US006821158B2

(12) United States Patent
Iida et al.

(10) Patent No.: US 6,821,158 B2
(45) Date of Patent: Nov. 23, 2004

(54) CONNECTOR

(75) Inventors: Mitsuru Iida, Tsu (JP); Narutoshi Hoshino, Katano (JP); Hirohisa Tanaka, Tsu (JP); Hidetoshi Takeyama, Hisai (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/344,705

(22) PCT Filed: May 24, 2002

(86) PCT No.: PCT/JP02/05032

§ 371 (c)(1),
(2), (4) Date: Feb. 25, 2003

(87) PCT Pub. No.: WO02/097931

PCT Pub. Date: Dec. 5, 2002

(65) Prior Publication Data

US 2003/0176111 A1 Sep. 18, 2003

(30) Foreign Application Priority Data

May 25, 2001 (JP) ..... 2001-157641
May 25, 2001 (JP) ..... 2001-157642
May 25, 2001 (JP) ..... 2001-157643
May 25, 2001 (JP) ..... 2001-157644

(51) Int. Cl.[7] ..... H01R 24/00
(52) U.S. Cl. ..... 439/660; 439/492
(58) Field of Search ..... 439/607, 492–495, 439/660

(56) References Cited

U.S. PATENT DOCUMENTS 5,738,545 A 4/1998 Igarashi et al.
6,066,000 A 5/2000 Masumoto et al.
6,267,623 B1 7/2001 Hisamatsu
6,332,801 B1 * 12/2001 Watanbe ..... 439/409
6,527,592 B2 * 3/2003 Mochizuki et al. ..... 439/660

FOREIGN PATENT DOCUMENTS

| | | |
|---|---|---|
| EP | 0933837 | 8/1999 |
| JP | 9-232039 | 9/1997 |
| JP | 9-259954 | 10/1997 |
| JP | 10208816 | 8/1998 |
| JP | 10284201 | 10/1998 |
| JP | 11111405 | 4/1999 |
| JP | 11283710 | 10/1999 |

OTHER PUBLICATIONS

English Language Abstract of JP 9–232039.
English Language Abstract of JP 9–259954.
English Language Abstract of JP 10–208816.
English Language Abstract of JP 10–284201.
English Language Abstract of JP 11–111405.
English Language Abstract of JP 11–283710.

* cited by examiner

*Primary Examiner*—Truc T. Nguyen
*Assistant Examiner*—James R. Harvey
(74) *Attorney, Agent, or Firm*—Greenblum & Bernstein, P.L.C.

(57) ABSTRACT

A connector has a connector plug and a connector receptacle for connecting a cable and a substrate. The connector plug has a shell made of a conductive material with both sides open, and an insulator made of a resin molding. The insulator has a first fitting part on a first side for mating with the connector receptacle, a second fitting part on the other side for mating with the cable, and a plurality of contacts disposed on the second fitting part side. The shell has flexible parts for flexibly contacting a connector receptacle shell mated with the first fitting part. The insulator is fit into the shell from an opening on one side of the shell.

9 Claims, 58 Drawing Sheets

CONNECTOR

TECHNICAL FIELD

The present invention relates to a connector having a connector plug and a connector receptacle for connecting a cable such as an FPC (flexible printed circuit board) to a substrate.

BACKGROUND ART

As shown in FIG. 53A, FIG. 53B, and FIG. 54, a conventional connector plug A for a connector with a shield used for interconnecting substrates in notebook computers and other electronic devices has a plurality of contacts 710, a metal first shell 720, a conductive metal second shell 740, and a molded resin insulator 730. The conductive metal second shell 740 is insert molded with the molded resin insulator 730, and a plurality of contacts 710 are press fit into the molded resin insulator 730.

A connector receptacle fitting 750 mating with a connector receptacle B as shown in FIG. 55A, FIG. 55B, and FIG. 55C is disposed to one side of the molded resin insulator 730, and an FPC fitting 760 mating with an FPC is disposed to the opposite side of the molded resin insulator 730.

A drawback of this conventional connector plug A is the number of parts in the shell, that is, the shell consists of two parts, i.e., the first shell 720 and second shell 740.

Another problem is that in order to reduce the overall thickness, the insulator 730 of the connector receptacle fitting 750 necessarily becomes thinner and mechanically weaker, making it necessary to insert mold the second shell 740 in order to retain sufficient strength.

A yet further problem is that the second shell 740 of the connector plug A contacts the conductive metal shell 774 of connector receptacle B, but because the second shell 740 has no flexible parts, ground contacts 772 for flexibly contacting the second shell 740 must be provided on the connector receptacle B side.

More specifically, a connector receptacle B as shown in FIG. 56A, FIG. 56B, FIG. 57, and FIG. 58 has been proposed.

This connector receptacle B has multiple contacts 771 for conductively contacting the contacts 710 of connector plug A, ground contacts 772 connected to a ground pattern of a wiring board, a support frame 773 made of a synthetic resin or other insulation material for supporting contacts 771 and ground contacts 772, and a metal shell 774 holding the contacts 771, ground contacts 772, and support frame 773.

As shown in FIG. 57 and FIG. 58, multiple contacts 771 are press fit into the support frame 773 at substantially equal intervals along the long side, and ground contacts 772 are similarly press fit into the support frame 773 separately from contacts 771. The open side of the shell 774 is then fit over the support frame 773 so as to enclose the contacts 771, ground contacts 772, and support frame 773, thus completing the connector receptacle B assembly. Contact terminals 771*a* disposed at the ends of the contacts 771 protrude from the back of the shell 774. The connector receptacle B is mounted to a wiring board with the contact terminals 771*a* bonded to the conductor pattern on the wiring board, and connector plug A is inserted to the front opening of the shell 774.

The shell 774 is stamped or pressed from a single piece of metal, and has a U-shaped section.

The shape of this prior art shell is thus complex and press forming the shell is increasingly difficult as the shell becomes thinner.

The present invention has been developed to overcome the above-described disadvantages.

It is accordingly an objective of the present invention to provide a connector having a connector plug with an FPC connection shield that can be made thin and is made of few parts, and a connector receptacle that can be made thinner without sacrificing shell manufacturability.

DISCLOSURE OF THE INVENTION

In accomplishing the above and other objectives, the present invention provides a connector having a connector plug and a connector receptacle for connecting a cable and a substrate where the connector plug has a shell made of a conductive material of which both sides are open, and an insulator made of a resin molding. The insulator has a first fitting part on a first side for mating with the connector receptacle, a second fitting part on a second side for mating with the cable, and a plurality of contacts disposed on the second fitting part side. The shell has flexible parts for flexibly contacting a connector receptacle shell mated with the first fitting part. The insulator is fit into the shell from an opening on one side of the shell.

By thus providing flexible parts for flexibly contacting the shell of the connector receptacle with the shell of the connector plug, it is not necessary to provide ground contacts on the connector receptacle. The number of parts in the connector receptacle is therefore reduced and the connector can be made thinner.

Preferably, recesses substantially U-shaped in section are formed on a surface of the insulator so as to extend in the direction of the first fitting part from the base between the insulator contacts, and the flexible parts are disposed inside these recesses. Interference between the insulator and flexible parts of the shell is thus prevented, and a thin connector plug can be achieved.

Further preferably, a shoulder for holding the cable to the contacts is formed on the second fitting part side on an inside surface of the shell opposite the insulator contacts. The contacts can thus only be deformed the size of the shoulder of the shell plus the thickness of the cable such as a flexible printed circuit board. Contact pressure between the contacts and a signal pattern of the cable, and between the shell and a ground pattern of the cable, is thus increased, and reliable contact can be assured.

Yet further preferably, the cable is a flexible printed circuit board (FPC) and a pressing part for pressing and positioning the FPC to an inside surface of the shell is formed at an edge of the shell opening on the second fitting part side. Deformation of the FPC away from this inside surface when the FPC is provisionally inserted or the FPC is fully connected can thus be prevented.

Yet further preferably, the shell has stops formed on both sides of the opening on the second fitting part side for preventing removal of the FPC, and the FPC has a protrusion formed on both sides at an end thereof. With this configuration, when the end of the FPC is inserted to the opening of the shell of the connector plug that is then provisionally positioned at a first position with respect to the insulator and when both the shell of the connector plug and the FPC are slid toward the first fitting part side from the first position to a second position where the insulator and the shell of the connector plug engage, the contacts flexibly deform to hold the FPC between the contacts and the inside surface of the shell of the connector plug.

The FPC is thus positioned by the FPC presser parts and stops of the shell when the FPC is inserted, skewed insertion of the FPC is thus prevented, and it is easier to fit the FPC to the shell.

Yet further preferably, the connector receptacle has a plurality of contacts for conductively contacting the contact of the connector plug, a support frame made of an insulation material for supporting and arraying the contacts, a first shell made of metal extending through the length of the contact array, and a second shell extending through the length of the contact array. The first and second shells engage with each other so that the contacts of the connector receptacle and the support frame are disposed therebetween, and an insertion opening for inserting the connector plug is formed therebetween, wherein a plurality of recesses enabling free insertion and removal of the contacts of the connector receptacle are formed to the support frame along an open edge of the insertion opening.

Interference between the support frame and ends of the contacts is thus prevented when the connector plug is inserted from the insertion opening, and the connector can be made even thinner.

Further preferably, the support frame has a fitting hole into which is press fit a tab projecting from the first or second shell to the other shell. Positive contact between the first and second shells can thus be assured, and the ground potential can be stabilized when mounted to a circuit board. It is also possible to suppress deformation, particularly increasing the opening, in the thickness direction of the connector when the connector plug is inserted from the insertion opening.

Yet further preferably the tab of the one shell is welded to the other shell. This further improves conductivity between the first and second shells, further improving the stability of the ground connection, and increasing strength in the insertion direction of the first and second shells.

Yet further preferably an insulation member for insulating between the first shell and each of the contacts is formed integrally to the first shell, and the insulation member has a press-fitting part to which is press fit a tab projecting from the second shell toward the insulation member. This further suppresses deformation in the thickness direction of the connector when the connector plug is inserted from the insertion opening.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

The preferred embodiments of the present invention are described below with reference to the accompanying figures.

Embodiment 1

Figures 1A, 1B:
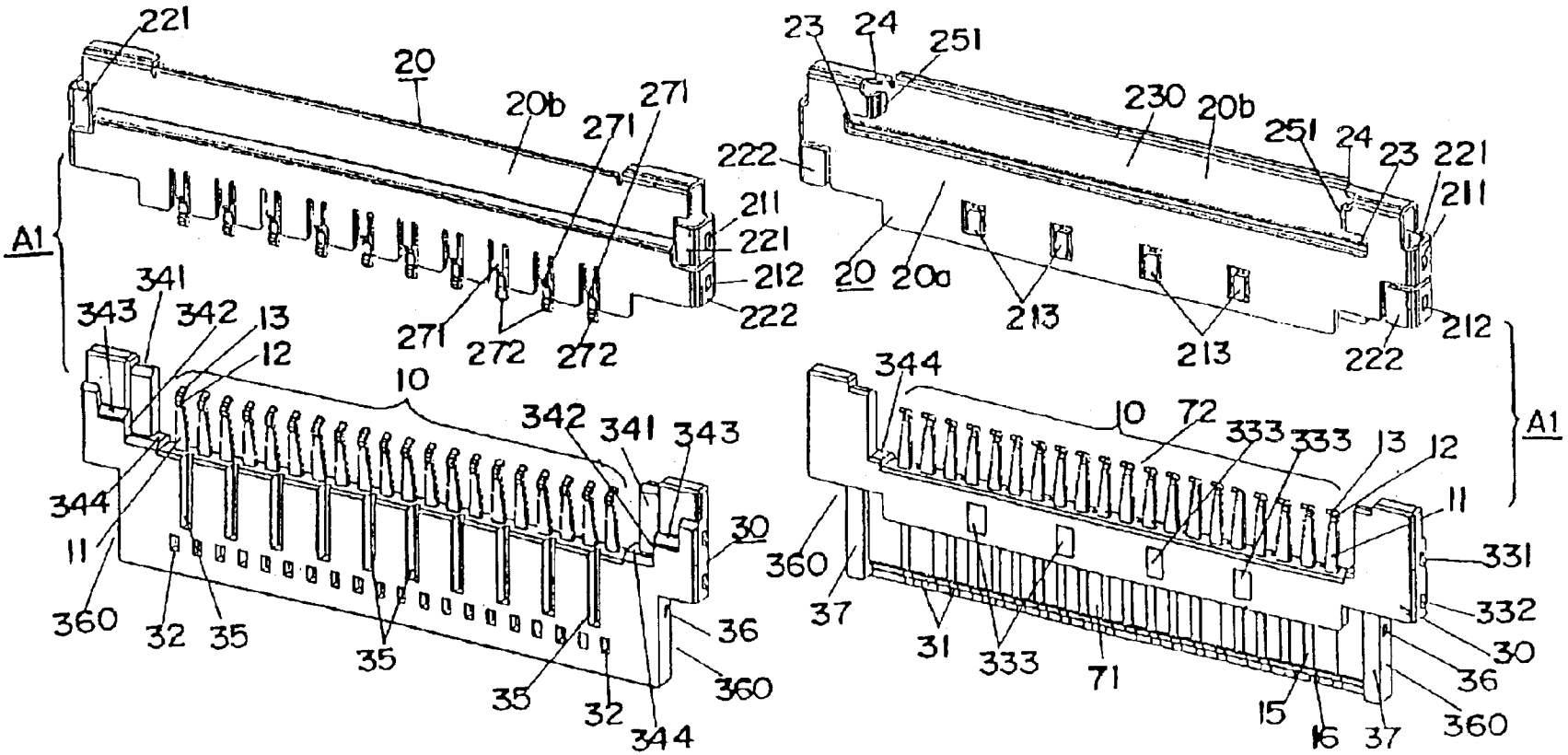
FIG. 1A is an exploded perspective view from the front of a connector plug according to a first embodiment of the invention.
FIG. 1B is an exploded perspective view from the back of the connector plug shown in FIG. 1A.

FIG. 1A and FIG. 1B show a connector plug A1 with a shield for FPC connection according to a first embodiment of the invention. This connector plug A1 has a shell 20 made by stamping and shaping a conductive metal sheet in a press, or example, and an insulator 30 made of a synthetic resin molding having a plurality of insert molded contacts 10.

Figure 2A:
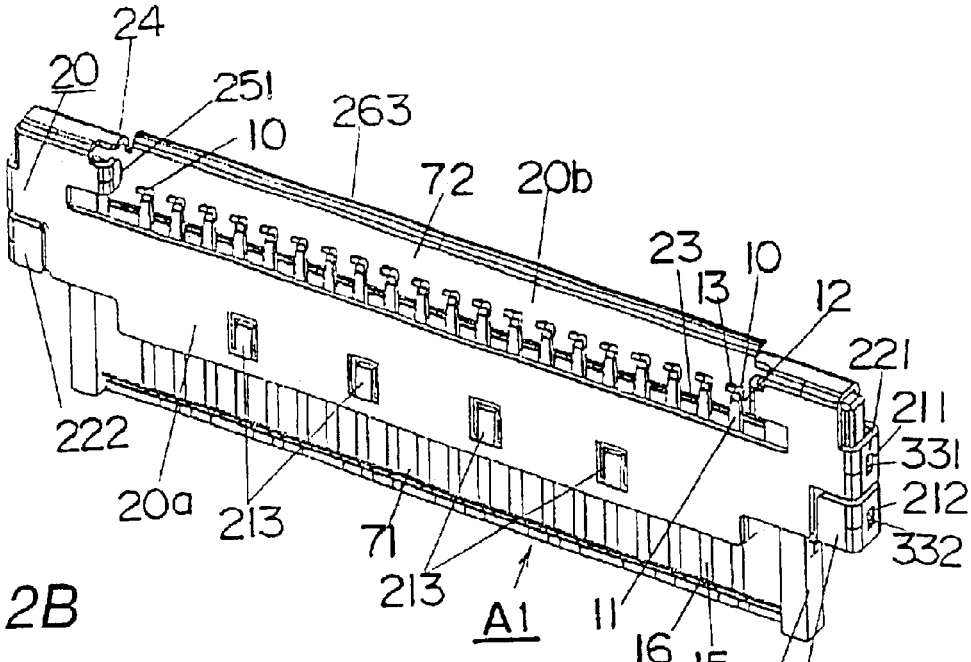
FIG. 2A is a perspective view from the back showing the shell slid into the insulator.
Figure 2B:
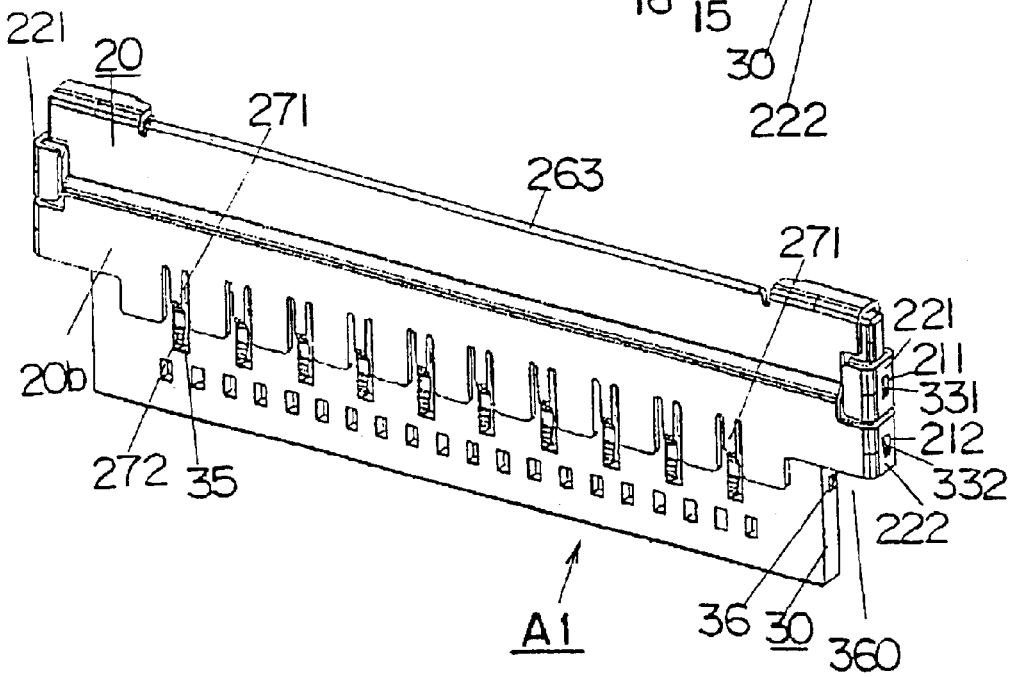
FIG. 2B is a perspective view from the front showing the shell slid into the insulator.

As shown in FIG. 2A and FIG. 2B, the insulator 30 has a connector receptacle fitting 71 on one side for mating with a connector receptacle and an FPC fitting 72 on the other side for mating with an FPC 50 (see FIG. 8).

The contacts 10 are disposed at a constant interval by insert molding widthwise along the edge of the other side of the insulator 30 (the top edge as seen in FIG. 1A and FIG. 1B). Each of the contacts 10 has a flexible part 11 effective for flexible contact with a signal pattern 51 of the FPC 50 (see FIG. 8A and FIG. 8B), a contact part 12 for contact with the signal pattern 51 of the FPC 50, a guide part 13 with a substantially U-shaped side section, a non-flexible part 14 fixed by insert molding to the insulator 30, a contact surface 15 for contacting the contacts 401 of the connector receptacle B1 shown in FIG. 6, an inclined guide part 16, and a support part 17 supported by the die during insert molding. The guide part 13 prevents bending the contacts 10 when the FPC 50 is inserted to an opening 23 (see FIG. 1B) of the shell 20 (further described below). The guide part 16 prevents bending the contacts 401 of the connector receptacle B1 when the connector plug A1 is engaged with the connector receptacle B1 using the connector receptacle fitting 71.

The shell 20 has front and back parallel sides 20*a* and 20*b* formed in an inverted U-shape from a single conductive metal plate, forming an opening 230 across the top of one side 20*a* from the top edge as seen in FIG. 1B and forming the opening 23 between the sides 20*a*, 20*b* below opening 230. First bent tabs 221 are formed at both ends of one side 20*a*, and second bent tabs 222 are formed at both ends of the other side 20*b*. Both first bent tab 221 and second bent tabs 222 are substantially U-shaped when seen in horizontal section. The free ends of first bent tab 221 are substantially parallel to the surface of side 20*b*, and the free ends of second bent tabs 222 are substantially parallel to the surface of side 20*a*. A hole 211, 212 is formed in the center side of the first bent tab 221 (the part at the end of the shell 20) and the center side of the second bent tabs 222 (the part at the end of shell 20) for engaging tabs 331, 332, which are formed on the ends of the insulator 30, when slid and fit into the shell 20 such that second bent tab 222 is positioned below first bent tab 221 as seen in FIG. 1A and FIG. 1B.

When the shell 20 is provisionally inserted to the insulator 30 from the FPC fitting 72 side, tab 331 on the FPC fitting 72 side engages hole 212 in second bent tabs 222, and when the shell 20 is slid and fit completely to the insulator 30, tab 332 engages hole 212 of second bent tab 222 and tab 331 engages hole 211 in first bent tab 221.

Figures 3A, 3B, 3C:
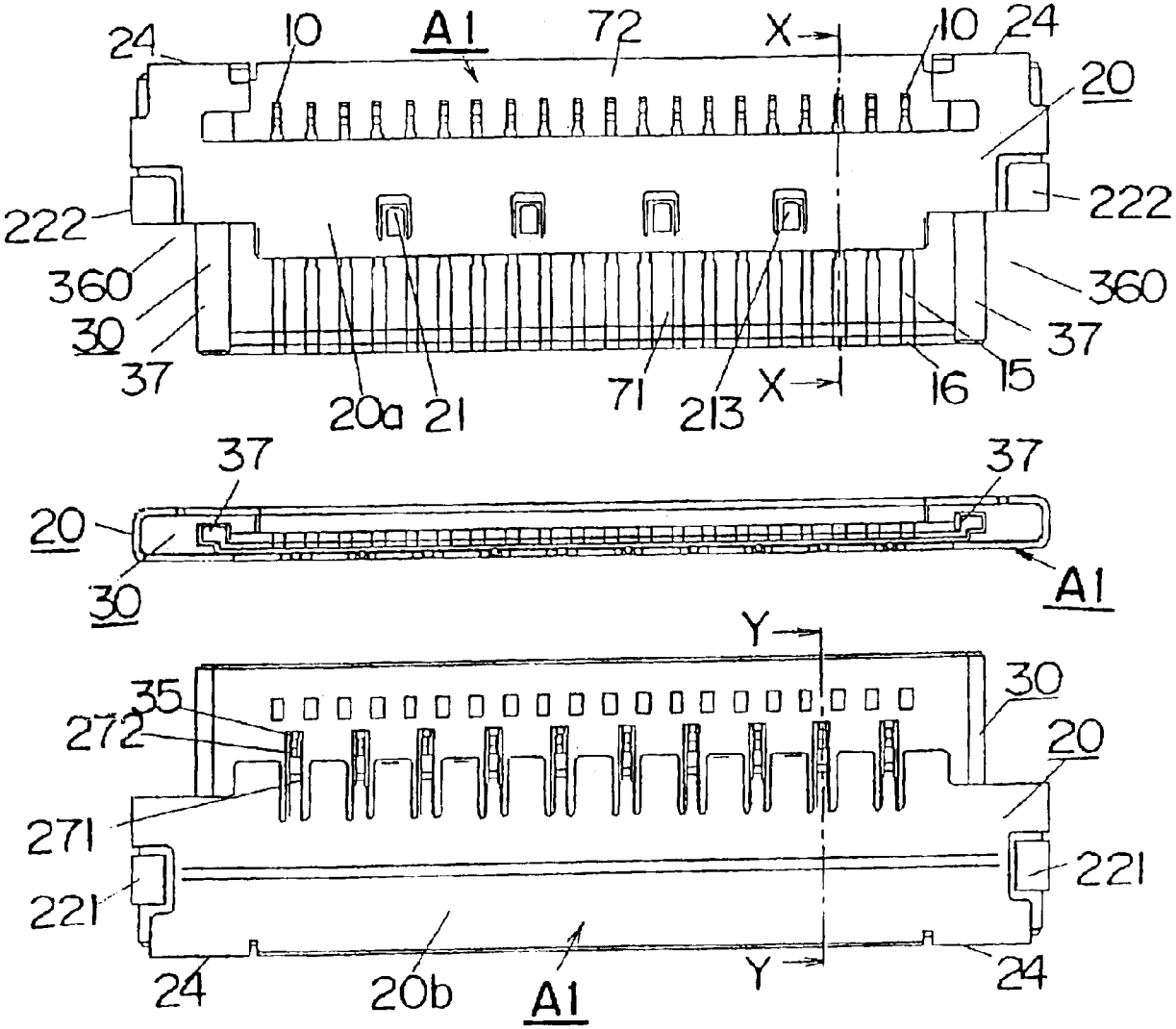
FIG. 3A is a back view showing the shell slid into the insulator.
FIG. 3B is a bottom plan view showing the shell slid into the insulator.
FIG. 3C is a front view showing the shell slid into the insulator.
Figure 4:
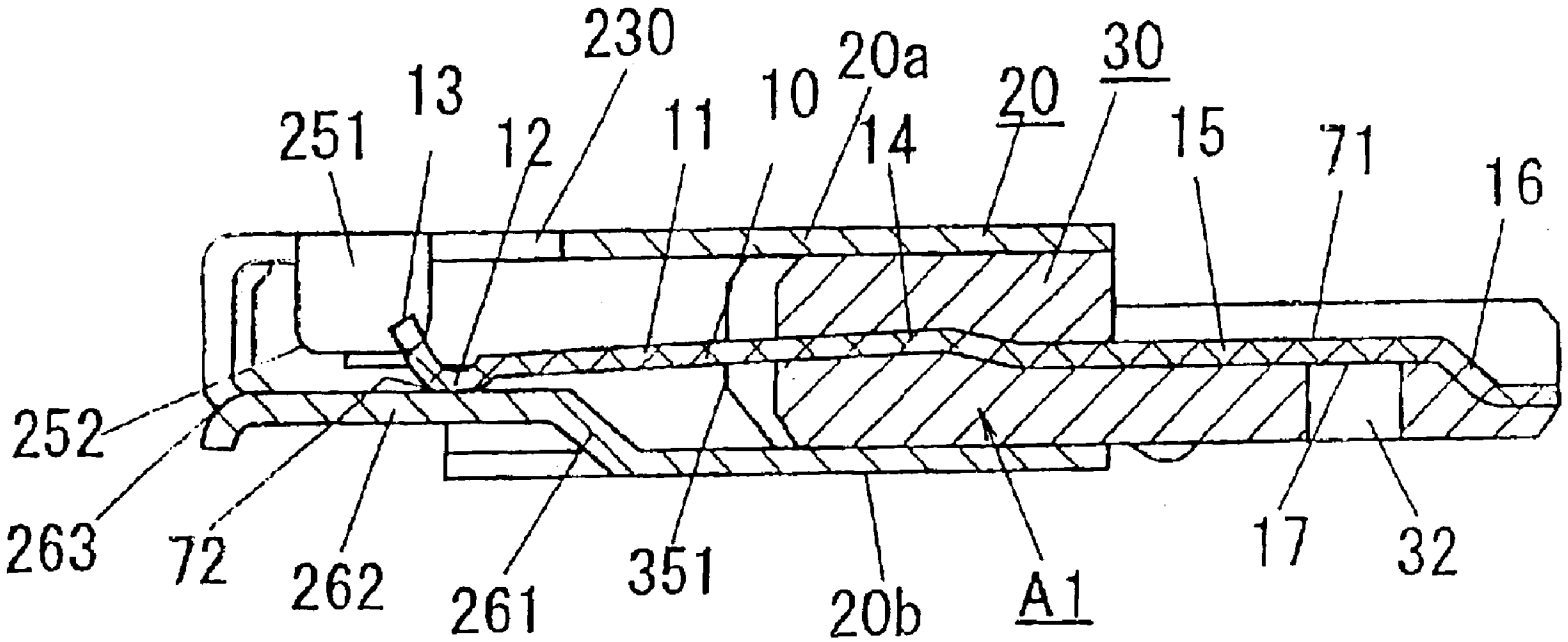
FIG. 4 is a side sectional view showing the shell slid into the insulator.
Figure 5:
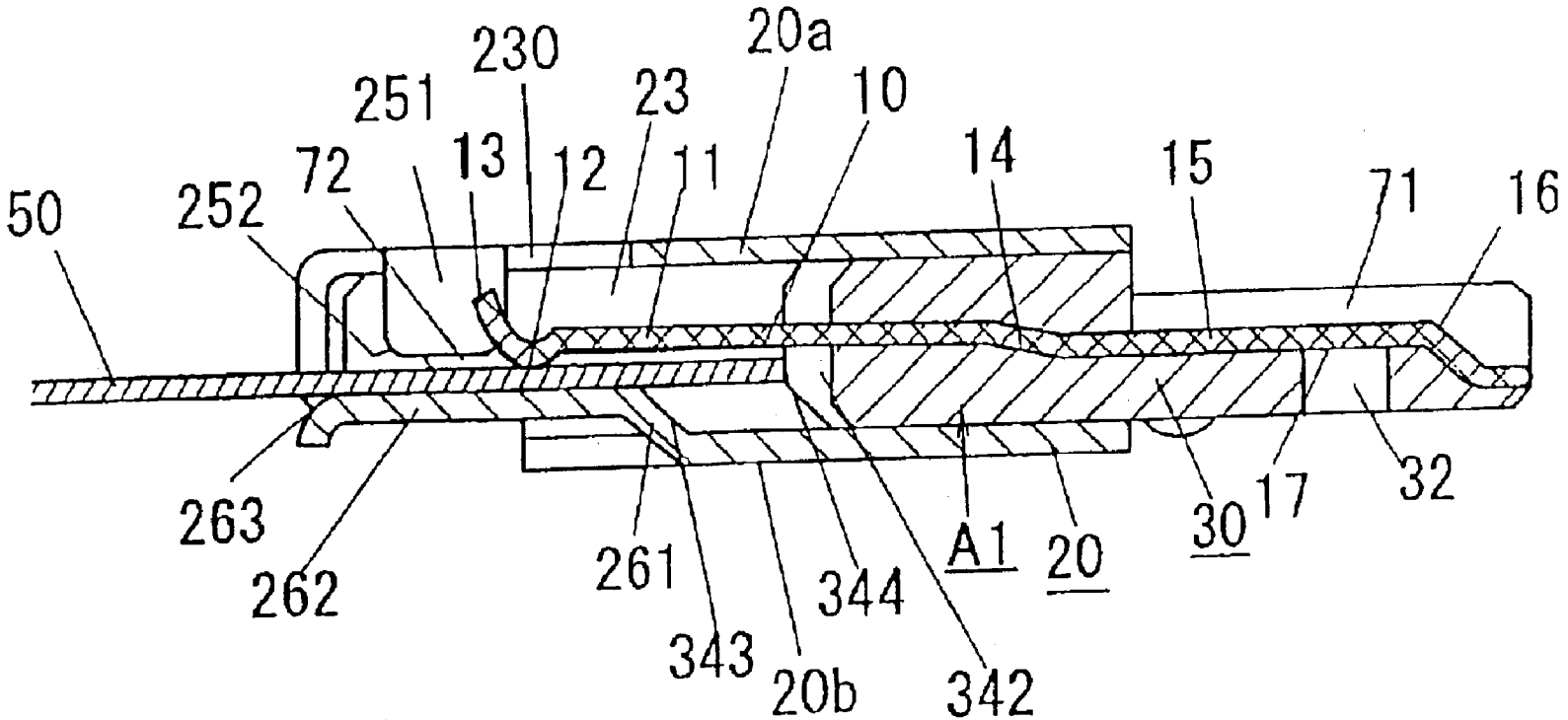
FIG. 5 is a sectional view through line X—X in FIG. 3A showing the connector plug to which the FPC is connected.

Sliding and fitting the shell 20 into the insulator 30 is shown in FIGS. 2A and 2B, FIGS. 3A to 3C, FIG. 4, and FIG. 5. FIG. 2A and FIG. 2B are perspective views from the front and back, respectively, showing the shell 20 slid and fit into the insulator 30. FIGS. 3A to 3C are front, bottom, and rear views of the shell 20 slid and fit to the insulator 30. FIG. 4 is a side sectional view of the shell 20 engaged with the insulator 30, and FIG. 5 is a side sectional view of the FPC 50 engaged with shell 20 and shell 20 fit into the insulator 30.

Figure 7:
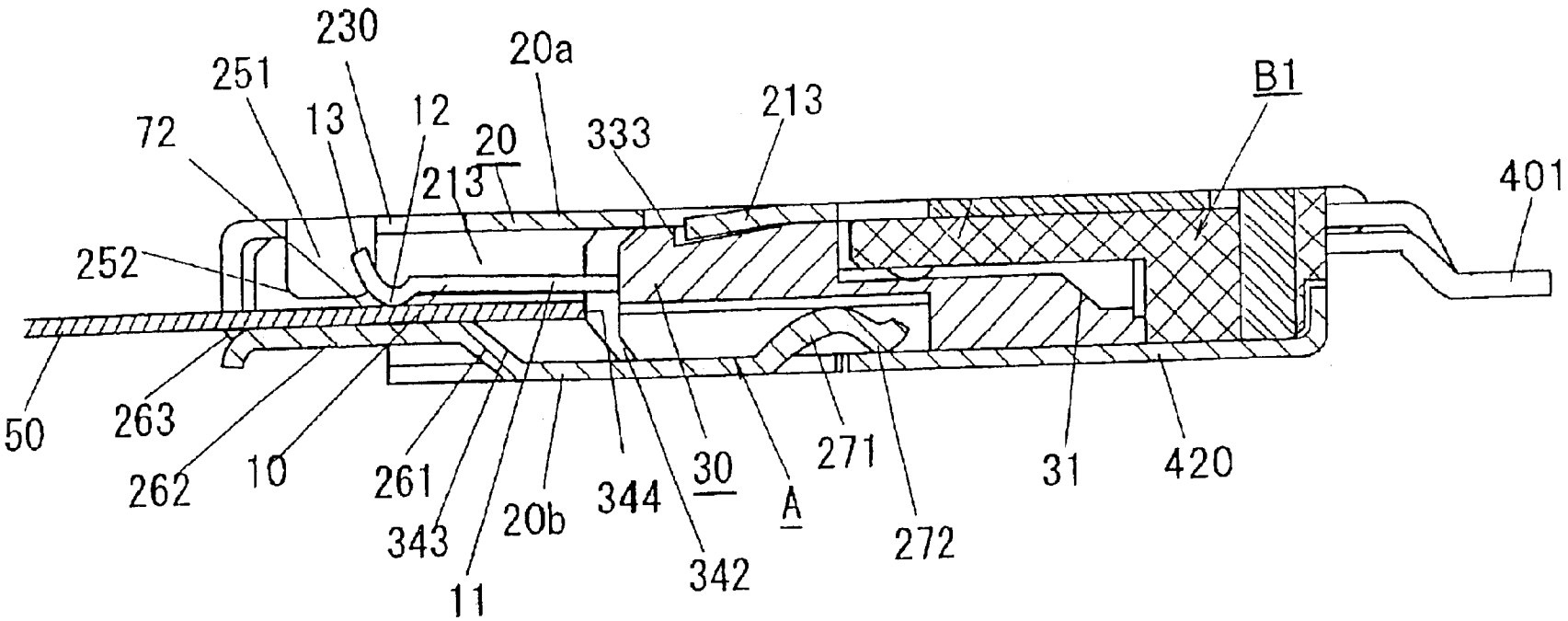
FIG. 7 is a sectional view through line Y—Y in FIG. 3C showing the connector plug to which the connector receptacle is connected.

Tabs 213 are punched out at a specific interval to both sides on the inside of side 20*a* so that when the shell 20 is slid into the insulator 30 as described above, the tabs 213 engage matching recesses 333 formed in the insulator 30 opposite the inside surface of side 20*a*, as shown in FIG. 7.

First bent tab 221 prevents deformation in the direction of side 20*a* of shell 20 (up as seen in FIG. 4) and second bent tabs 222 prevent deformation in the direction of side 20*b* of shell 20 (down as seen in FIG. 4).

Figure 11A:
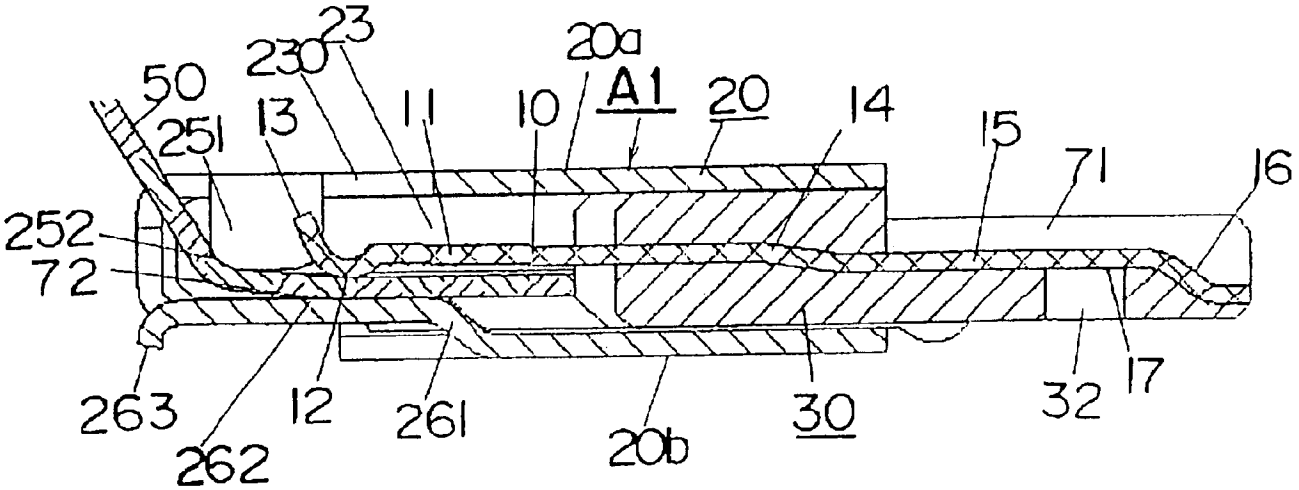
FIG. 11A is a sectional view showing the FPC deformed when fully inserted.
Figure 11B:
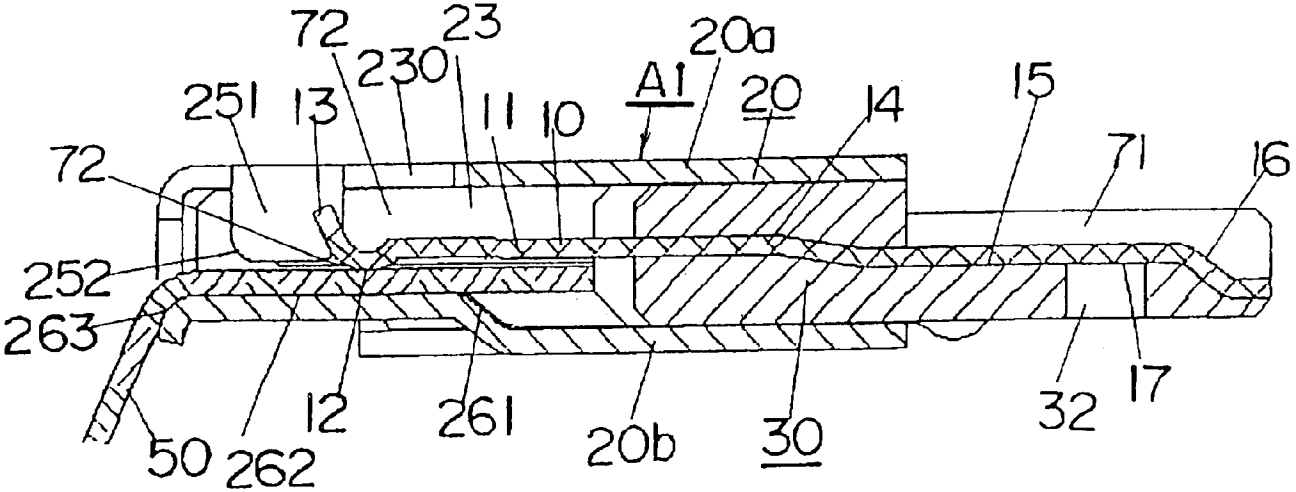
FIG. 11B is a sectional view showing the FPC deformed differently when fully inserted.
Figure 12:
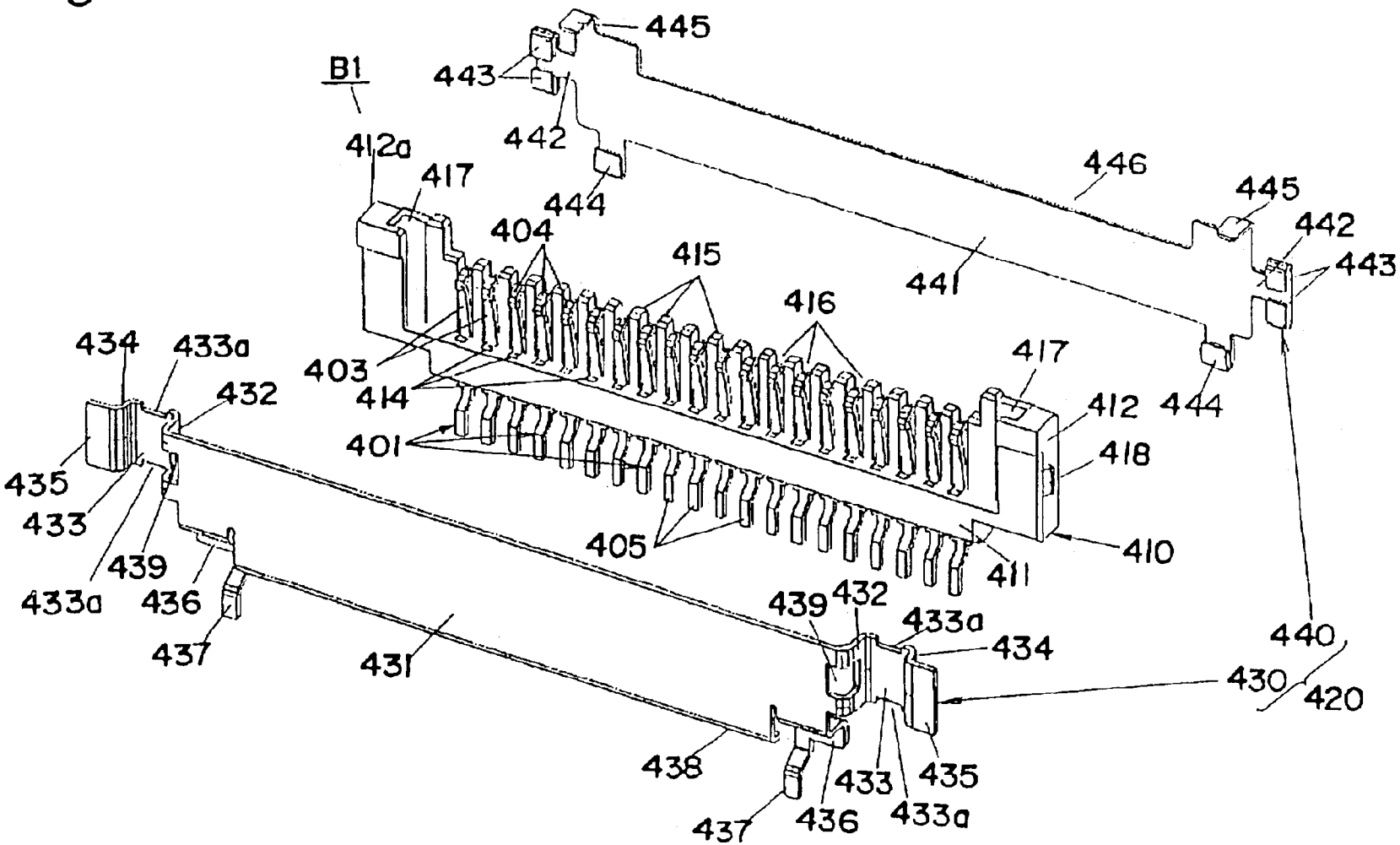
FIG. 12 is an exploded perspective view of a connector receptacle according to a first embodiment of the present invention.

Catches 24 preventing removal of the FPC 50 are provided beside opening 230 on both ends of the inversely U-shaped center part (top side part) of the top edge of FIG. 1A and FIG. 1B connecting sides 20*a*, 20*b* of shell 20, and L-shaped FPC pressing part 251 preventing upward (as seen in FIG. 4) deformation of FPC 50 in FPC fitting 72 is integrally formed from the ends beside the vertical part of opening 230 on the inversely U-shaped side 20*a* side toward the other side 20*b*. A shoulder 261 for holding FPC 50 to contacts 10 is formed from side to side in the middle of side 20*a*, and a contact part 262 for contact with ground pattern 52 of FPC 50 is disposed between the position of this shoulder 261 and the leading edge (top in FIG. 1A and FIG. 1B). A curved part (arc part) 252 is formed on the corner of FPC pressing part 251 (top edge in FIG. 1A and FIG. 1B) to prevent tears in the surface of the FPC 50 when the FPC 50 is upwardly deformed (see FIG. 11A) after inserting the FPC 50, and a curved part (arc part) 263 is formed on the edge (top side in FIG. 1A and FIG. 1B) of side 20*b* to prevent tears in the surface of the FPC 50 when the FPC 50 is downwardly deformed (see FIG. 11B) after inserting the FPC 50. A plurality of parallel flexible parts 271 are formed at a specific interval on the bottom edge of side 20*b* (bottom in FIG. 1A and FIG. 1B) as flexible parts having contact parts 272 for flexibly contacting the inside surface of shell 420 of connector receptacle B1 on the ends thereof.

Guide parts 31 having an inclined surface for preventing bending of the contacts 401 of connector receptacle B1 when fitting with connector receptacle B1 are formed to the insulator 30 on the one side of connector receptacle fitting 71 (bottom in FIG. 1A and FIG. 1B), and holes 32 for pressing the contacts 10 by the die during insert molding are formed on the connector receptacle fitting 71 side (bottom in FIG. 1A and FIG. 1B). The above-noted tab 331 and tab 332 are formed on both sides, and recesses 333 are formed in one top surface. Furthermore, presser surface 341 for preventing upward deformation of the FPC 50 (in FIG. 5), positioning surface 342 for preventing deformation of the FPC 50 to the sides, guide surface 343 for guiding the shell 20 when inserting to the shell 20, and contact surface 344 for positioning the FPC 50 when connecting the FPC 50, are disposed on both sides of one edge to which contacts 10 are disposed (top edge in FIG. 1A and FIG. 1B). On the surface side opposite the inside surface of side 20*b* of shell 20 are housed flexible parts 271 so as not to interfere with flexible parts 271 disposed to shell 20, and recesses 35 with a basically U-shaped section for exposing the contact surfaces of the end contact parts 272 are formed between contacts 10 and contacts 10 extending from the base of the contacts 10 in the direction of connector receptacle fitting 71. Furthermore, tabs 36 for provisionally engaging the connector receptacle B1, and a rotationally asymmetric mechanism 37 for preventing improper mating with the connector receptacle B1, are disposed at the bottom on both sides beside recesses 360.

Figure 8A:
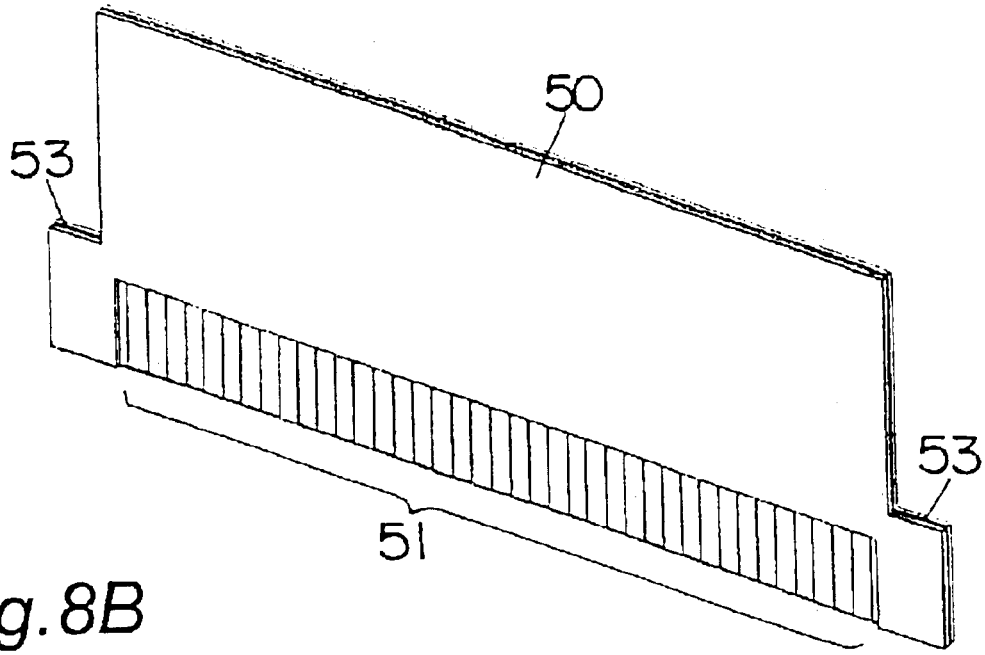
FIG. 8A is a perspective view of the FPC from the front.
Figure 8B:
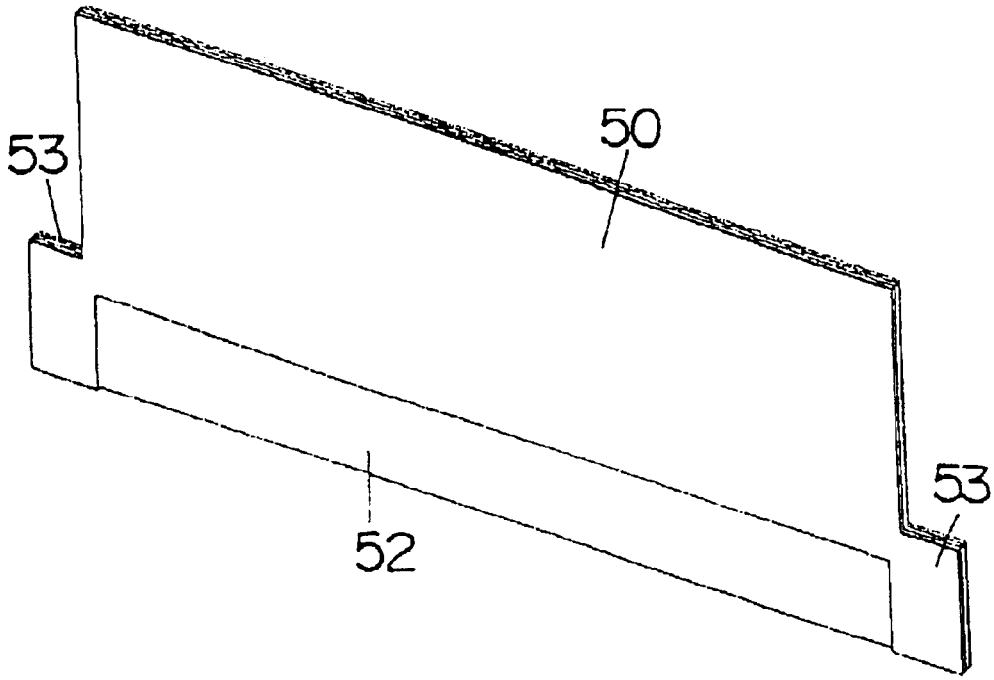
FIG. 8B is a perspective view of the FPC from the back.

FPC 50 mating with the connector plug A1 having an FPC connection shield according to this embodiment of the invention has signal pattern 51 on the front side as seen in FIG. 8A and ground pattern 52 on the back side as seen in FIG. 8B. Protrusions 53 projecting to the sides are also disposed on both sides of the front edge of the FPC 50 for engaging the catches 24 of the shell 20. These protrusions 53 projecting to opposite sides give the FPC 50 a T-shape.

Assembling this connector plug A1 is described next with reference to FIG. FIG. 1A and FIG. 1B.

First, the insulator 30 with insert-molded contacts 10 is inserted from the FPC fitting 72 thereof to the shell 20 from the opening on the bottom side of the shell 20, and the insulator 30 is inserted to the shell 20 until tab 331 of the insulator 30 is engaged with hole 212 of shell 20 from the inside, thus provisionally locking the insulator 30 in shell 20.

The procedure for fitting FPC 50 to connector plug A1 in this provisional locking condition is further described below based on FIGS. 9A to 9D.

Figures 9A, 9B, 9C, 9D:
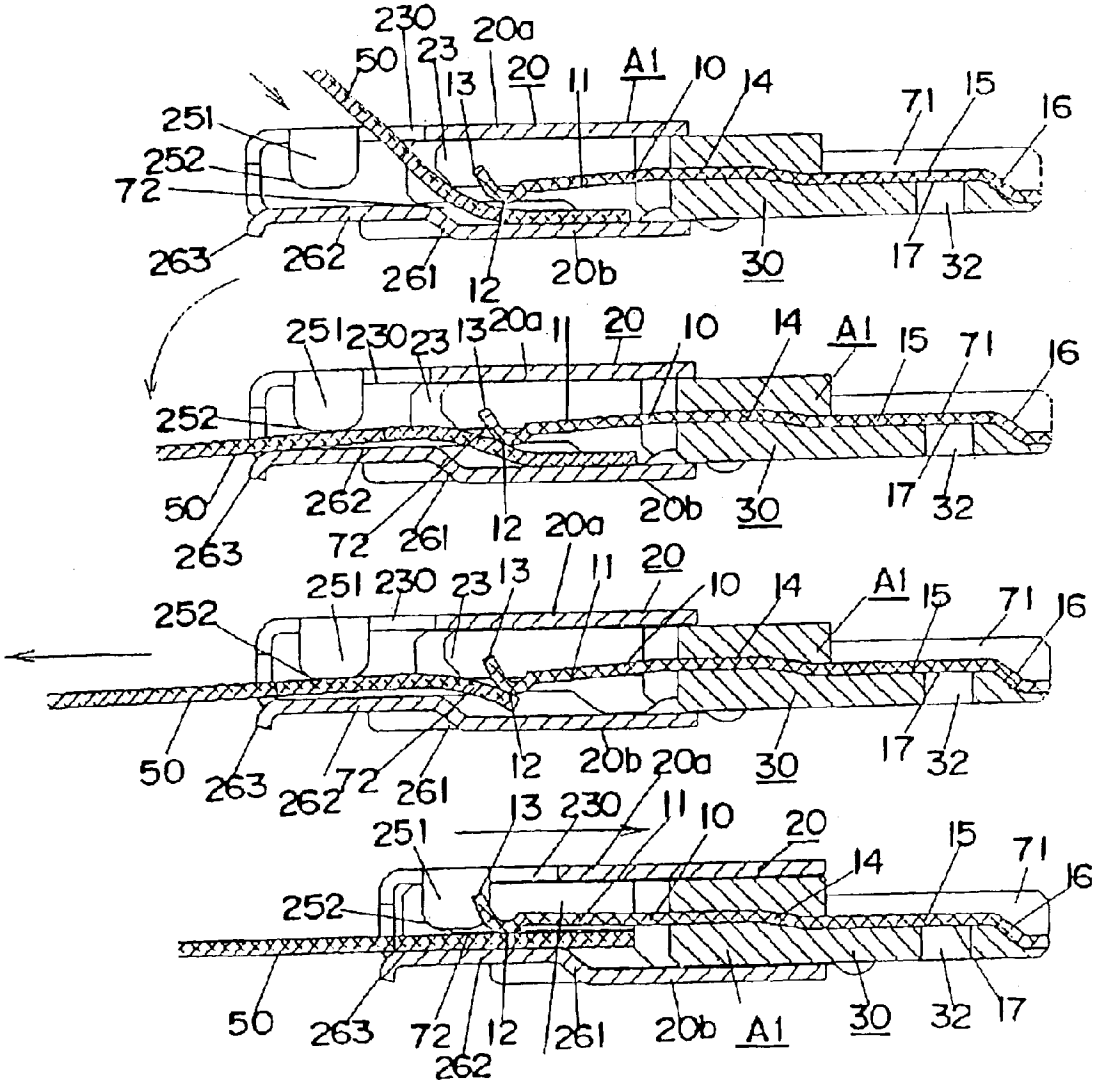
FIGS. 9A, 9B, 9C and 9D show the FPC assembly procedure.
Figure 10B:
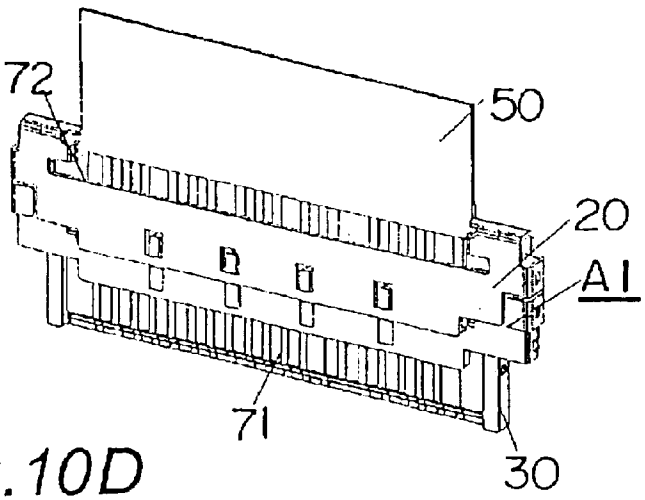
FIG. 10B is a perspective view from the back of the partially inserted FPC.
Figure 10D:
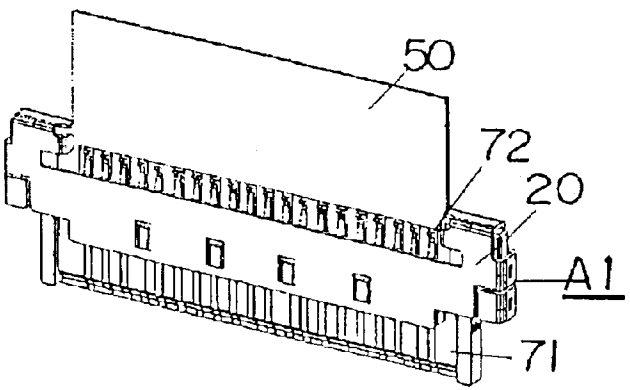
FIG. 10D is a perspective view from the back of the fully inserted FPC.
Figure 10A:
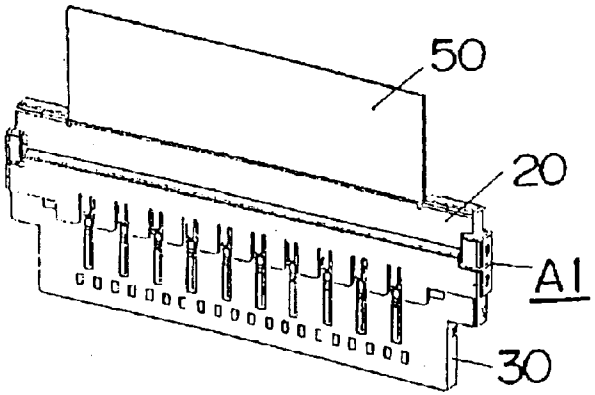
FIG. 10A is a perspective view from the front of the partially inserted FPC.

First, as shown in FIG. 9A, the leading edge on the connection side of FPC 50 is inserted from above at a downward angle into the space between sides 20*a*, 20*b* of shell 20 through opening 23 from the opening 230 side of shell 20 for FPC fitting 72, and is guided by the inclined surface of shoulder 261 between contacts 10 and the inside surface of side 20*a*. As shown in FIG. 9B, FPC 50 is then bent down so as to enter between FPC pressing part 251 of shell 20 and contact part 262. FIG. 10A and FIG. 10B are perspective views from the front and back at this time.

Next, as shown in FIG. 9C, FPC 50 is pulled back in the direction of the arrow until protrusions 53 of FPC 50 contact catches 24 of shell 20. The shell 20 and FPC 50 are then slid together in the direction of the arrow shown in FIG. 9D until tabs 332 on both sides of insulator 30 engage corresponding holes 212 in shell 20, both tabs 331 of insulator 30 engage corresponding holes 211 in shell 20, and tabs 213 of shell 20 are engaged in recesses 333 of insulator 30.

Figure 10C:
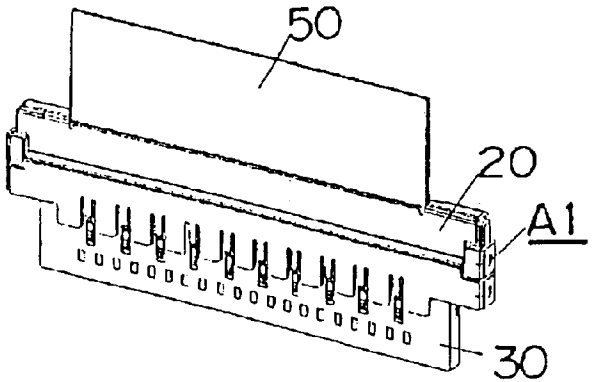
FIG. 10C is a perspective view from the front of the fully inserted FPC.

The flexible part 11 of contacts 10 flexibly deforms as the shell 20 and FPC 50 slide, and this deformation produces contact pressure establishing contact between signal pattern 51 of FPC 50 and contact part 12 of contacts 10, and between ground pattern 52 and ground pattern contact part 262 of shell 20. FIG. 5 is a sectional view of this state, and FIG. 10C and FIG. 10D are front and back perspective views of the same.

Figure 6:
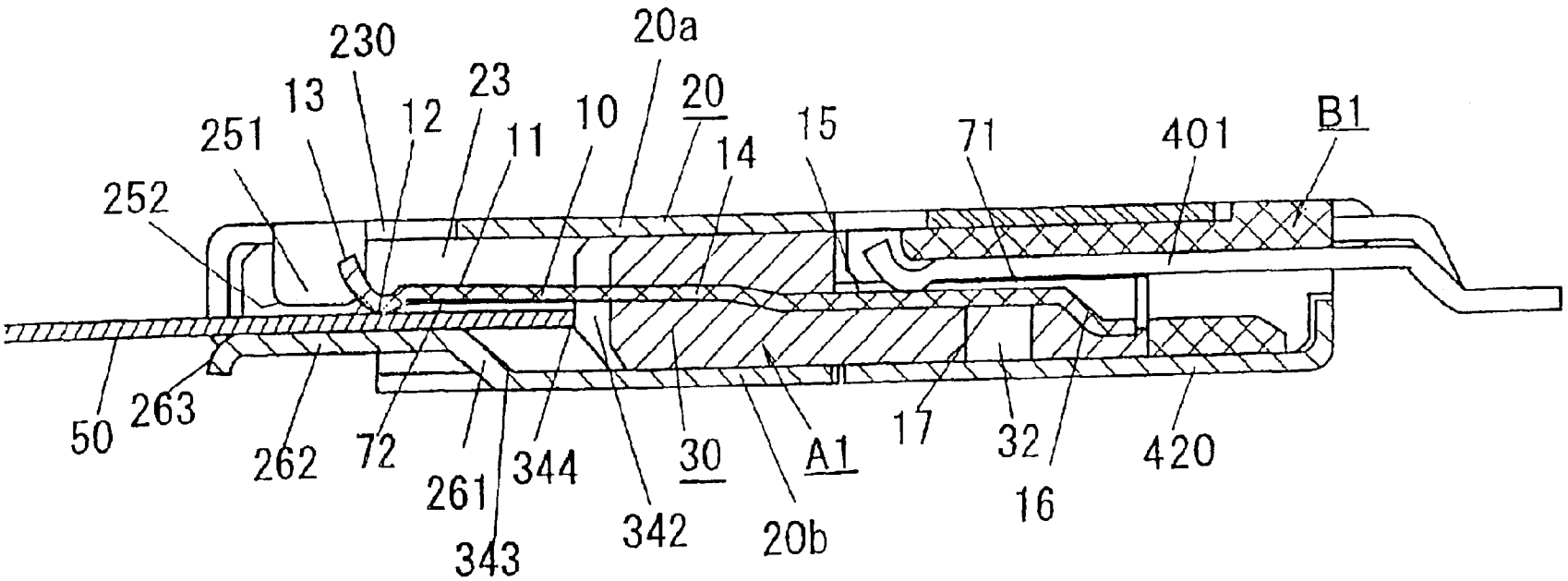
FIG. 6 is a sectional view through line X—X in FIG. 3A showing the connector plug to which a connector receptacle is connected.

When connector receptacle B1 is fit to the connector receptacle fitting 71 of connector plug A1 as shown in FIG. 6 and FIG. 7, the flexible part of contacts 401 of connector receptacle B1 deforms. This deformation produces contact pressure establishing contact between shell 20 of connector plug A1 and shell 420 of connector receptacle B1. At the same time contact parts 272 at the free end of flexible parts 271 of connector plug A1 shell 20 flexibly contact the inside surface of shell 420 and deform, producing contact pressure against the inside surface of shell 420, thus electrically connecting shell 420 of connector receptacle B1 and shell 20 of connector plug A1 together forming an external shield casing.

A connector receptacle B1 according to the present invention is described next.

As shown in FIG. 12 to FIG. 15, the connector receptacle B1 according to this embodiment of the invention has a plurality of contacts 401 for conductively contacting contacts 10 of connector plug A1, a support frame 410 supporting the contacts 401, and a shell 420 housing the contacts 401 and support frame 410 and shielding the contacts 401. The shell 420 includes a first shell 430 and a second shell 440 fastened together with the contacts 401 and support frame 410 therebetween.

The support frame 410 is a resin plastic molding having a long rod-like main part 411, pillars 412*a* and 412*b* projecting widthwise to the main part 411 from the lengthwise ends of the main part 411, and thin wall 413 extending in the same direction as pillars 412*a* and 412*b* from one edge along the thickness direction of main part 411 between pillars 412*a* and 412*b*. A plurality of mounting holes 414 passing through the thickness direction of the main part 411 are formed at equal intervals in the lengthwise direction. Contacts 401 are press fit into these mounting holes 414 as further described below.

A plurality of protrusions 415 for insulating the individual contacts 401 inserted to the mounting holes 414 also project from the wall 413 at equal intervals along the lengthwise direction of main part 411. The protrusions 415 are arrayed in a comb-like fashion with the ends thereof projecting beyond the ends of the wall 413 such that a comb part is formed with recesses (channels) 416 at a location delimited by the ends of adjacent protrusions 415 and the end of wall 413.

Guide channels 417 are formed at the mutually opposing inside surfaces of the pillars 412*a* and 412*b*. Matching protrusions on the connector plug A1 fit into guide channels 417 in only one direction. The guide channels 417 thus control the direction in which the connector plug A1 can be inserted and thereby prevent improper connection. Tabs 418 for engaging the first shell 430 are disposed protruding from the outside surface of the pillars 412*a* and 412*b*.

Figure 15:
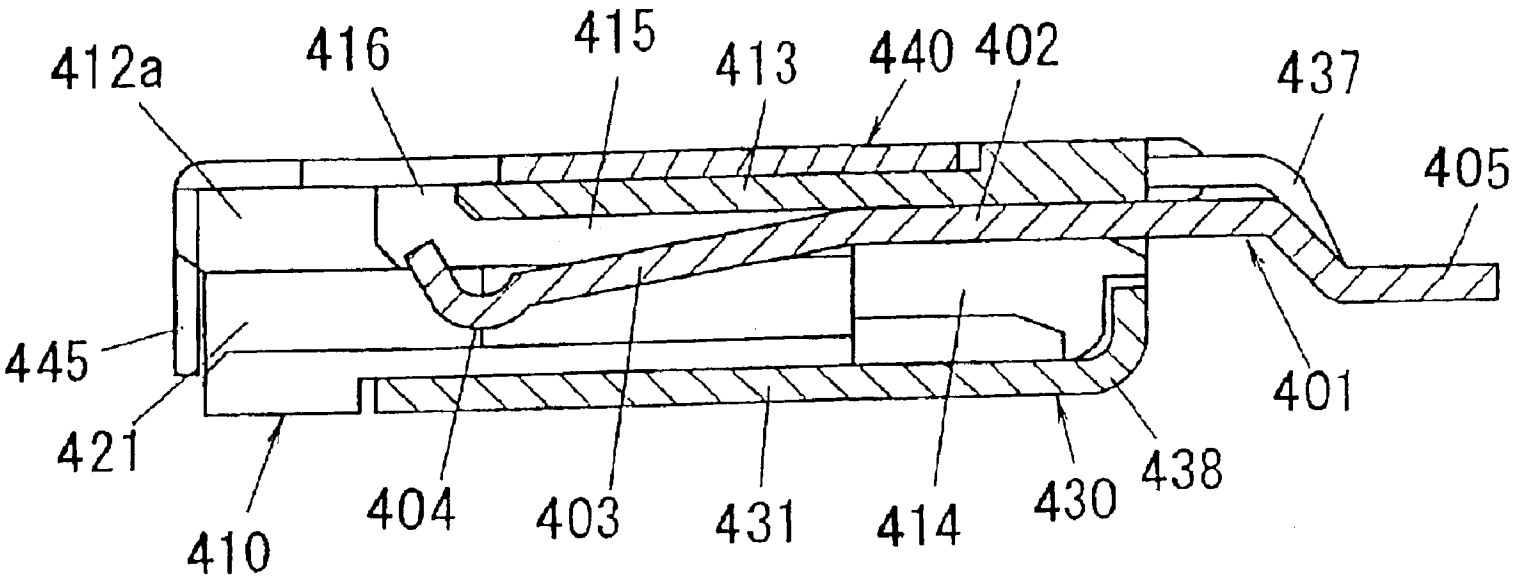
FIG. 15 is a sectional view through line X—X in FIG. 14A.

Contacts 401 are formed by shaping a flexible metal sheet material as shown in FIG. 15 and have a flat support part 402 supported by support frame 410, spring part 403 inclined in the thickness direction from the free end of support part 402, contact part 404 formed by bending the end of spring part 403 in an arc, and hook-like contact terminal part 405 projecting from the back end of support part 402.

The first shell 430 is formed by stamping or bending a metal sheet material, and has a flat rectangular main part 431, bent parts 432 formed by bending the ends in the lengthwise direction of main part 431 substantially perpendicularly in the same direction, first locking tabs 433 extending substantially parallel to the main part 431 from the ends of the bent parts 432, bends 434 formed by substantially perpendicularly bending the ends of first locking tabs 433, and connection parts 435 extending substantially parallel to the main part 431 from the ends of bends 434. The first shell 430 also has second locking tabs 436 substantially parallel to main part 431 and projecting in the same direction as first locking tabs 433 from both ends at one lengthwise edge (the back edge) of the main part 431, terminal parts 437 with a deformed L-shape projecting in the widthwise direction of main part 431 from the ends of second locking tabs 436, extension 438 with an L-shape in top plan view, and rectangular engaging holes 439 passing through the thickness direction between main part 431 and bent parts 432. Extension 438 projects from the back edge of main part 431 between second locking tabs 436 with the long edge bent into an L-shape.

The second shell 440 is similarly formed by stamping or bending a metal sheet material, and has a flat rectangular main part 441, end tabs 442 projecting from the middle of the lengthwise ends of the main part 441, a pair of first crimping parts 443 projecting from both edges in the widthwise direction at the ends of tabs 442, second crimping parts 444 projecting in the widthwise direction of main part 441 from both ends along one lengthwise edge (back edge) of main part 441, and pressing tabs 445 rising perpendicularly to main part 441 from both ends at the other lengthwise edge (front edge) of the main part 441. A recess 446 is also formed along the front lengthwise edge of the main part 441.

Assembling a connector receptacle B1 thus comprised according to this embodiment of the invention is described next.

First, the plural contacts 401 are pressed into the plural corresponding mounting holes 414 disposed in the main part 411 of support frame 410 so that the contacts 401 are supported at equal intervals in the support frame 410. The protrusions 415 are positioned between adjacent contacts 401 at this time, and adjacent contacts 401 are thus insulated by the protrusions 415. The contact terminal part 405 of each contact 401 also projects from the back edge of main part 411 of support frame 410.

The first shell 430 is then provisionally fixed to one side of the support frame 410 having the contacts 401 mounted therein by engaging the tabs 418 on the side of pillars 412*a* and 412*b* of support frame 410 with engaging holes 439 of first shell 430. Finally, the second shell 440 is placed against the other side of support frame 410, the first crimping parts 443 of second shell 440 are crimped to the first locking tabs 433 of first shell 430, and the second crimping parts 444 of second shell 440 are crimped to the second locking tabs 436 of first shell 430, thereby fastening first shell 430 and second shell 440 together with contacts 401 and support frame 410 therebetween and forming connector receptacle B1 housing contacts 401 and support frame 410 in shell 420.

Recesses 433*a* fitting first crimping parts 443 are formed to first locking tabs 433, and first crimping parts 443 are fit into recesses 433*a* to prevent shifting of first locking tabs 433 and first crimping parts 443. In addition, the support frame 410 is fixed with tabs 445 of second shell 440 contacting the front of pillars 412*a* and 412*b* of support frame 410. The contacts 401 and second shell 440 are insulated by wall 413 projecting from main part 411.

Figure 16:
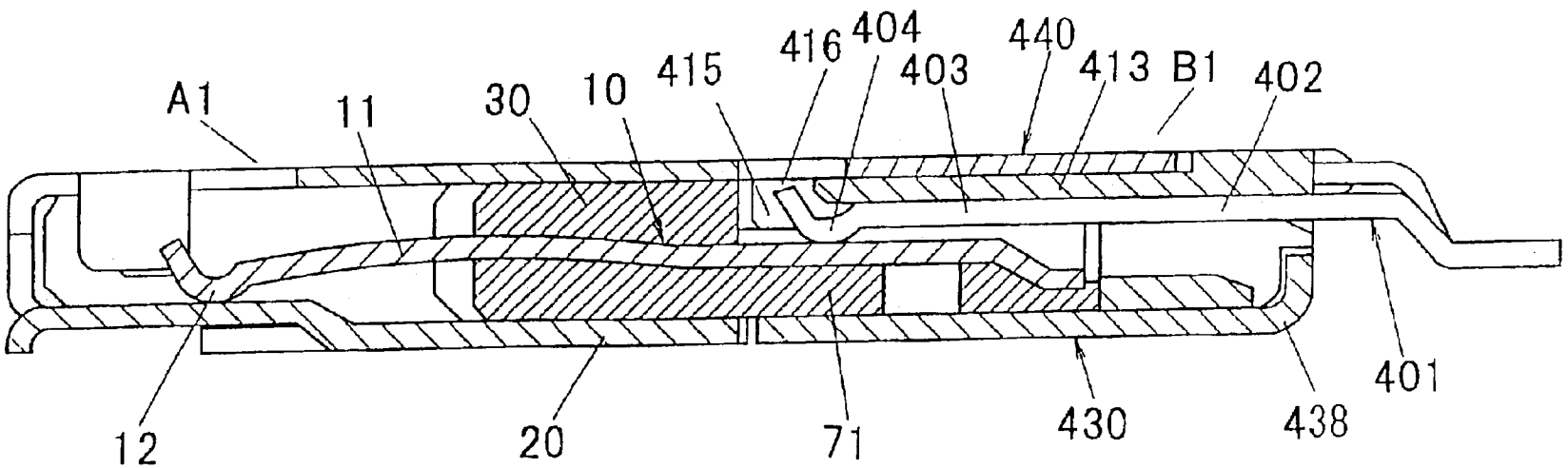
FIG. 16 is a sectional view of the connector receptacle shown in FIG. 12 mated with the connector plug.

A connection opening 421 enabling connector plug A1 to be freely inserted and removed is formed at the front of connector receptacle B1 thus assembled. The connector receptacle B1 is mounted to a wiring board such, for example, as a printed circuit board (not shown in the figure) by connecting the contacts 401 projecting from the back of support frame 410 to a signal conductor pattern of the wiring board, and connecting the connection parts 435 and terminal parts 437 of first shell 430 to the ground conductor pattern of the wiring board. The connector plug A1 can then be freely connected and disconnected to the connector receptacle B1 mounted on the wiring board as shown in FIG. 16.

Figure 13A:
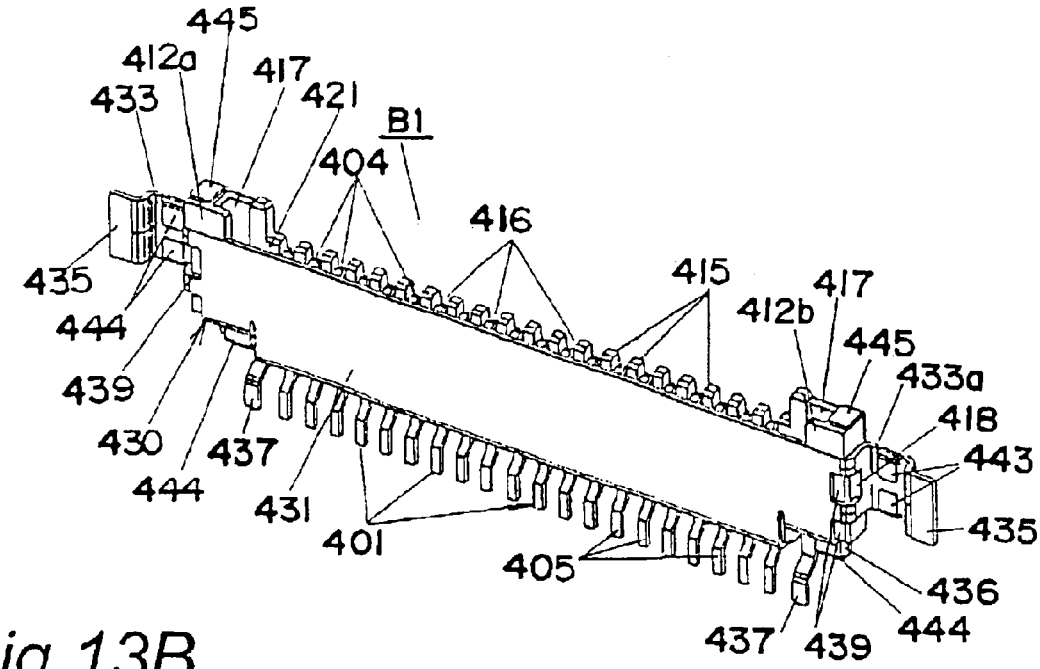
FIG. 13A is a perspective view from the first shell side of the connector receptacle shown in FIG. 12.
Figure 13B:
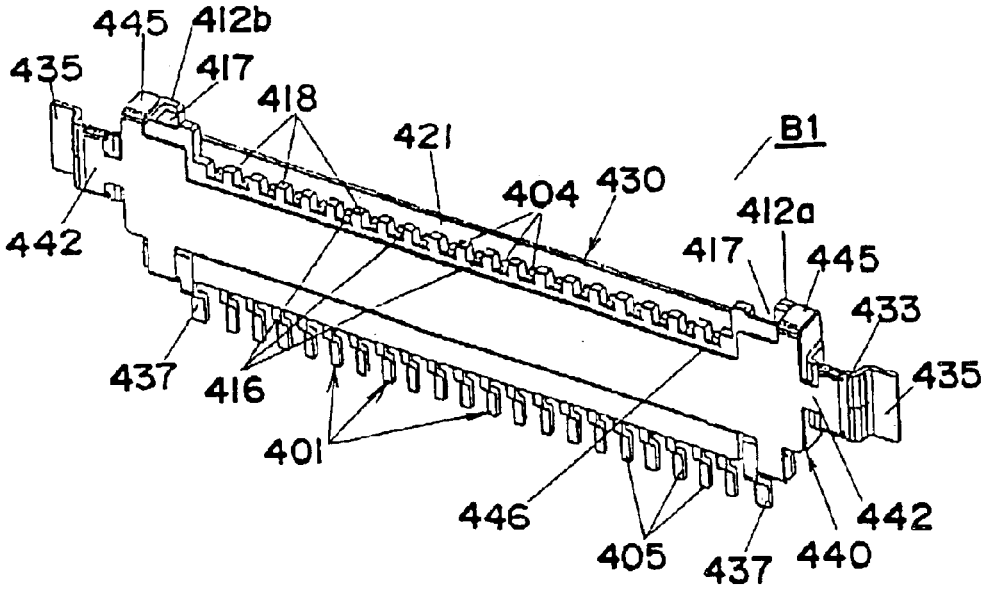
FIG. 13B is a perspective view from the second shell side of the connector receptacle shown in FIG. 12.
Figures 14A, 14B, 14C:
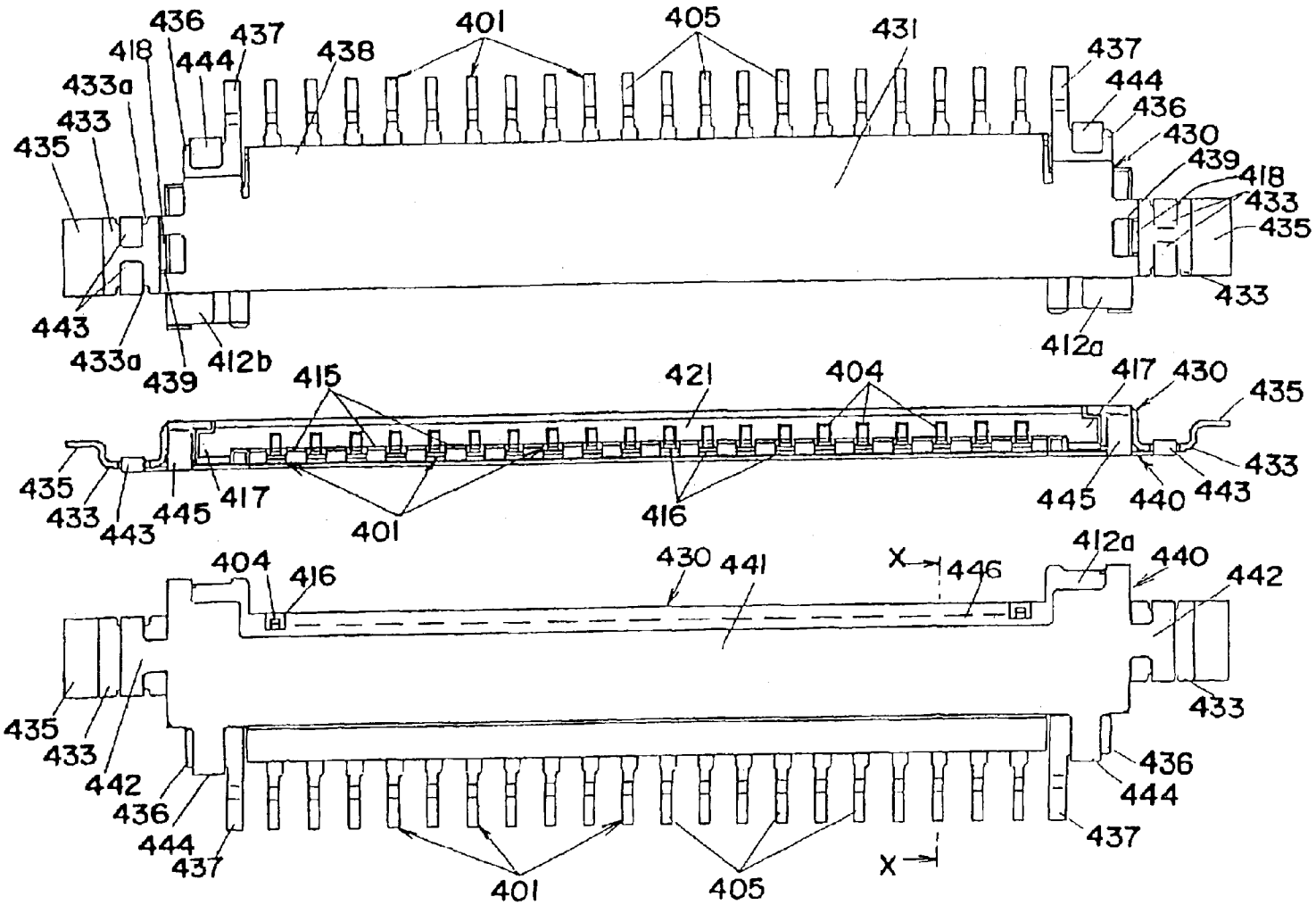
FIG. 14A is a side view from the second shell side of the connector receptacle shown in FIG. 12.
FIG. 14B is a front view of the connector receptacle shown in FIG. 12.
FIG. 14C is a side view from the first shell side of the connector receptacle shown in FIG. 12.

That is, when the connector receptacle fitting 71 projecting from shell 20 of connector plug A1 is fit into connection opening 421 of connector receptacle B1, the contact part 404 of each contact 401 of connector receptacle B1 slides in contact with each of the contacts 10 of connector plug A1, the spring part 403 of contacts 401 bends, and the restoring force of spring part 403 produces contact pressure between contacts 10 and contacts 401. Interference between contacts 401 and support frame 410 when contact is made with connector plug A1 can be prevented at this time because the ends of contact part 404 of contacts 401 are pushed into the recesses 416 disposed in support frame 410 in conjunction with deflection of the spring part 403. As a result, the support frame 410 can be made thin. Furthermore, because recess 446 is disposed to main part 441 of second shell 440, the ends of contacts 401 inserted to the recesses 416 do not contact the second shell 440 as shown in FIG. 13B.

The shape of first shell 430 and second shell 440 is thus simplified compared with a single shell 420 having a complicated shape, and the connector can be made thinner without sacrificing the manufacturability of the shell 420 (first and second shells 430, 440). Furthermore, the first shell 430 and second shell 440 can be easily fastened together because the tabs 418 on the sides of pillars 412*a* and 412*b* of support frame 410 engage engaging holes 439 in first shell 430 to provisionally attach first shell 430 to one side of the support frame 410.

Figures 17A, 17B, 17C:
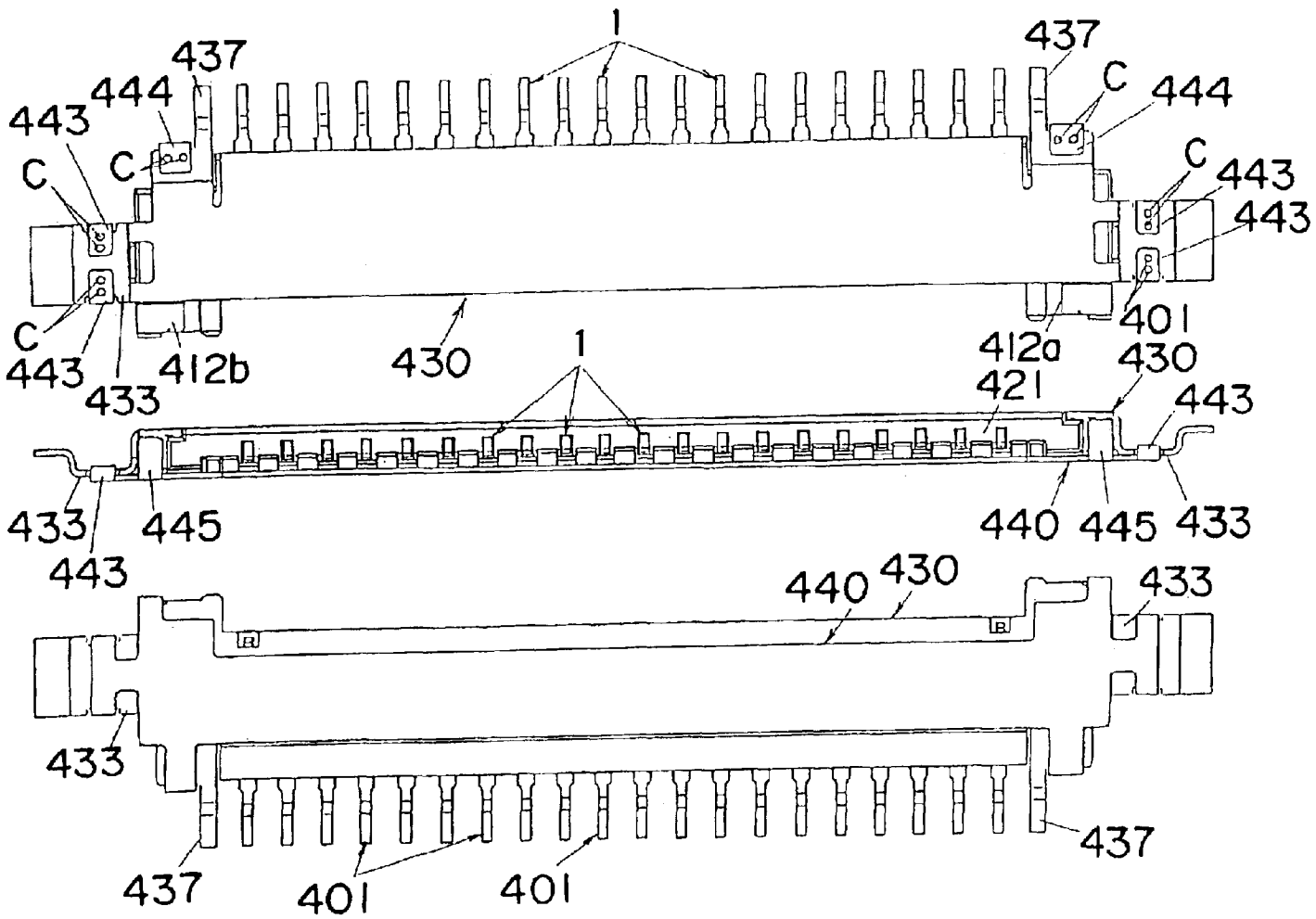
FIG. 17A is a side view from the second shell side showing another configuration of the connector receptacle in FIG. 12.
FIG. 17B is a front view of the connector receptacle shown in FIG. 17A.
FIG. 17C is a side view from the first shell side of the connector receptacle shown in FIG. 17A.

Furthermore, the first and second shells 430, 440 can be fastened strongly together by crimping the first and second crimping parts 443, 444 of second shell 440 to the first and second locking tabs 433, 436 of the first shell 430. As a result, connector strength can be improved in the mating direction of the first and second shells 430, 440 (the direction perpendicular to the insertion direction of connector plug A1), conductivity can be reliably established therebetween, and stable contact with the ground of shell 420 can be assured. It should be noted that if the first and second crimping parts 443, 444 are welded to the first and second locking tabs 433, 436 as shown in FIGS. 17A to 17C (C in FIG. 17C indicates the weld), connector strength in the mating direction of the first and second shells can be further improved, reliable conductivity therebetween can be assured, and contact with the ground of the shell can be further stabilized.

Furthermore, as shown in FIG. 15 and FIG. 16, because extension 438 is bent along the lengthwise edge thereof at the back end of the main part 431 of first shell 430, strength in the mating direction of first and second shells 430, 440 is yet further improved. It should be noted that because contacts 401 are pressed into mounting holes 414 of support frame 410 in this embodiment, a connector according to the present invention can be easily adapted to different numbers of contacts 401 (leads).

A variation of connector receptacle B1 according the present embodiment of the invention is described next below with reference to FIG. 18 to FIG. 20.

This variation is characterized in that tabs 447*a* passing between contacts 401 of support frame 410 are disposed to the second shell 440, and flexible tabs 438*a* for flexibly contacting the ends of tabs 447*a* passing through support frame 410 are disposed to the first shell 430.

Figure 18:
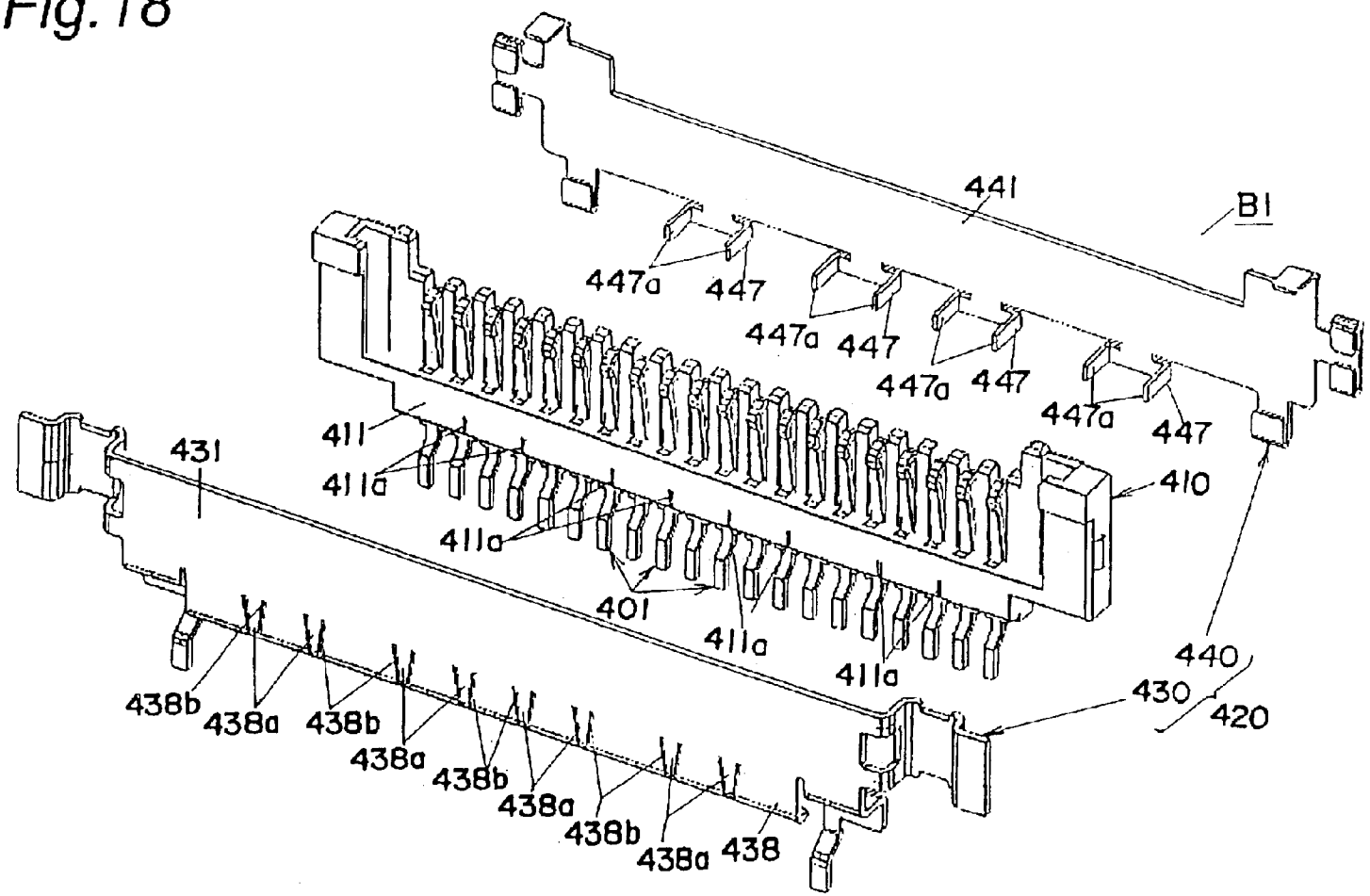
FIG. 18 is an exploded perspective view showing a variation of the connector receptacle in FIG. 12.
Figures 19A, 19B, 19C:
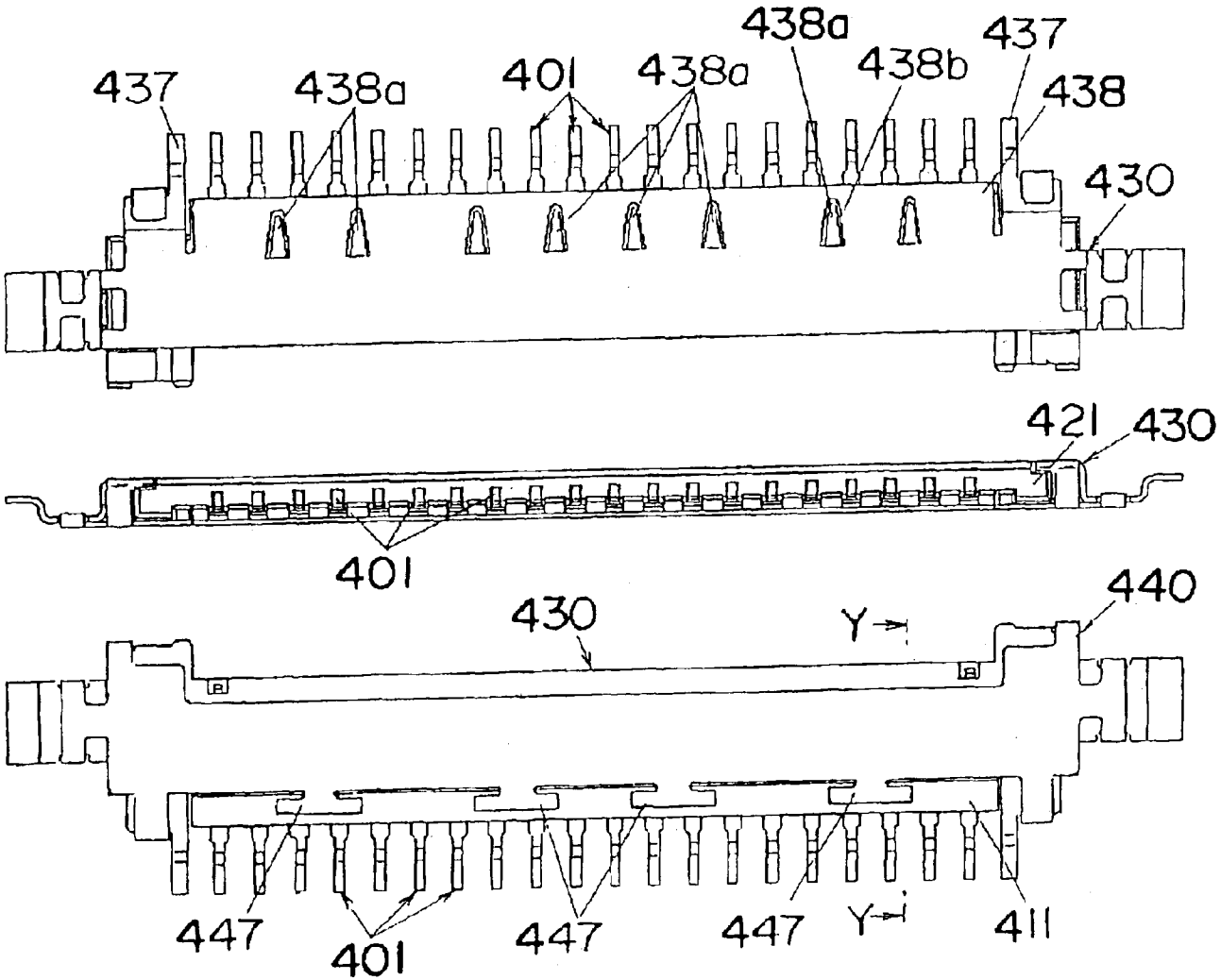
FIG. 19A is a side view of the connector receptacle in FIG. 18 from the second shell side.
FIG. 19B is a front view of the connector receptacle in FIG. 18.
FIG. 19C is a side view of the connector receptacle in FIG. 18 from the first shell side.

As shown in FIG. 18, four tab bases 447 each having a pair of substantially parallel tabs 447*a* projecting therefrom in a substantially U-shaped configuration are formed from the back edge of main part 441 of second shell 440. Eight matching through-channels 411*a* corresponding to the tabs 447*a* are disposed passing through the thickness direction of the main part 411 of support frame 410 between the mounting holes 414. Eight V-shaped notches 438*b* are also formed along the length of extension 438 of first shell 430, and wedge-shaped flexible tabs 438*a* partially cut out from extension 438 by notches 438*b* are formed opposite through-channels 411*a* of support frame 410.

Figure 20:
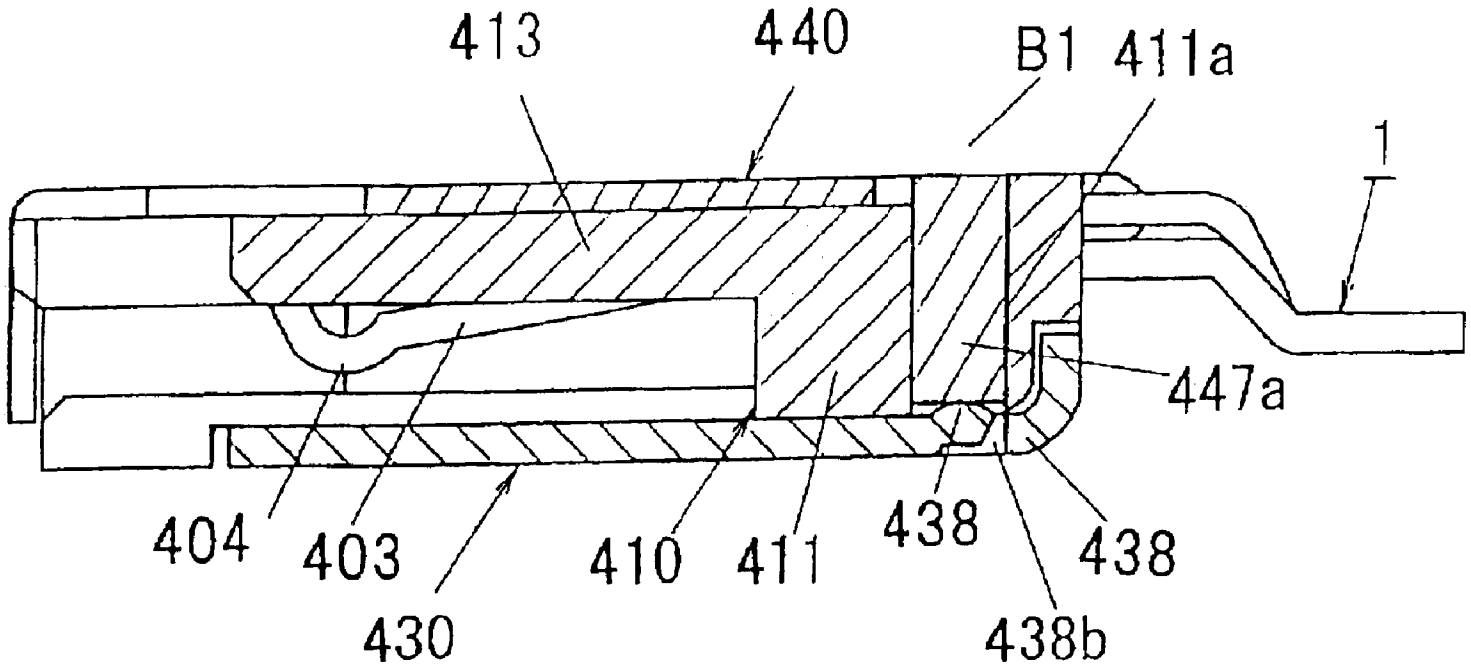
FIG. 20 is a sectional view through line Y—Y in FIG. 19A.

When the first and second shells 430, 440 are then fastened together with support frame 410 therebetween, the tabs 447*a* of first shell 430 pass through through-channels 411*a* of support frame 410 as shown in FIG. 20 and protrude from the opposite side of the support frame 410, contacting the flexible tabs 438*a* of first shell 430 and bending the flexible tabs 438*a* out. The restoring force of flexible tabs 438*a* produces contact pressure between flexible tabs 438*a* and tabs 447*a*.

Thus comprised contact between tabs 447*a* and flexible tabs 438*a* assures reliable conductivity between first and second shells 430, 440, and thus further stabilizes connection between the shell 420 and ground.

Figures 21A, 21B, 21C:
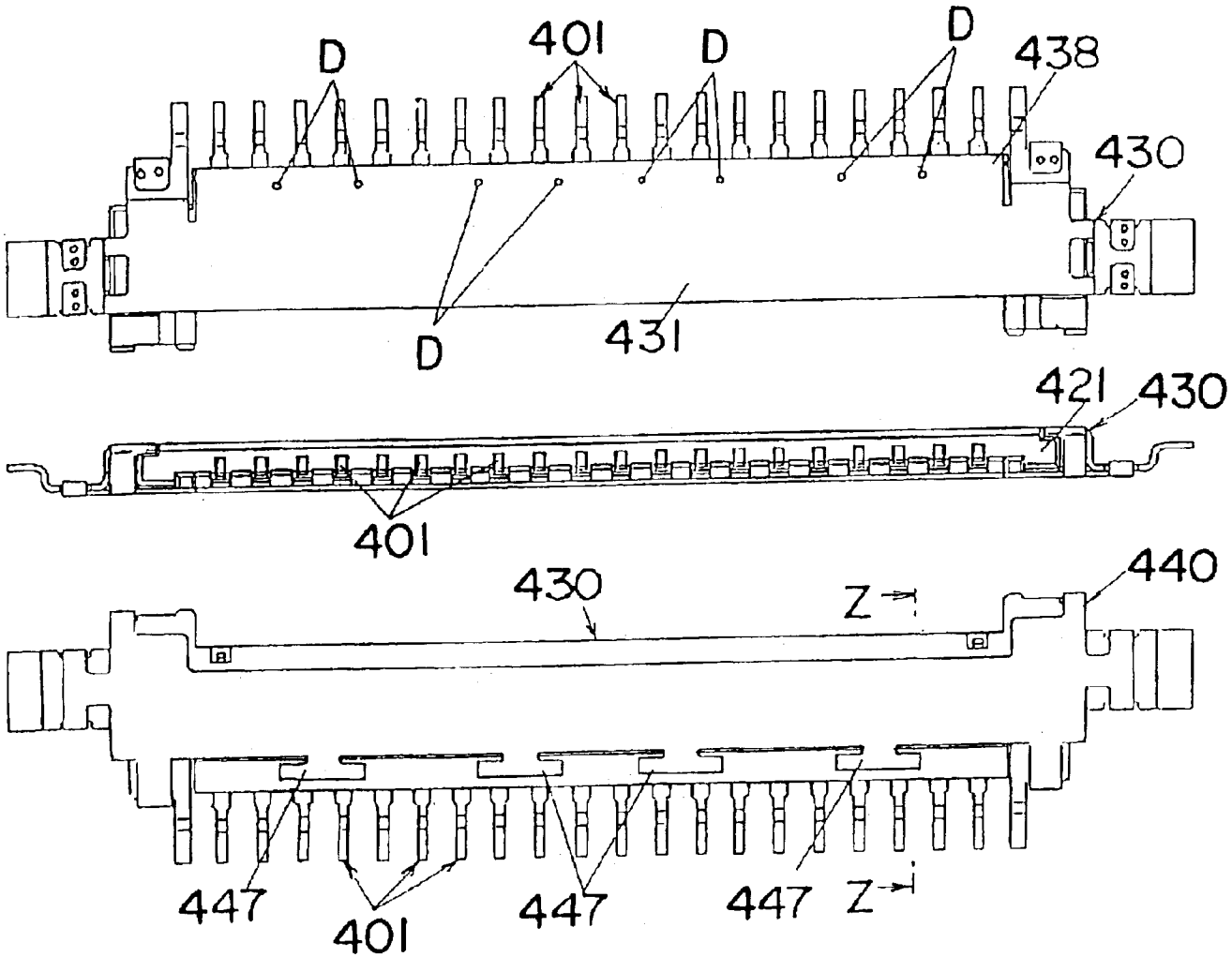
FIG. 21A is a side view of another variation of the connector receptacle in FIG. 12 from the second shell side.
FIG. 21B is a front view of the connector receptacle shown in FIG. 21A.
FIG. 21C is a side view of the connector receptacle in FIG. 21A from the first shell side.
Figure 22:
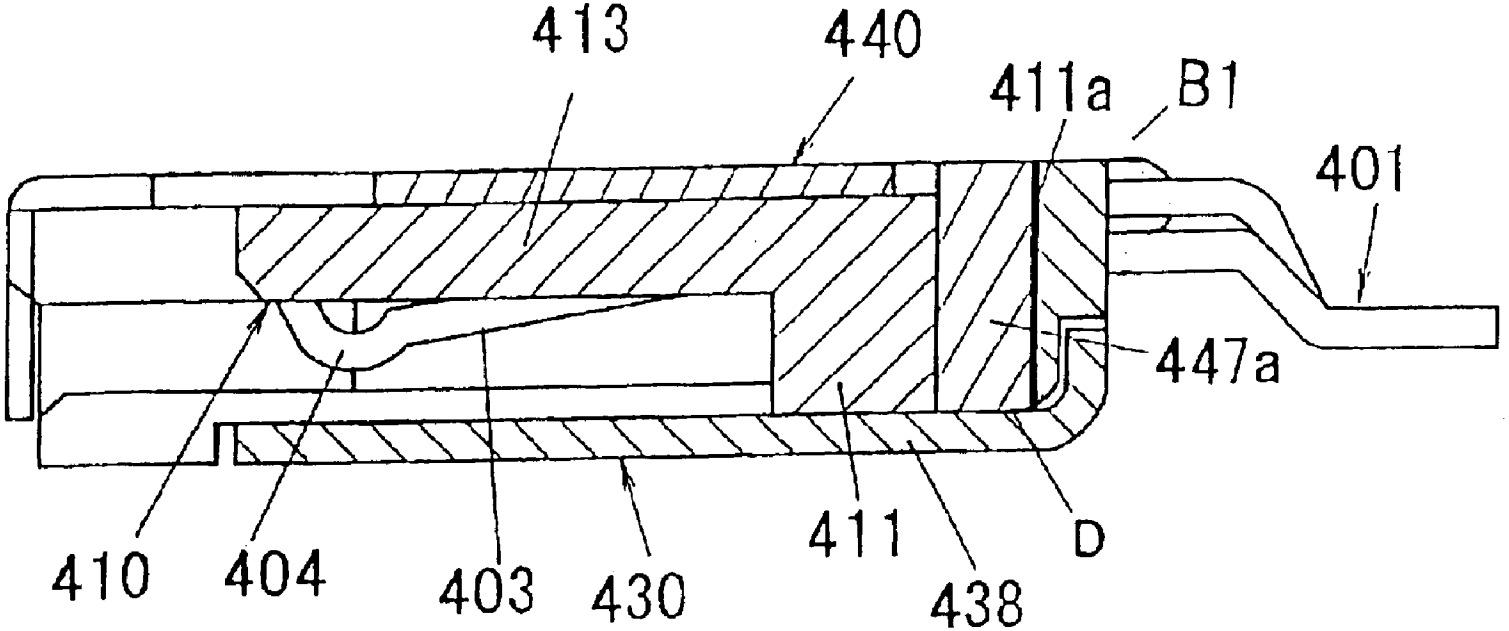
FIG. 22 is a sectional view through line Z—Z in FIG. 21A.

It should be noted that instead of providing flexible tabs 438*a* to first shell 430 to flexibly contact tabs 447*a* of second shell 440, tabs 447*a* passing through through-channels 411*a* of support frame 410 to the other side of the support frame 410 can be welded to the extension 438 of first shell 430 as shown in FIGS. 21A to 21C and FIG. 22 (where D in FIG. 21C and FIG. 22 is the weld). This assures conductivity between first and second shells 430, 440 through contact between tabs 447*a* and extension 438, further assuring stable contact with the ground and further improving the strength of the first and second shells 430, 440 in the mating direction.

Embodiment 2

As shown in FIG. 23 to FIG. 31, a connector receptacle B2 according to a second embodiment of the invention has a contact block 501, a metal first shell 540, a body 520, and a second shell 530. The contact block 501 has multiple contacts 550 integrally molded to a holding frame 510, which is a synthetic resin molding. The first shell 540 has holding frame 510 mounted thereto in the thickness direction and extends lengthwise in the direction of the contacts 550. The body 520 is formed integrally to the first shell 540 to house the contact tabs 551 of the contacts 550 contacting the contacts 10 of connector plug A1, and insulates between first shell 540 and contacts 550. The second shell 530 is a metal member extending in the direction of the contacts 550, and connects to the first shell 540 so that the contact tabs 551 of contacts 550 and holding frame 510 are disposed between the second shell 530 and first shell 540. An insertion opening 570 (see FIG. 25 and FIG. 26) for inserting connector plug A1 between the contacts 550 and second shell 530 is formed between body 520 and second shell 530. In other words, an insertion opening 570 for inserting the terminal parts on the insertion side of the connector plug A1 is formed in the part enclosed by body 520 and second shell 530, and connector plug A1 is inserted to insertion opening 570 along a circuit board.

It should be noted that the first shell 540 is insert molded to the body 520, the contacts 550 are insert molded to the holding frame 510, and the body 520 and holding frame 510 are made of an insulation material.

In this embodiment of the invention, the contacts 550 are enclosed between the metal first shell 540 and metal second shell 530, and a shield is formed by connecting these two metal parts. Compared with the prior art in which the shell enclosing the contacts is made of a single metal piece, the shell configuration of the present invention is simplified and can be easily manufactured, and the thickness (the vertical dimension in FIG. 26) of the connector can be reduced. Furthermore, because the contacts 550 are integrally molded to the holding frame 510 in the contact block 501, deformation of the contacts 550 during assembly can be prevented and the flatness of the contacts 550 within the same plane can be assured more easily when compared with the prior art in which the contacts are pressed in along the lengthwise direction thereof.

It is therefore easier to align the contact part 553 of each of the contacts 550 in the same plane. Furthermore, because the first shell 540 is integrally molded to the body 520, insulation of the contacts 550 and first shell 540 can be assured.

The body 520 has an insulation base plate 521 and a guide part 527. The insulation base plate 521 is a long narrow rectangular member for insulating the first shell 540 and contact tabs 551 of contacts 550. The guide part 527 guides both sides of the connector plug A1, and is molded continuously to both ends in the lengthwise direction of the insulation base plate 521. A divider 522 for preventing a short-circuit between adjacent contacts 550 is formed to insulation base plate 521 opposite second shell 530. The dividers 522 are formed in line with the insertion direction of the connector plug A1. It should be noted that guide parts 527 also function to prevent upside down insertion of the connector plug A1, and can thus prevent the connector plug A1 from being inserted with front and back sides reversed.

The contacts 550 are formed of a conductive material in strips and have a contact tab 551 for contacting contacts 10 of connector plug A1 at one end and contact part 553 for surface mounting to a circuit board at the other end. The contact tab 551 and contact part 553 are connected by a fixed part 552 (see FIG. 29) so that each contact 550 is a single continuous piece. The contacts 550 are insert molded to the holding frame 510 so that the fixed part 552 is embedded in the holding frame 510. The contact tabs 551 are inclined in the thickness direction of insulation base plate 521, and have at the end thereof a contact part 551*a* bent to form a protrusion away from the insulation base plate 521 in the thickness direction of the insulation base plate 521. The contact tabs 551 are able to flex when the contact block 501 is fixed in the first shell 540.

Figure 31:
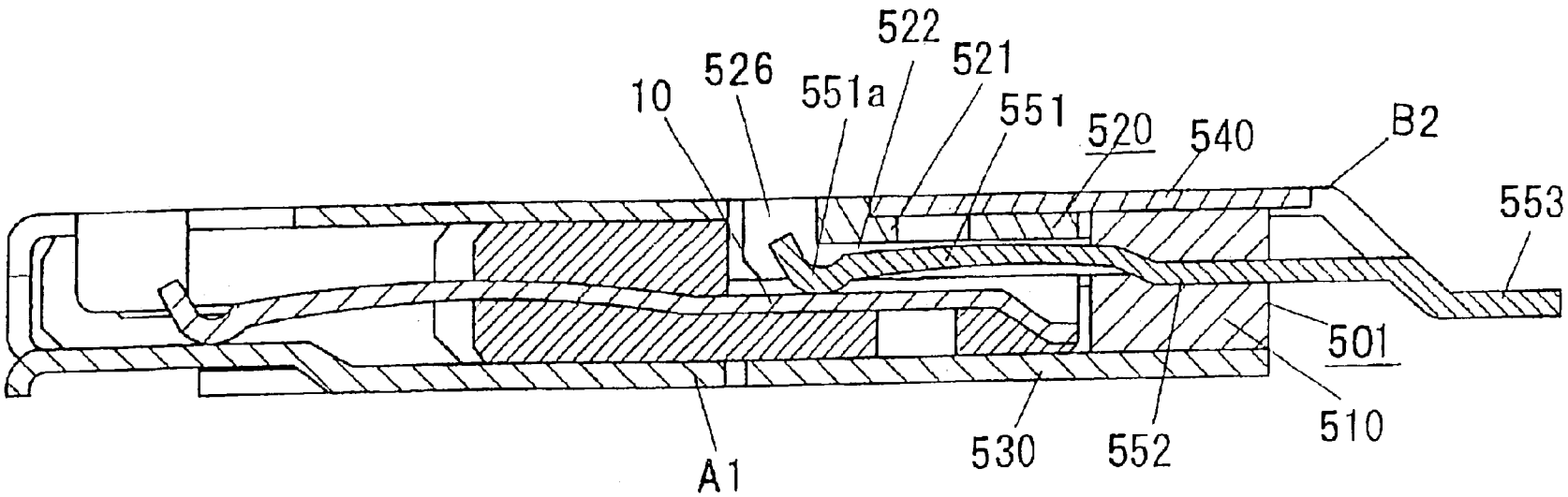
FIG. 31 is a sectional view showing the connector plug inserted to the connector receptacle in FIG. 23.
Figure 32:
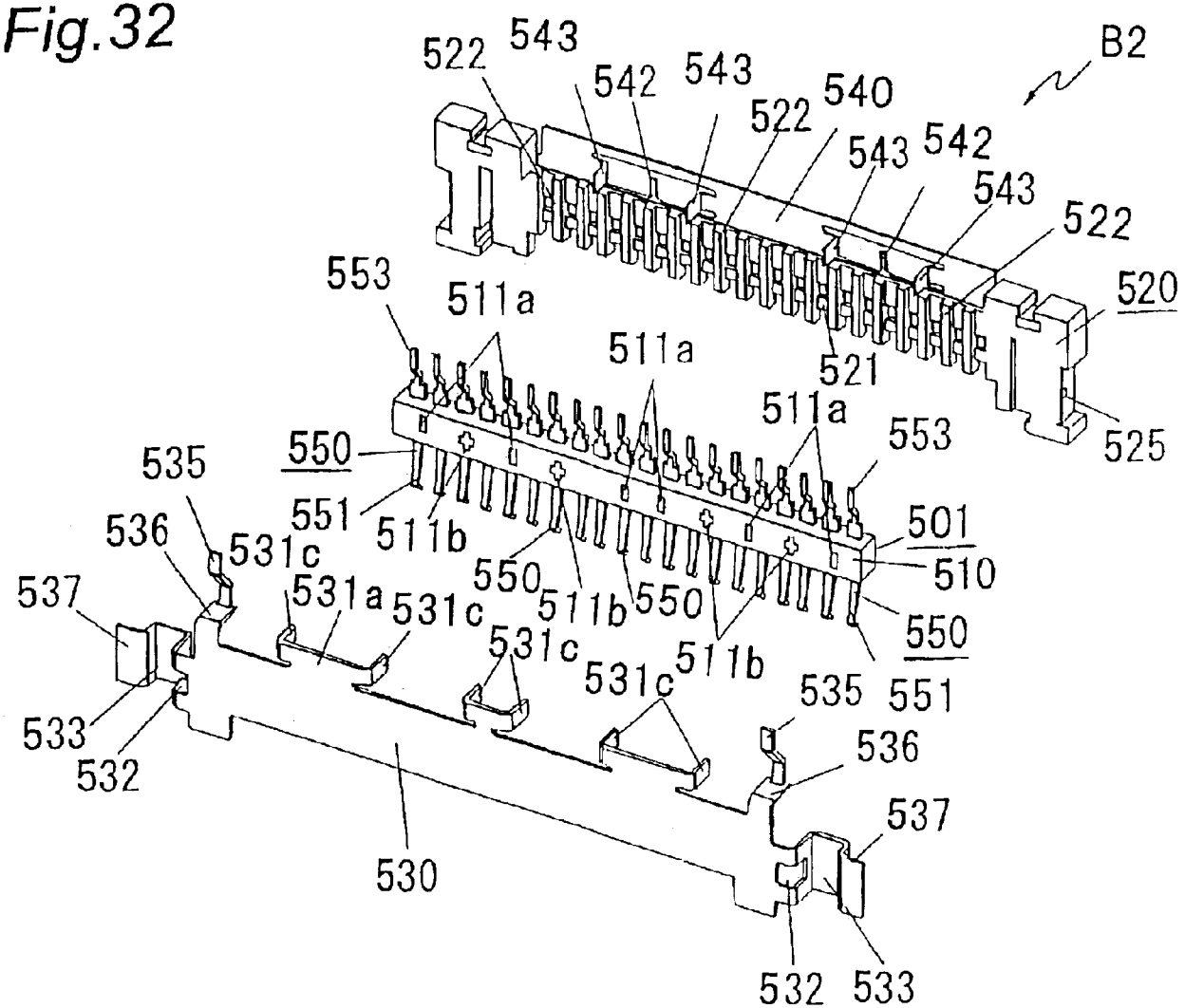
FIG. 32 is an exploded perspective view showing a variation of the connector receptacle in FIG. 23.
Figure 33:
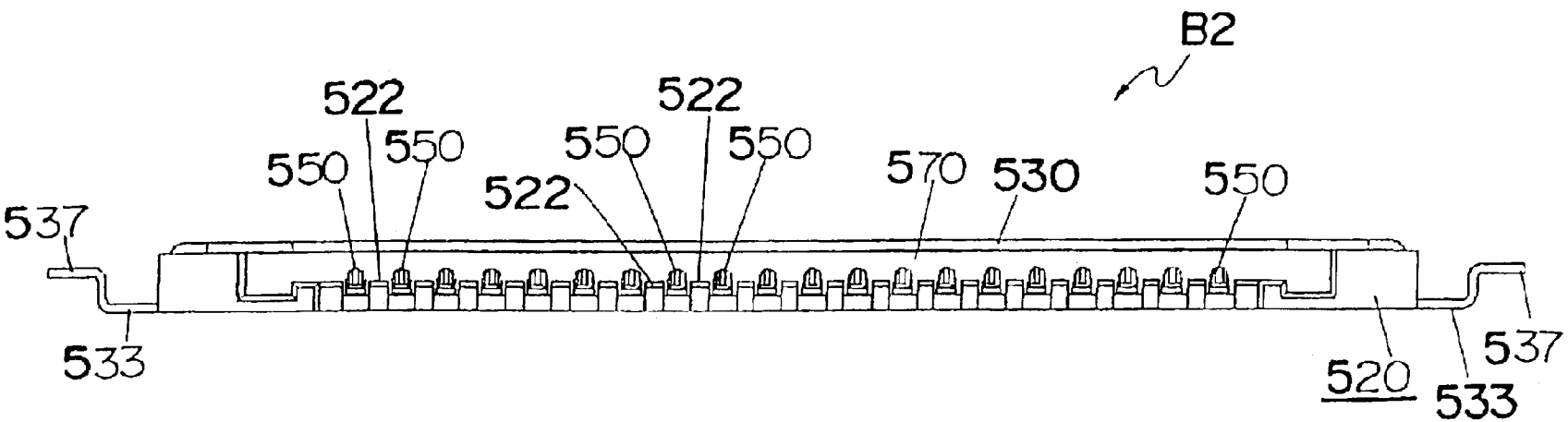
FIG. 33 is a front view of the connector receptacle shown in FIG. 32.
Figure 34:
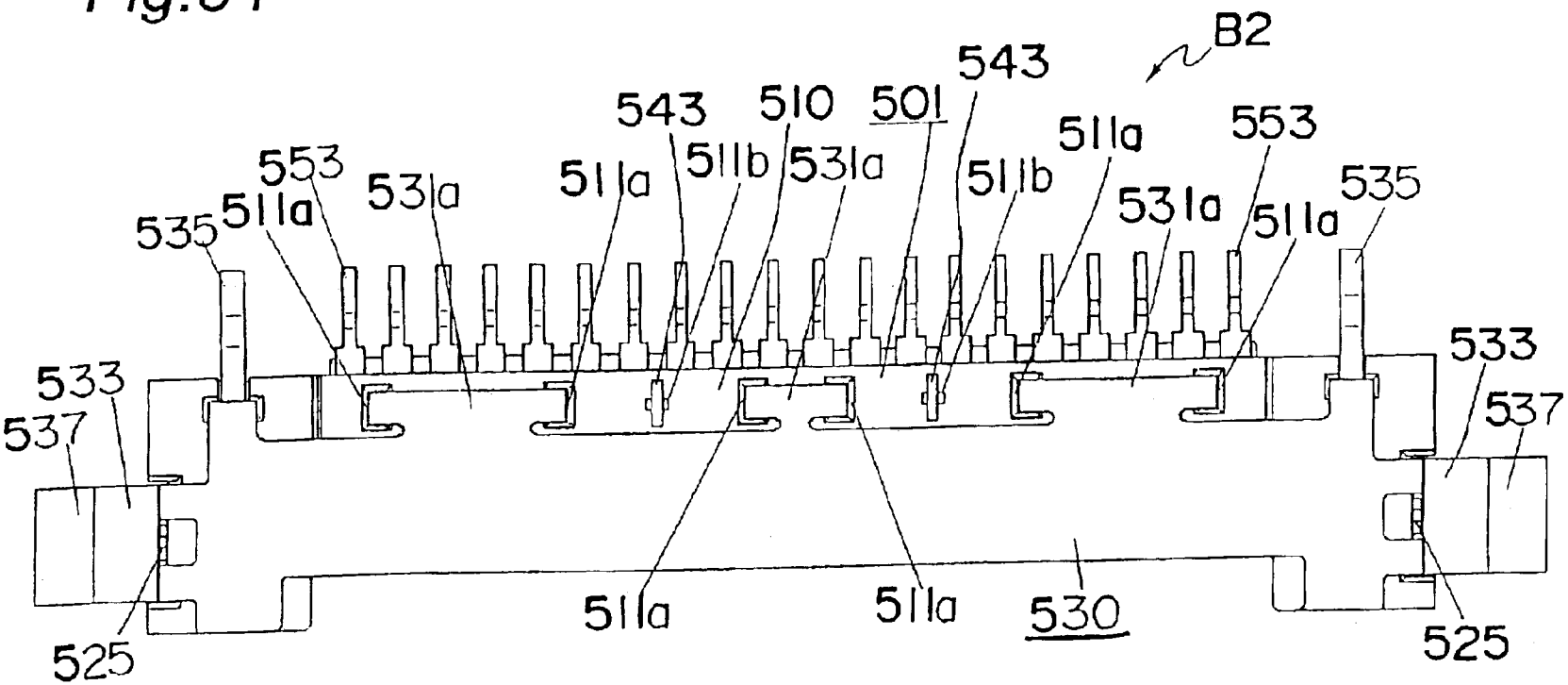
FIG. 34 is a top plan view of the connector receptacle shown in FIG. 32.
Figure 35:
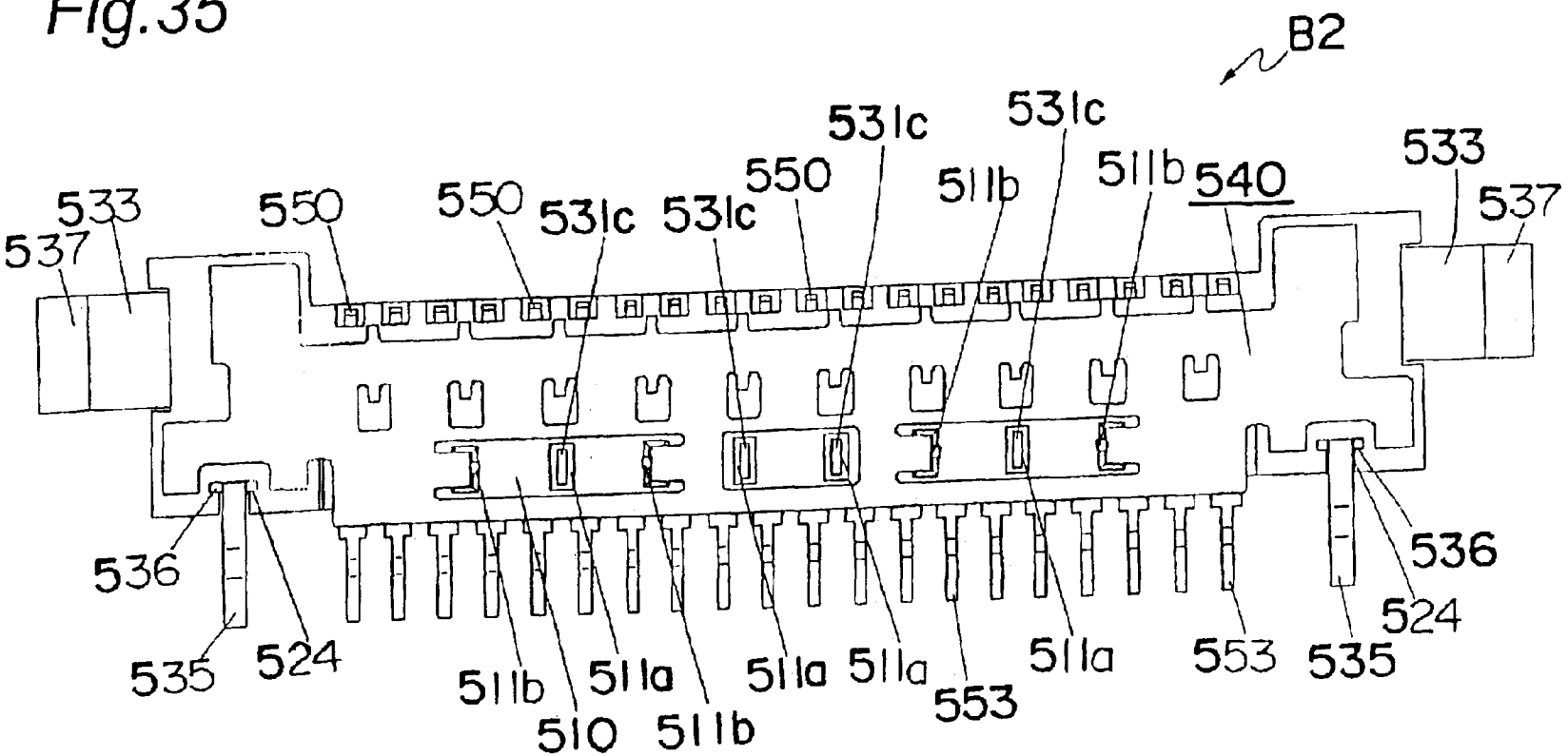
FIG. 35 is a bottom plan view of the connector receptacle shown in FIG. 32.
Figure 36:
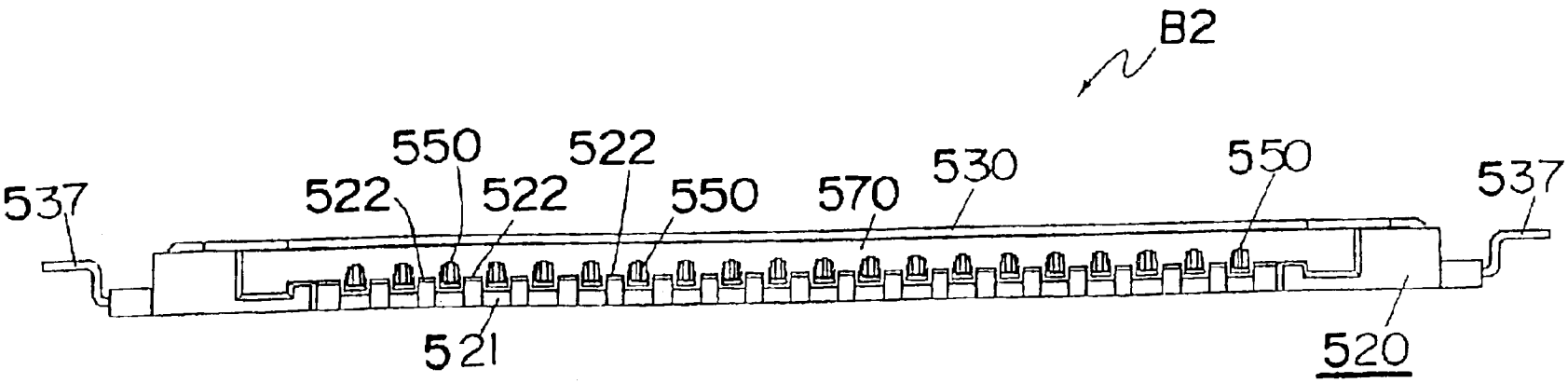
FIG. 36 is a front view of another variation of the connector receptacle shown in FIG. 23.
Figure 37:
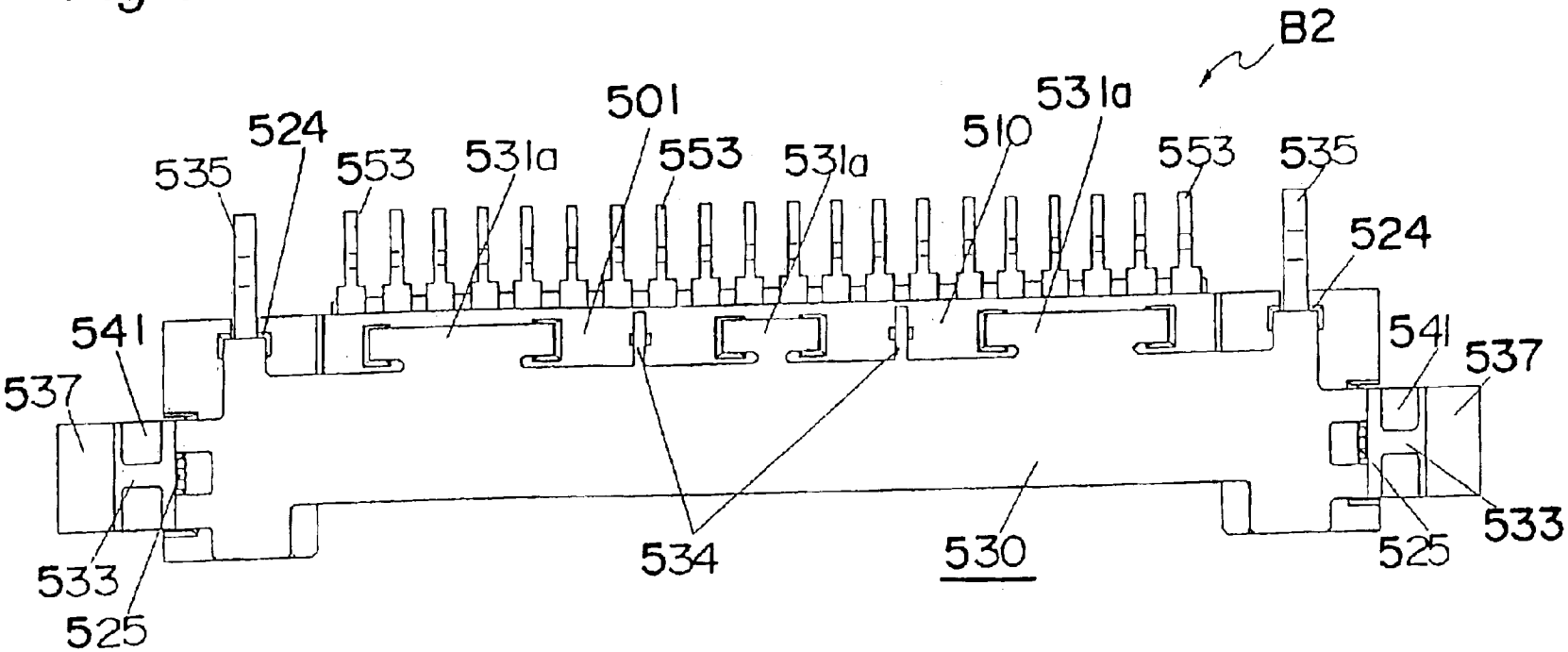
FIG. 37 is a top plan view of the connector receptacle shown in FIG. 36.
Figure 38:
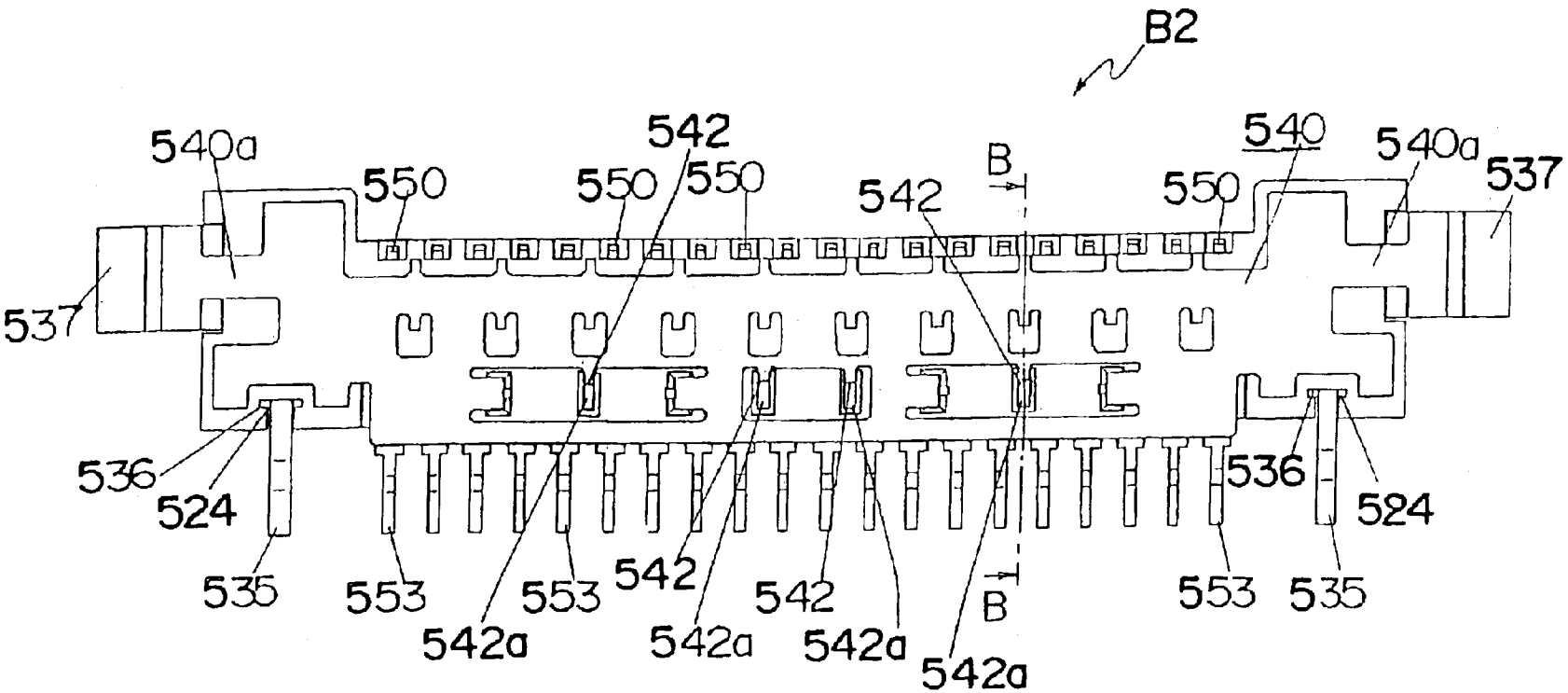
FIG. 38 is a bottom plan view of the connector receptacle shown in FIG. 36.

When the end of connector plug A1 is inserted to insertion opening 570, contact part 551*a* contacts contact 10 of connector plug A1 as shown in FIG. 31 so that contact tabs 551 are pushed and enter between adjacent dividers 522. Contact pressure between contacts 10 of connector plug A1 and contacts 550 is assured at this time by deflection of contact tabs 551 and contact parts 551*a*.

It should be noted that the part of body 520 surrounding insertion opening 570 has a comb-like shape formed by the dividers 522 extending as protrusions from the leading edge of the insulation base plate 521, and the contacts 550 are disposed corresponding to matching channels 526. It is therefore possible to prevent interference of insulation base plate 521 of body 520 with the ends (contact part 551*a*) of the contacts 550 when connector plug A1 is inserted from insertion opening 570, and the connector can be made even thinner.

Figure 26:
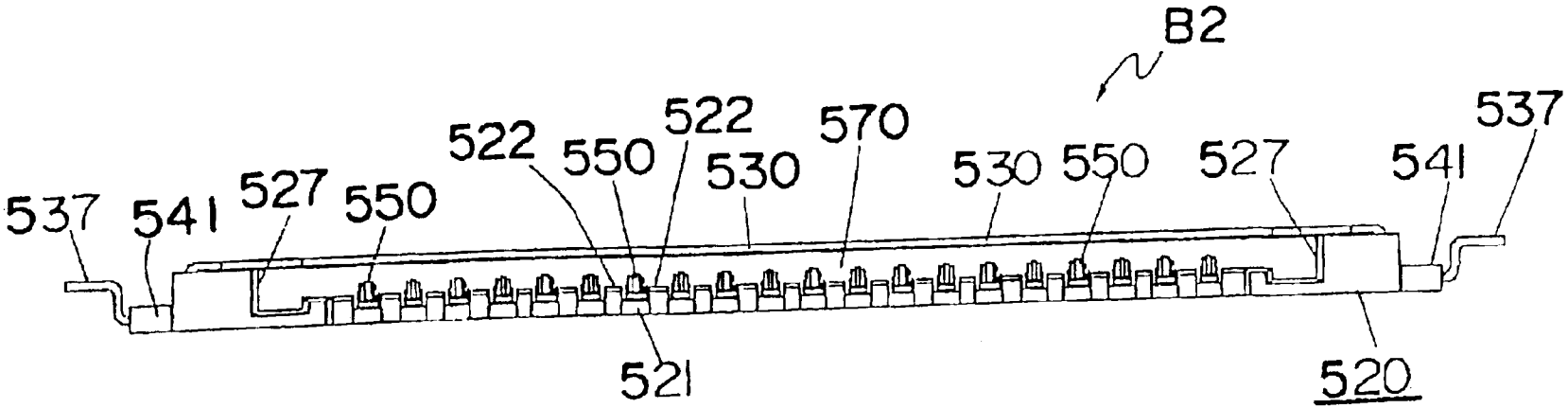
FIG. 26 is a front view of the connector receptacle shown in FIG. 23.

The second shell 530 has T-shaped shoulders 531*a* projecting from one edge on the long side, and pressing tabs 531*c* project toward the first shell 540 from both edges of the shoulders 531*a*. The second shell 530 is a rectangular member long from left to right as seen in FIG. 26, has locking tabs 533 disposed thereto through intervening shoulders 538 at both right and left ends, and has L-shaped terminal ends 537 further extending from the locking tabs 533. Engaging holes 532 are formed at right and left ends of the second shell 530 extending to the shoulders 538.

Notches 533*a* are also formed to the locking tabs 533 at both ends thereof on the short sides of the second shell 530. Push tabs 536 also project toward the body 520 from one side edge at both right and left ends of the second shell 530, and terminal ends 535 extend from the ends of the push tabs 536. Note that terminal ends 535 and 537 are connected to the ground pattern of the circuit board.

The holding frame 510 of contact block 501 has push tabs 543 projecting from first shell 540 toward second shell 530, and insertion holes 511 to which pressing tabs 531*c* projecting from second shell 530 toward first shell 540 are inserted. The holding frame 510 is shaped like an elongated block, and insertion holes 511 are formed in the thickness direction of the holding frame 510 arrayed in the direction of the contacts 550 so as not to overlap the fixed parts 552 of the contacts 550.

Recesses 524 are formed at both ends in the lengthwise direction of body 520, and push tabs 536 projecting from second shell 530 toward body 520 are pressed into these recesses 524. Engaging tabs 525 for engaging corresponding engaging holes 532 in second shell 530 are formed at both ends in the lengthwise direction (in the same direction in which the contacts 550 are arrayed) to body 520. Tabs 540*a* integrally formed with first shell 540 protrude from both ends in the lengthwise direction of first shell 540, and crimping tabs 541 for securing the second shell 530 are integrally formed with tabs 540*a* so as to extend therefrom. The crimping tabs 541 are formed long in the insertion direction of the connector plug A1. The first shell 540 is connected (fastened) to the second shell 530 by crimping (folding over) both lengthwise ends of the crimping tabs 541 at the parts corresponding to the notches 533*a* in second shell 530.

Figure 23:
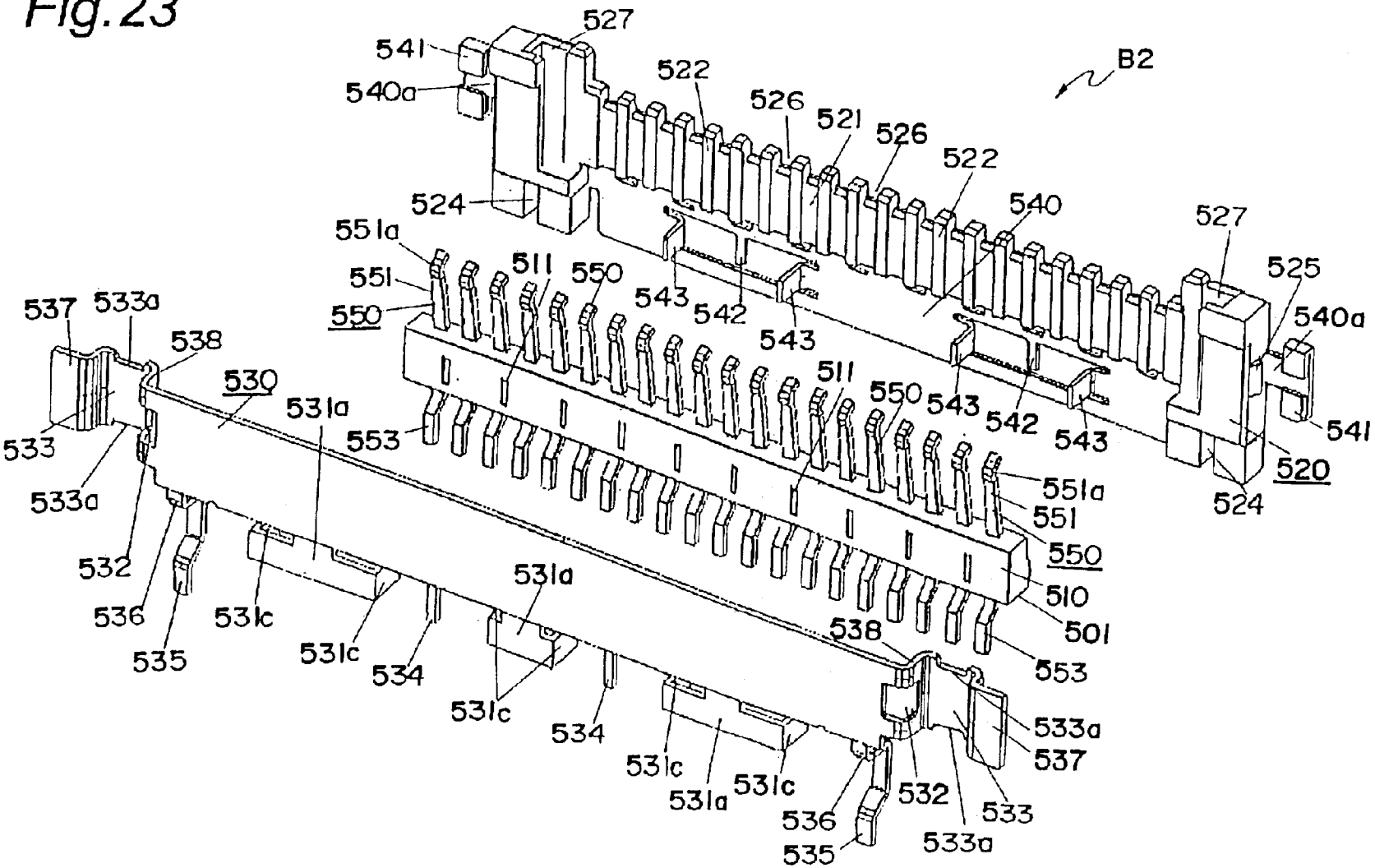
FIG. 23 is an exploded perspective view of a connector receptacle according to a second embodiment of the invention.
Figure 24:
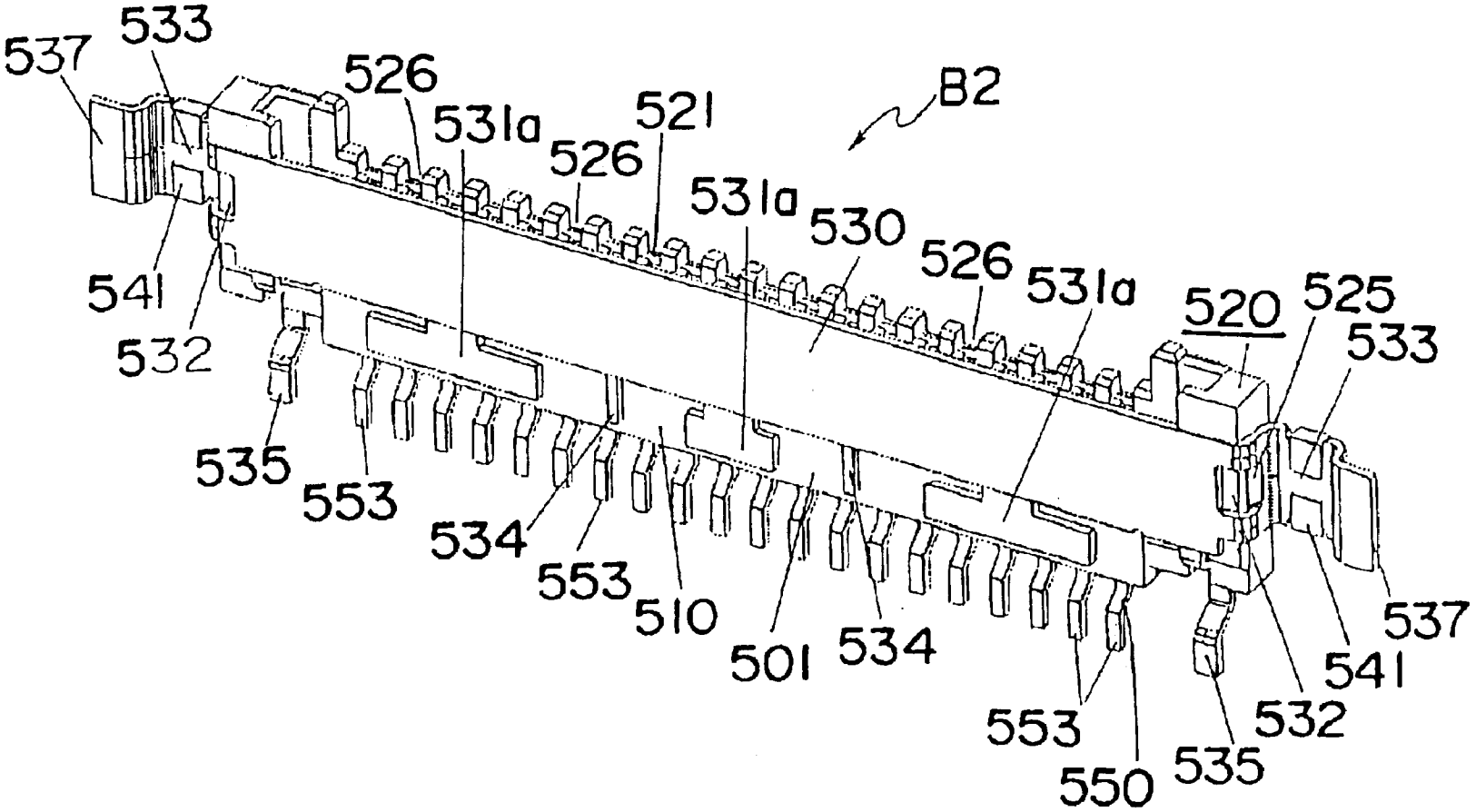
FIG. 24 is a perspective view of the connector receptacle in FIG. 23.
Figure 25:
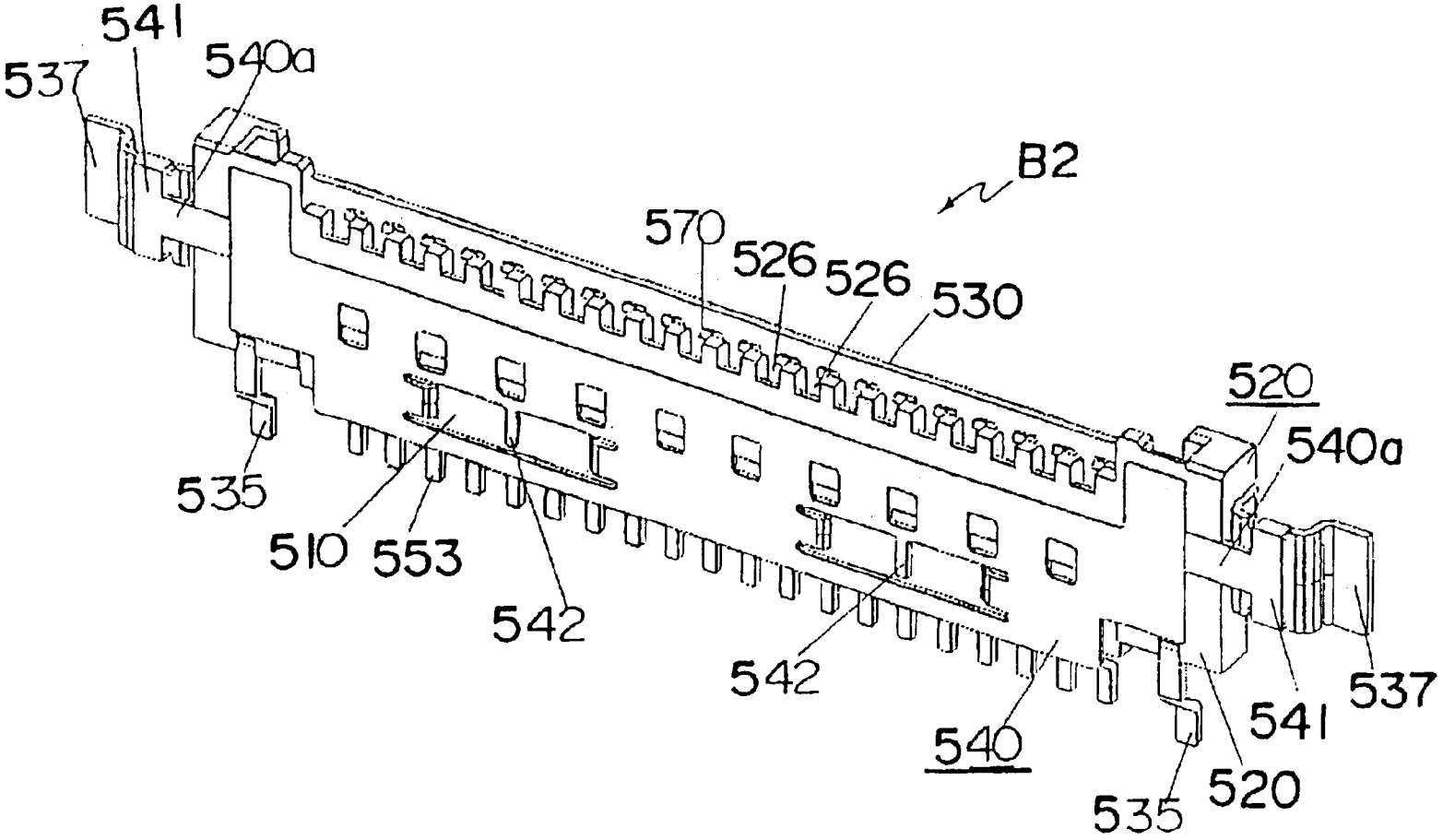
FIG. 25 is another perspective view of the connector receptacle in FIG. 23.

It should be noted that both ends of the crimping tabs 541 are shown in the crimped position in FIG. 23, and crimping tabs 541 are the crimping parts of the present embodiment.

The present embodiment is thus able to establish reliable contact between the first shell 540 and second shell 530, and stabilize the ground potential when mounted to the circuit board. It is also possible to suppress deformation in the thickness direction of the connector when the connector plug A1 is inserted from insertion opening 570.

The first shell 540 has tabs 542 formed at one side thereof so as extend in the widthwise direction thereof to act as contact parts for contacting the ends of pressure tabs 531, which are disposed to the second shell 530. The tabs 542 of first shell 540 are welded to the pressure tabs 531 of second shell 530 with a weld 563 (see FIG. 28).

Figure 27:
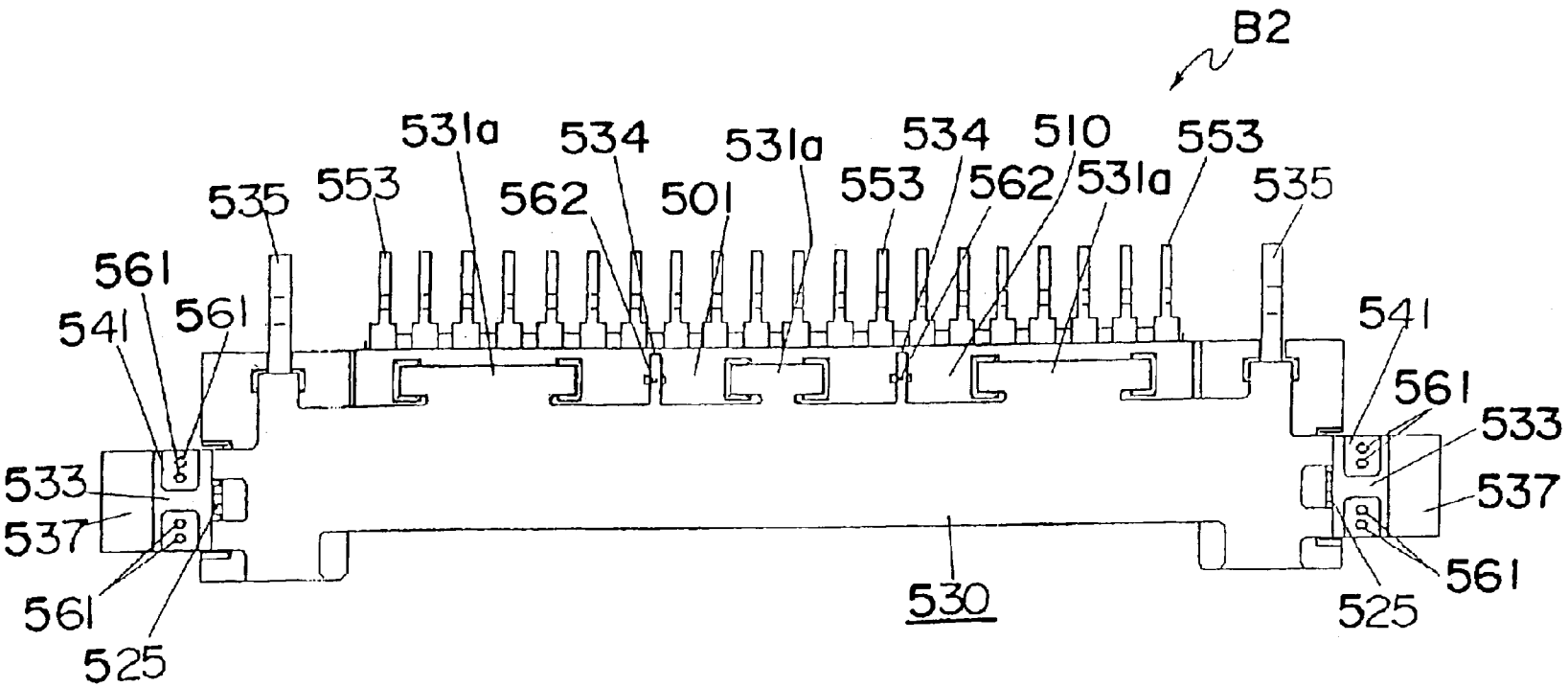
FIG. 27 is a top plan view of the connector receptacle shown in FIG. 23.
Figure 28:
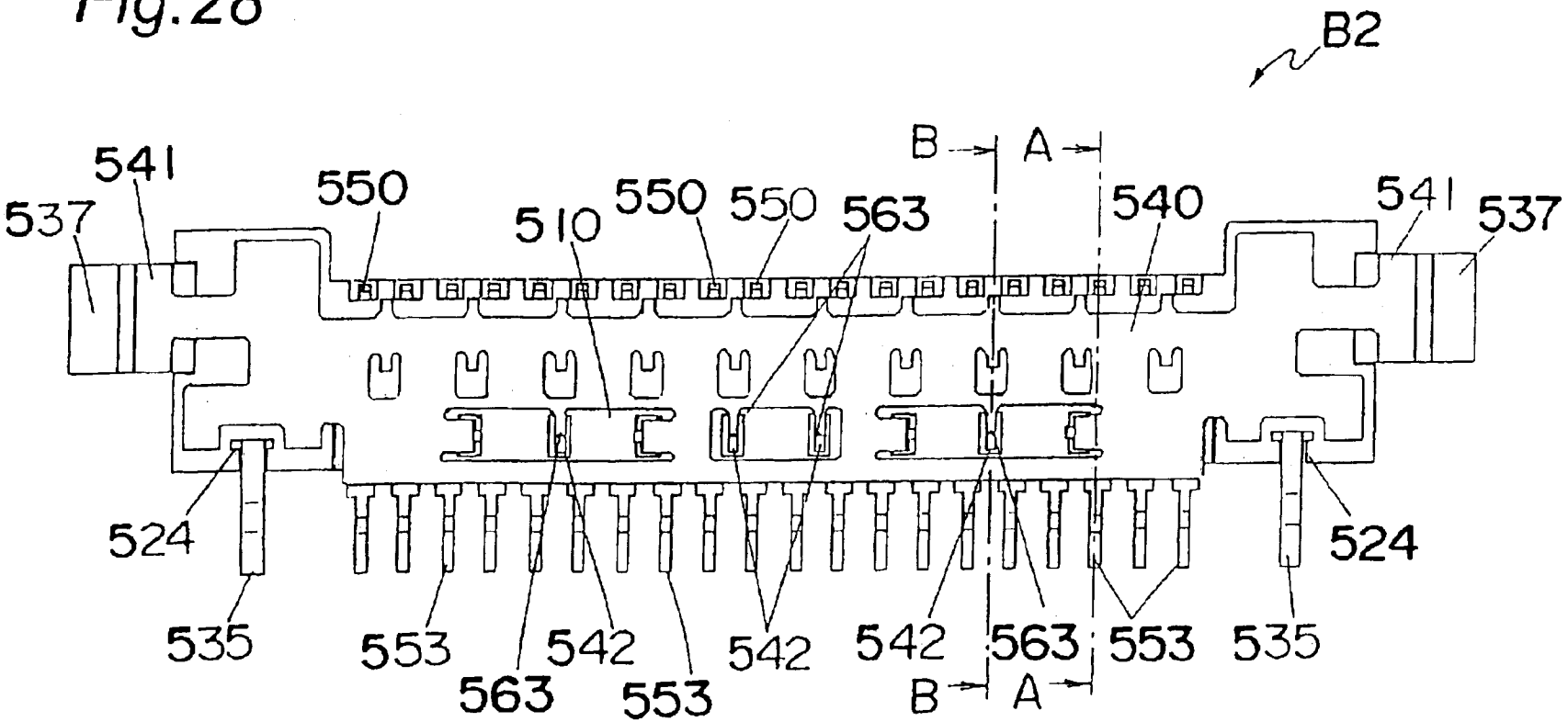
FIG. 28 is a bottom plan view of the connector receptacle shown in FIG. 23.
Figure 29:
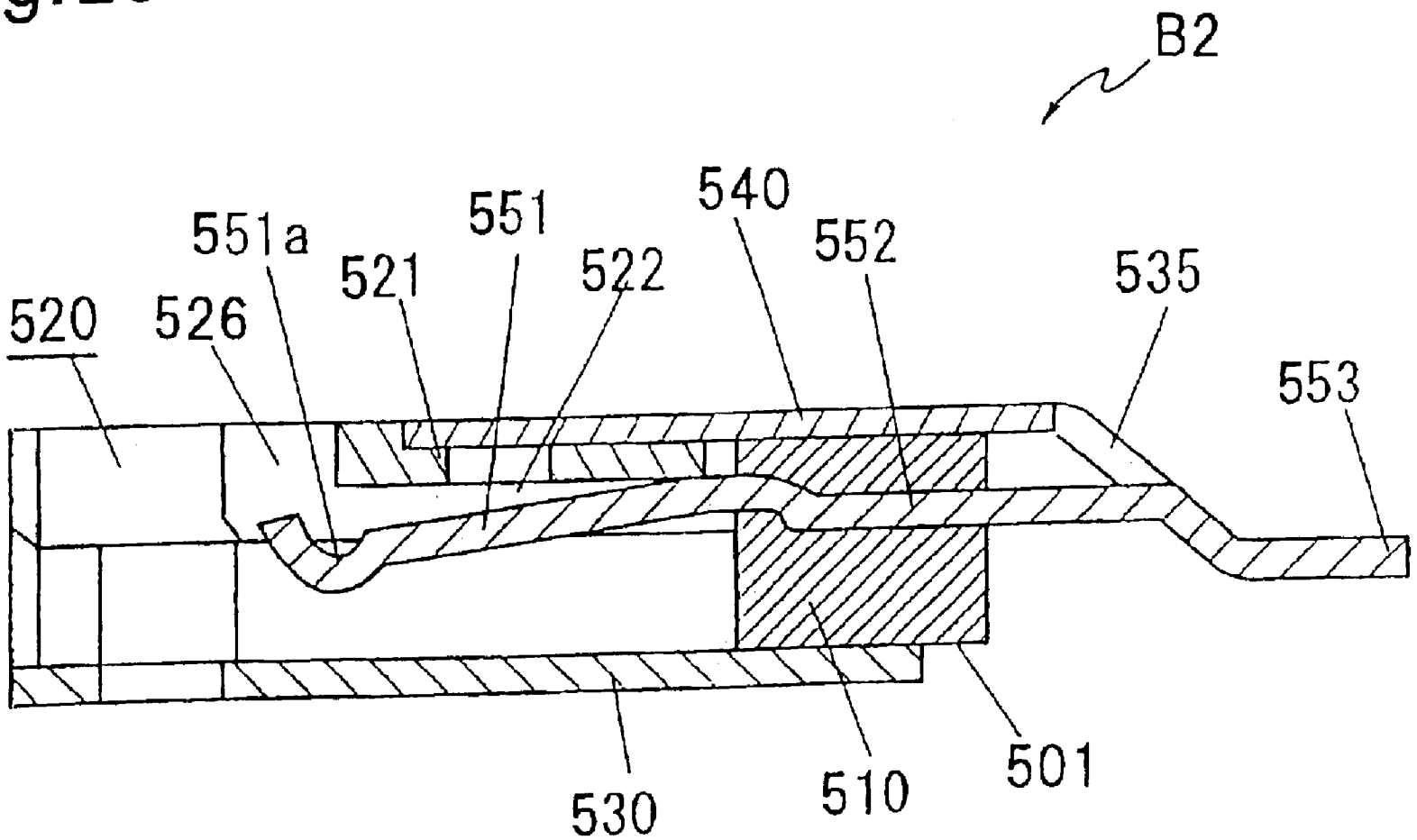
FIG. 29 is a sectional view through line A—A in FIG. 28.
Figure 30:
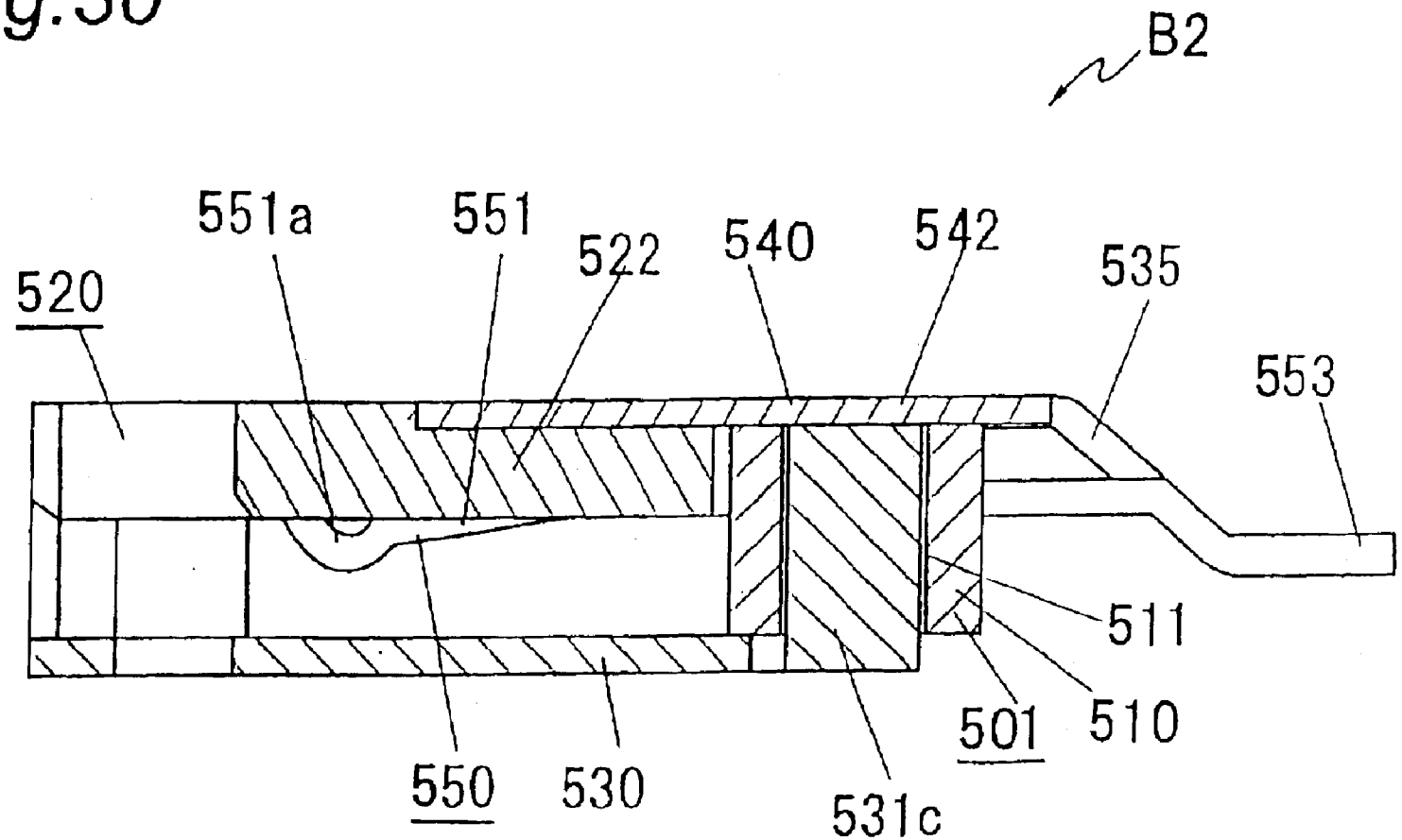
FIG. 30 is a sectional view through line B—B in FIG. 28.

Tabs 534 extend from one side edge of second shell 530 as contact parts for contacting the ends of pressure tabs 543, which are disposed to the first shell 540. These tabs 534 of the second shell 530 are also welded to the push tabs 543 of the first shell 540 at weld 562 (FIG. 27). In addition, crimping tabs 541 of first shell 540 are welded to locking tabs 533 of second shell 530 at weld 561 (FIG. 27).

Therefore, because first shell 540 and second shell 530 are welded at appropriate points of contact therebetween in the connector receptacle B2 according to this embodiment of the invention, deformation in the thickness direction of the connector can be suppressed when the connector plug A1 is inserted from insertion opening 570, reliable contact can be established between first shell 540 and second shell 530, and the ground potential when mounted to the circuit board can be stabilized.

Assembling a connector receptacle B2 thus comprised is described next below.

First, second shell 530 is assembled from above as seen in FIG. 26 to the contact block 501 having contacts 550 integrally molded to the holding frame 510 so that pressure tabs 531 of second shell 530 are pressed into insertion holes 511 of holding frame 510. The first shell 540 is then assembled from below as seen in FIG. 26 so that push tabs 543 of first shell 540 integrally molded to the body 520 are pressed into the insertion holes 511 in holding frame 510. Crimping tabs 541 of first shell 540 are then crimped to the locking tabs 533 of second shell 530, and welds 561 to 563 are made to bond first shell 540 and second shell 530 together.

In this embodiment of the invention, therefore, the second shell 530 and first shell 540 are connected so that the contact block 501 is disposed therebetween in the vertical direction as seen in FIG. 26.

Because the contacts 550 are integrally molded to the holding frame 510 in the contact block 501 according to this embodiment of the invention, deformation of the contacts 550 during assembly can be prevented when compared with longitudinally pushing the contacts into place as done in the prior art, and the flatness of the contacts 550 in the same plane can be more easily assured. Furthermore, because first shell 540 is integrally molded to body 520, insulation of contacts 550 and first shell 540 can also be assured.

A variation of this connector receptacle B2 is described next with reference to FIG. 32 to FIG. 35.

This variation is characterized by the shape of the through-holes 511*b* to which push tabs 543 projecting from first shell 540 toward second shell 530 are inserted in the holding frame 510 of contact block 501, and the shape of through-holes 511*a* to which pressing tabs 531*c* projecting from second shell 530 toward first shell 540 are inserted, being different. In the example shown in the figure the open side of through-holes 511*a* is rectangular, and the open side of through-holes 511*b* is shaped like a cross.

If the insertion holes 511 to which pressure tabs 531 are inserted and the insertion holes 511 to which push tabs 543 are inserted have the same shape as shown in FIG. 23 to FIG. 31, the lengthwise assembly positions of second shell 530 and first shell 540 to holding frame 510 of contact block 501 can be mistaken. However, if the shape of the through-holes 511*b* to which push tabs 543 are inserted and the shape of the through-holes 511*a* to which pressure tabs 531 are inserted differ, it is easy to determine where the first shell 540 and second shell 530 are to be respectively assembled to the holding frame 510 of contact block 501.

A yet further variation of this connector receptacle B2 is described below.

Figure 39:
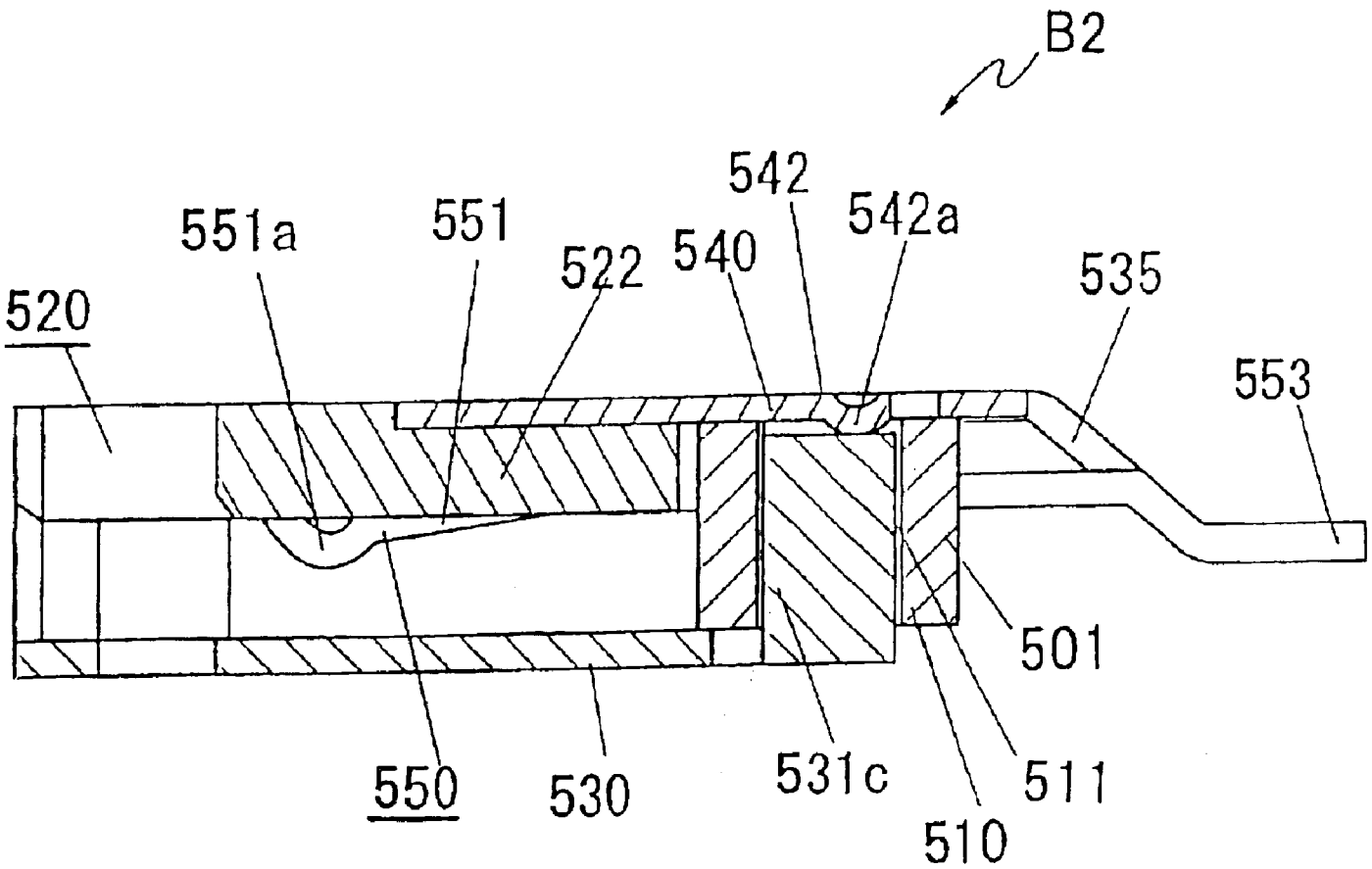
FIG. 39 is a sectional view through line B—B in FIG. 38.

As shown in FIG. 36 to FIG. 39, curved contacts 542*a* form protrusions toward second shell 530 in the thickness direction of first shell 540 at the end of tabs 542 extending from first shell 540 (see FIG. 39). In this variation contacts 542*a* reliably contact pressure tabs 531, and the ground potential when mounted to the circuit board can be stabilized.

Furthermore, contact tabs 534 extend from second shell 530 as flexible contacts for flexibly contacting the end of push tabs 543 extending from one long edge of first shell 540. Contact area between first shell 540 and second shell 530 thus increases and the ground potential can be further stabilized.

Embodiment 3

FIG. 40 to FIG. 48 show a connector receptacle B3 according to a third embodiment of the invention. This connector receptacle B3 has a synthetic resin molded body 620, a holding frame 610, a first shell 640, and a second shell 630. The body 620 contains a plurality of contacts 650 for contacting contacts 10 of connector plug A1. The holding frame 610 is of an insulation material for holding all of the contacts 650 to the body 620. First shell 640 is of a metal plate extending lengthwise to the direction of the contact 650 array and is integrally molded with the body 620. Second shell 630 is also of a metal plate extending through the entire length of the contact 650 array and is bonded with the first shell 640 so as to enclose contacts 650 between the second shell 630 and first shell 640. An insertion opening 670 for inserting connector plug A1 between contacts 650 and second shell 630 is formed between body 620 and second shell 630 (see FIG. 42).

That is, the insertion opening 670 for inserting the terminal parts on the insertion side of connector plug A1 is formed in the area surrounded by body 620 and second shell 630. Connector plug A1 is inserted along the circuit board to insertion opening 670. Note that first shell 640 is insert molded to body 620, which is made of an insulation material.

The body 620 has an insulation base 621 for insulating the first shell 640 and contacts 650, base 620*a* extending in the lengthwise direction of insulation base 621 for holding contacts 650 to the holding frame 610, and guide parts 627 formed integrally continuously to both lengthwise ends of the insulation base 621 for guiding both ends of the connector plug A1. Channels 620*e* equal to the number of contacts 650 are formed in the insertion direction of connector plug A1 in the base 620*a* on the side opposite holding frame 610. The channels 620*e* are open on the side opposite the holding frame 610 of base 620*a*. Dividers 622 preventing a short-circuit between adjacent contacts 650 are formed on the side of insulation base 621 opposite second shell 630. The channels between adjacent dividers 622 are formed in line with channels 620*e*. It should be noted that guide parts 627 also function to prevent upside down insertion of the connector plug A1, and can thus prevent the connector plug A1 from being inserted with front and back sides reversed.

The contacts 650 are formed of a conductive material in strips and have a contact tab 651 for contacting contacts 10 of connector plug A1 at one end and contact part 653 for surface mounting to the circuit board at the other end with the contact tab 651 and contact part 653 connected by a fixed part 652 so that each contact 650 is a single continuous piece. The fixed part 652 of contacts 650 is pressed into channel 620*e*, and thus fixed between base 620*a* and holding frame 610. The contact tabs 651 are inclined in the thickness direction of insulation base plate 621, and have at the end thereof a contact part 651*a* bent to form a protrusion away from the insulation base plate 621 in the thickness direction of the insulation base plate 621. The contact tabs 651 are able to flex when the contacts 650 are fixed in the body 620.

Figure 48:
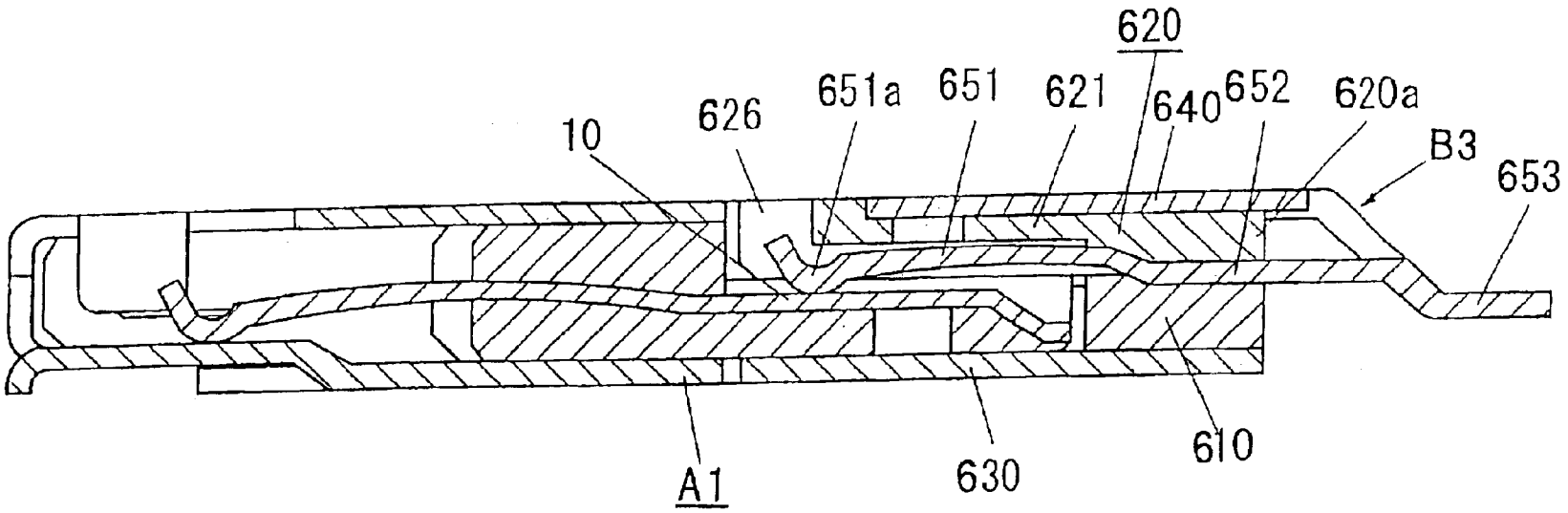
FIG. 48 is a sectional view showing a connector plug inserted to the connector receptacle in FIG. 40.
Figure 49:
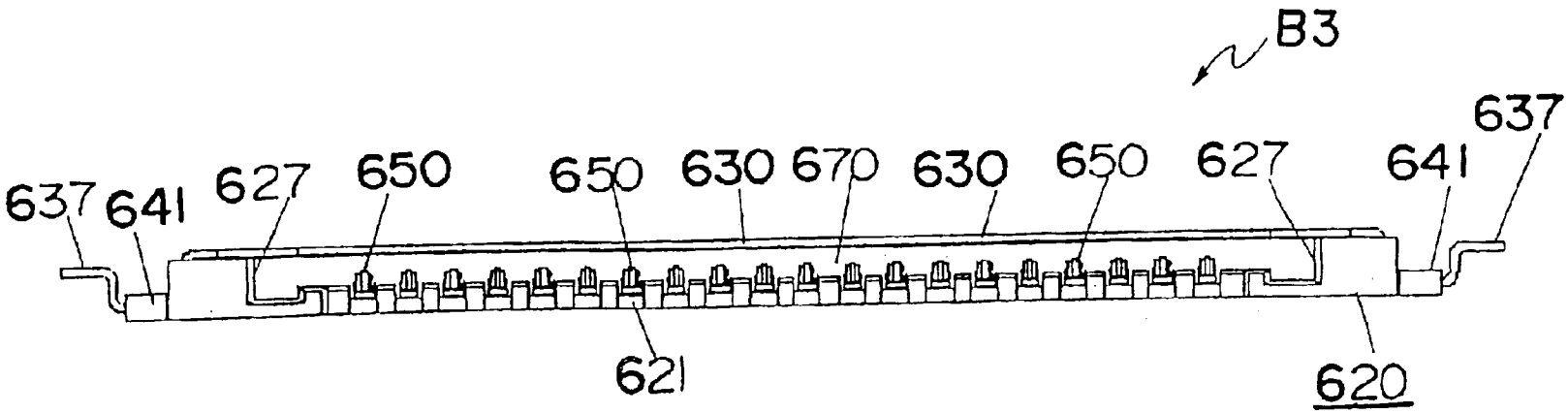
FIG. 49 is a front view of a variation of the connector receptacle in FIG. 40.
Figure 50:
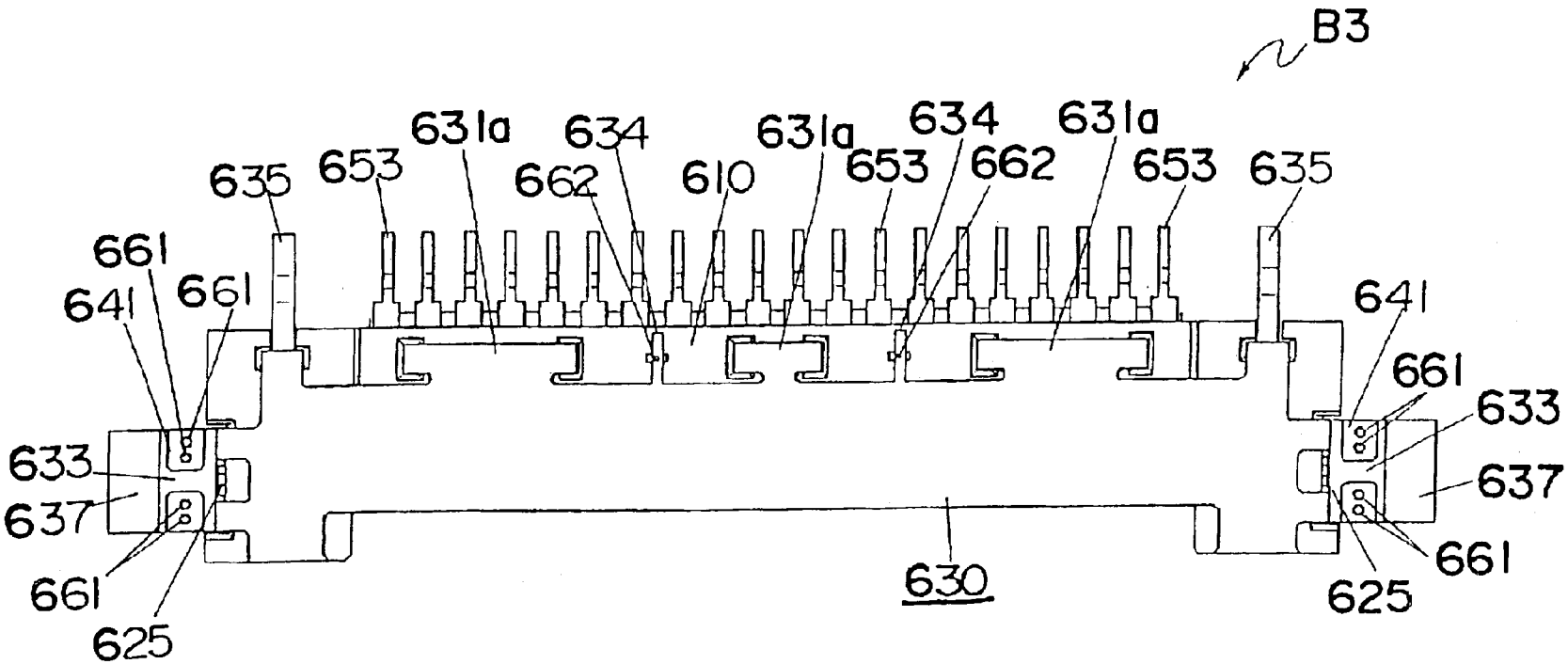
FIG. 50 is a top plan view of the connector receptacle shown in FIG. 49.
Figure 51:
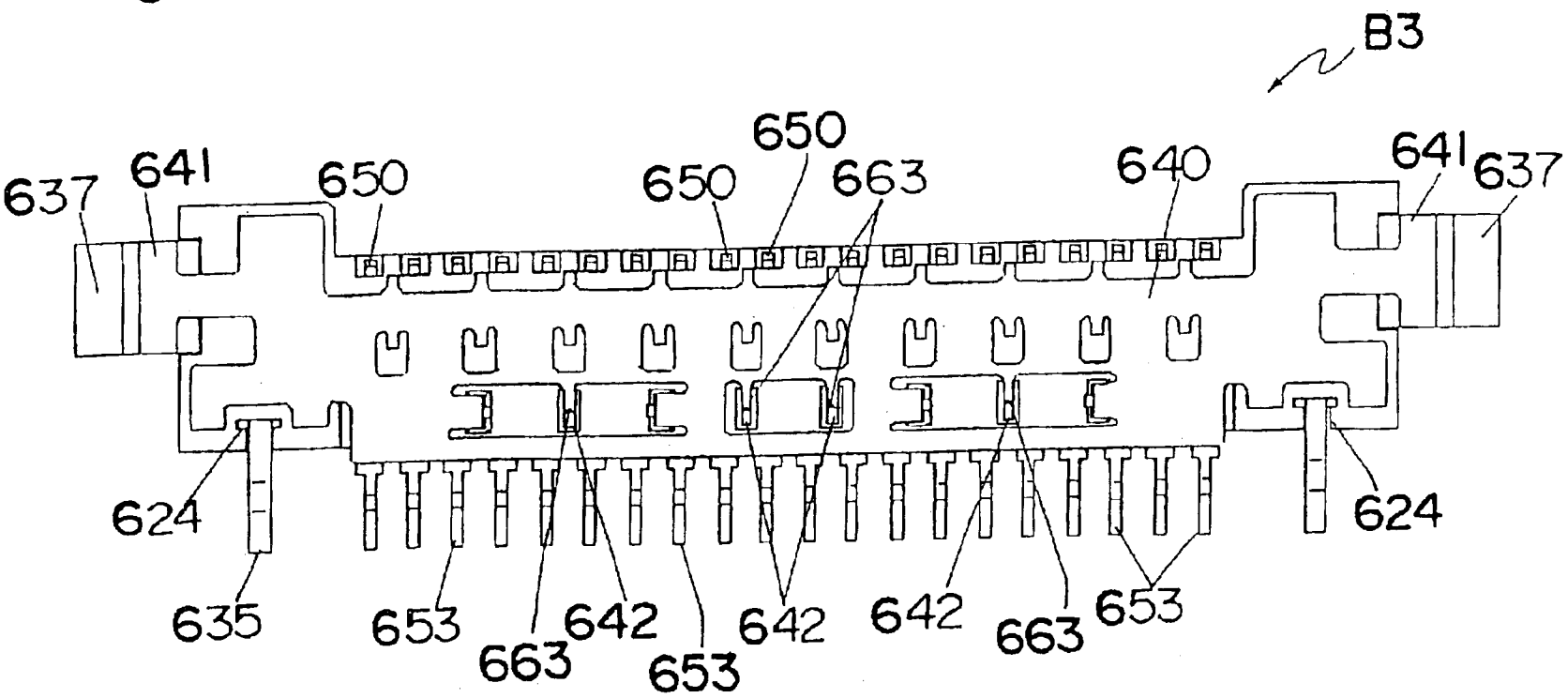
FIG. 51 is a bottom plan view of the connector receptacle shown in FIG. 49.
Figure 52:
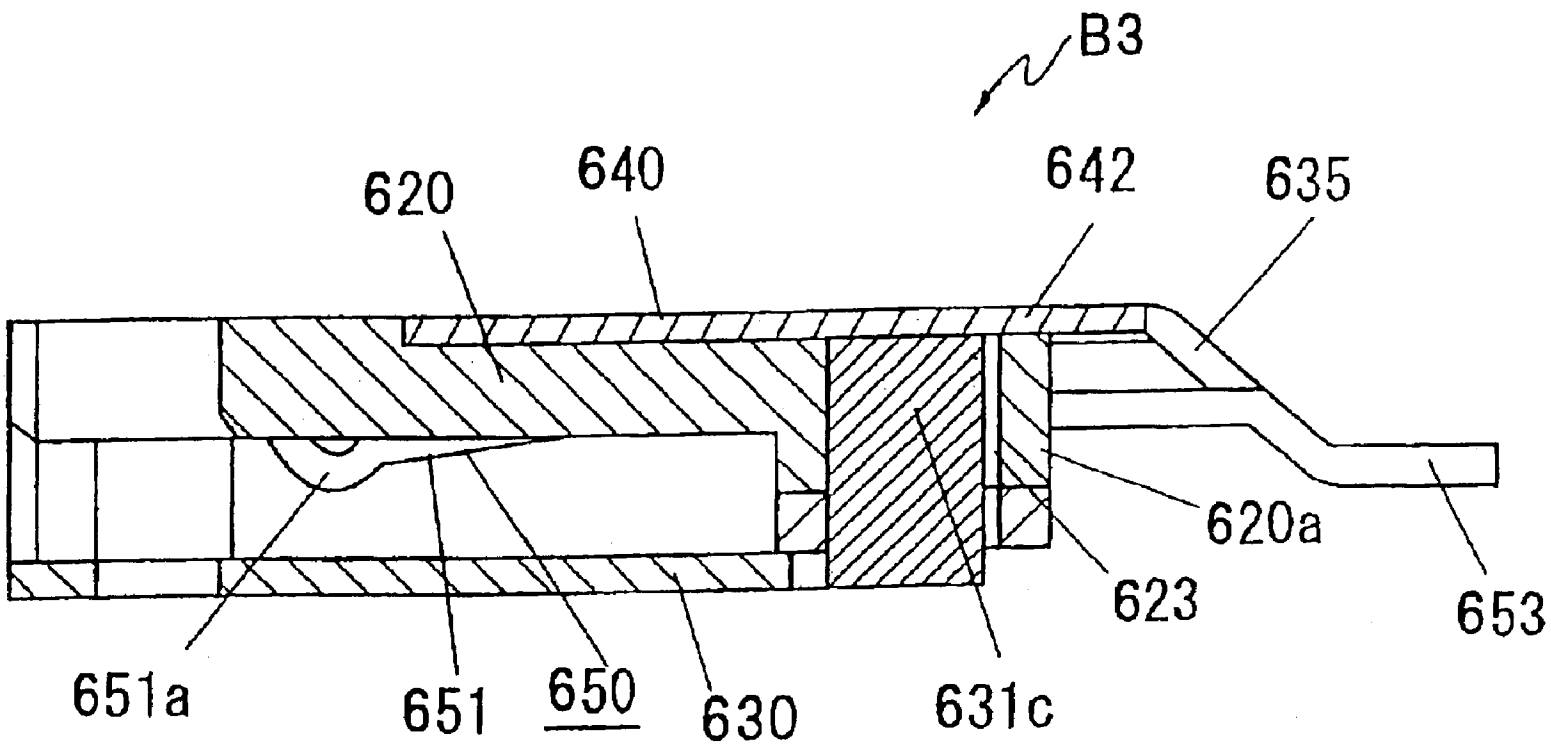
FIG. 52 is a sectional view of the connector receptacle in FIG. 49.
Figure 53A:
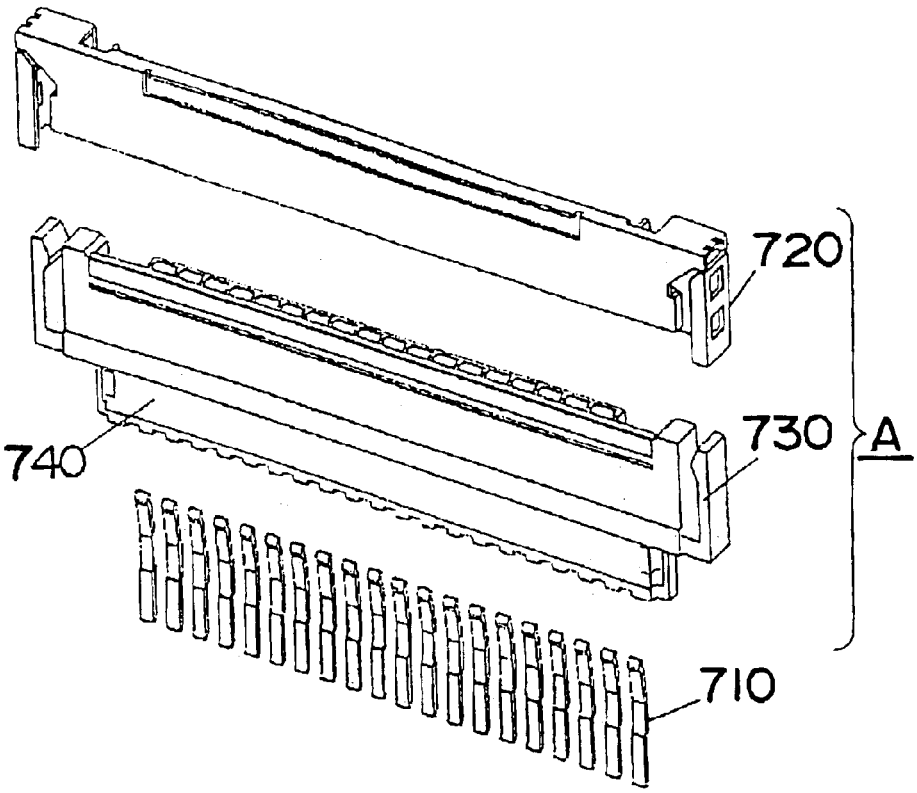
FIG. 53A is an exploded perspective view of a conventional connector plug.
Figure 53B:
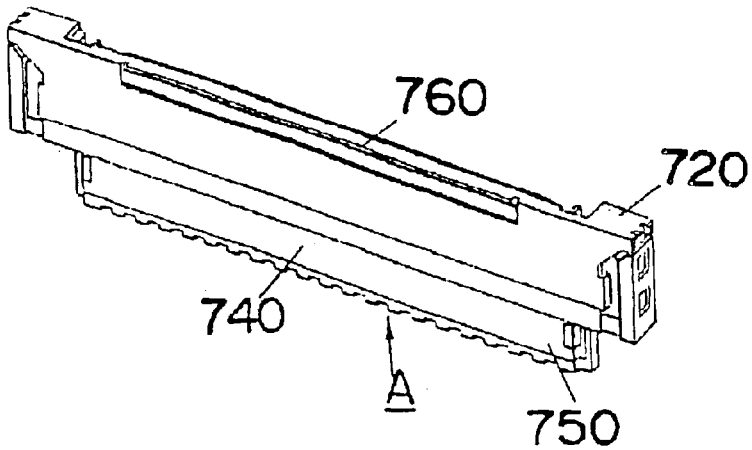
FIG. 53B is a perspective view of the connector plug in FIG. 53A.
Figure 54:
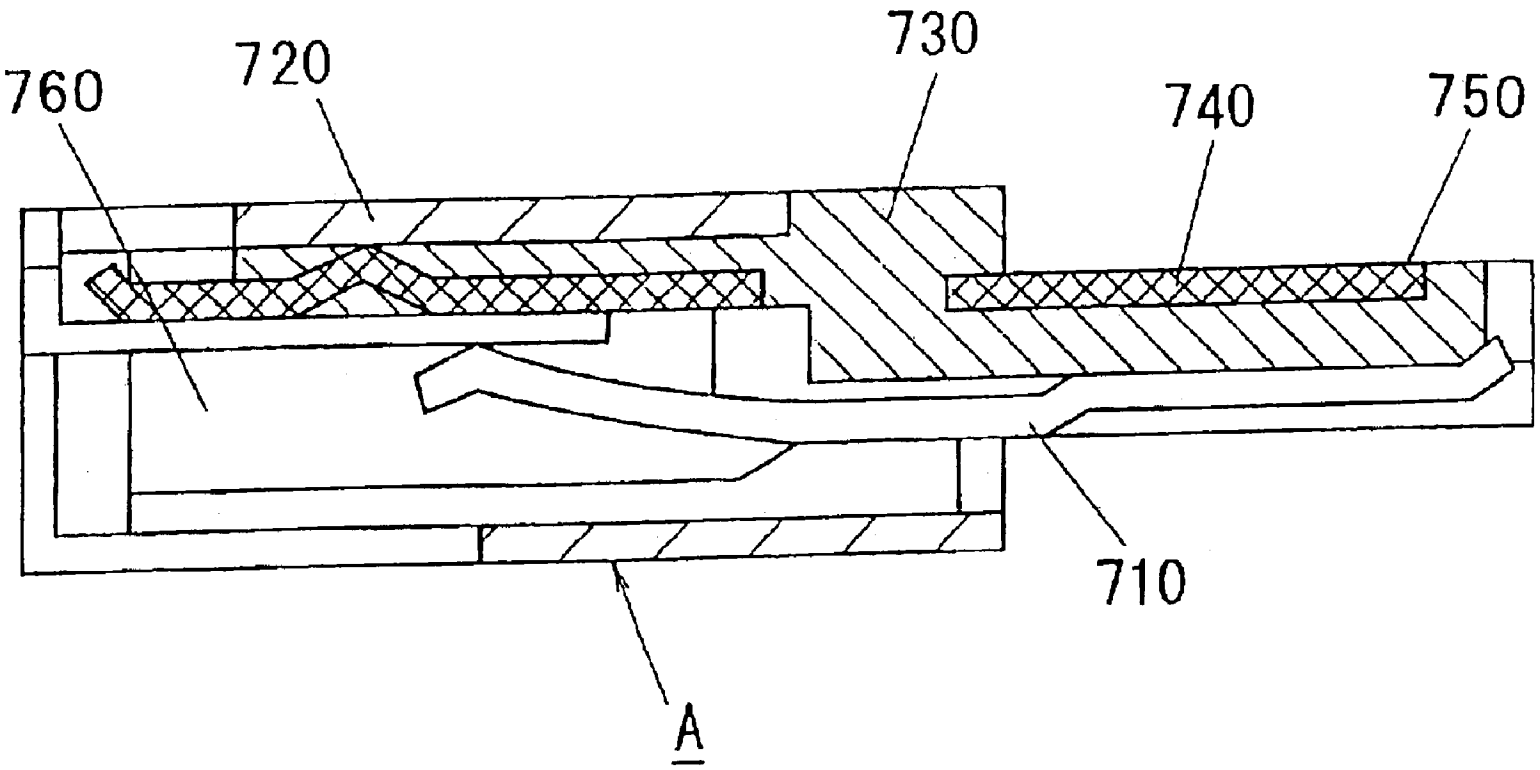
FIG. 54 is a side sectional view of the connector plug in FIG. 53A.
Figures 55A, 55B, 55C:
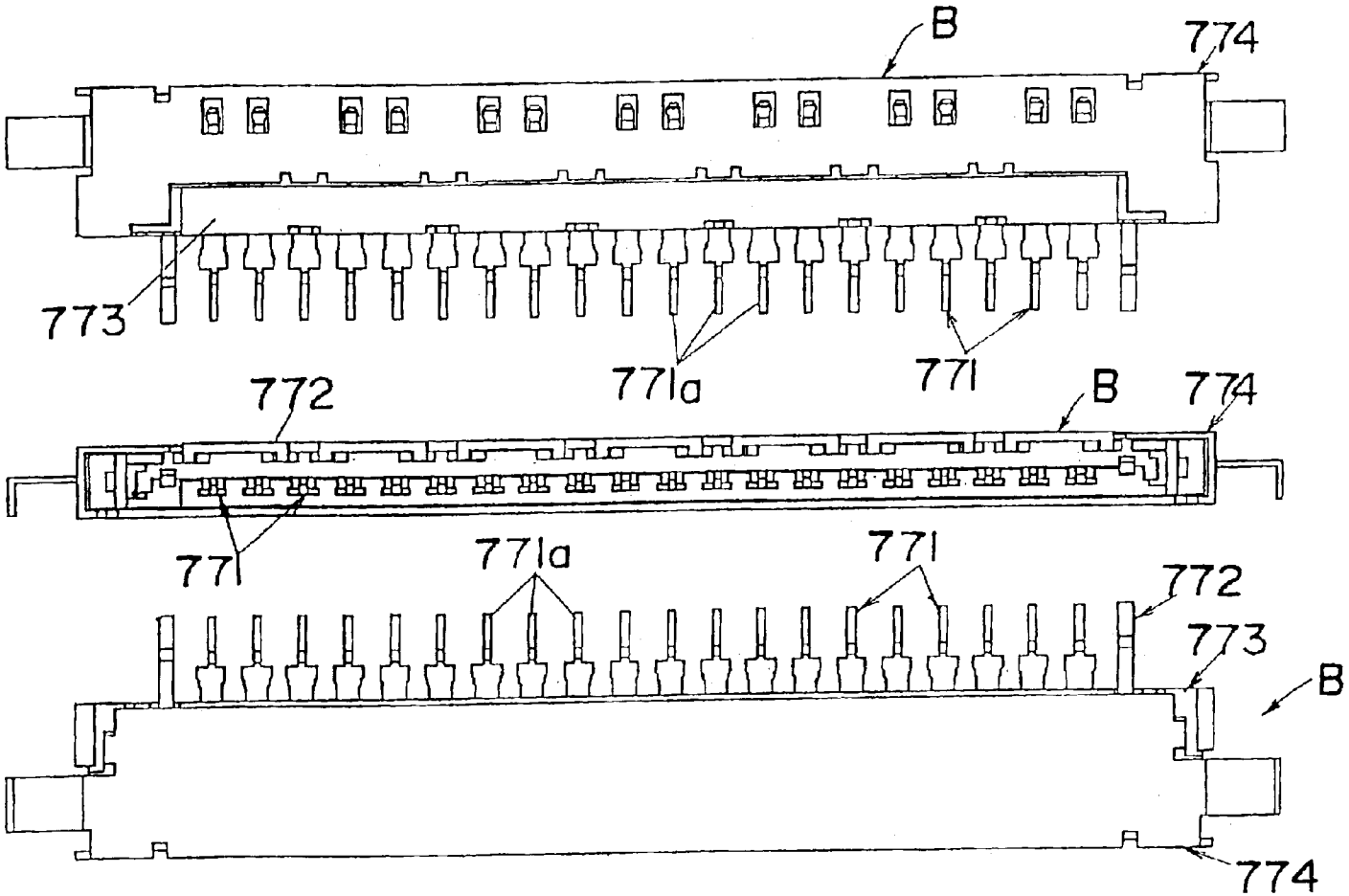
FIG. 55A is a side view of a conventional connector receptacle.
FIG. 55B is a front view of the connector receptacle shown in FIG. 55A.
FIG. 55C is another side view of the connector receptacle in FIG. 55A.
Figure 56A:
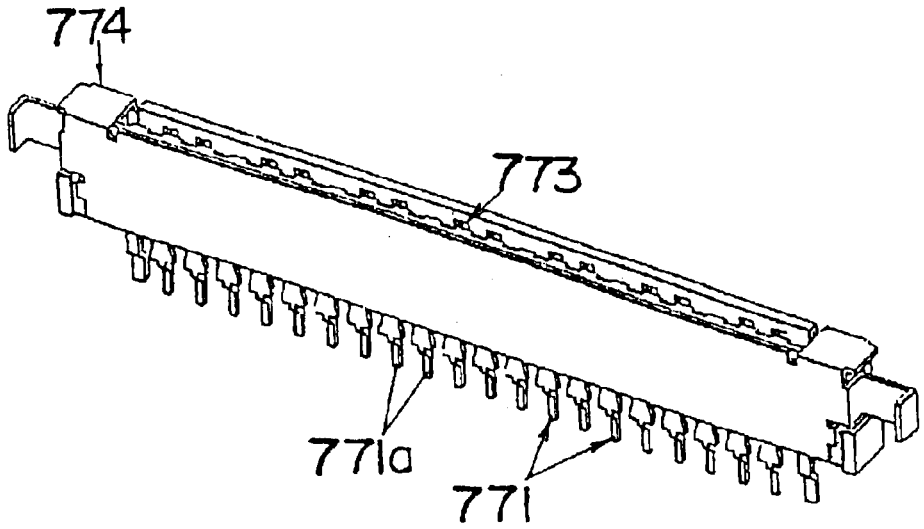
FIG. 56A is a perspective view of the connector receptacle shown in FIG. 55A.
Figure 56B:
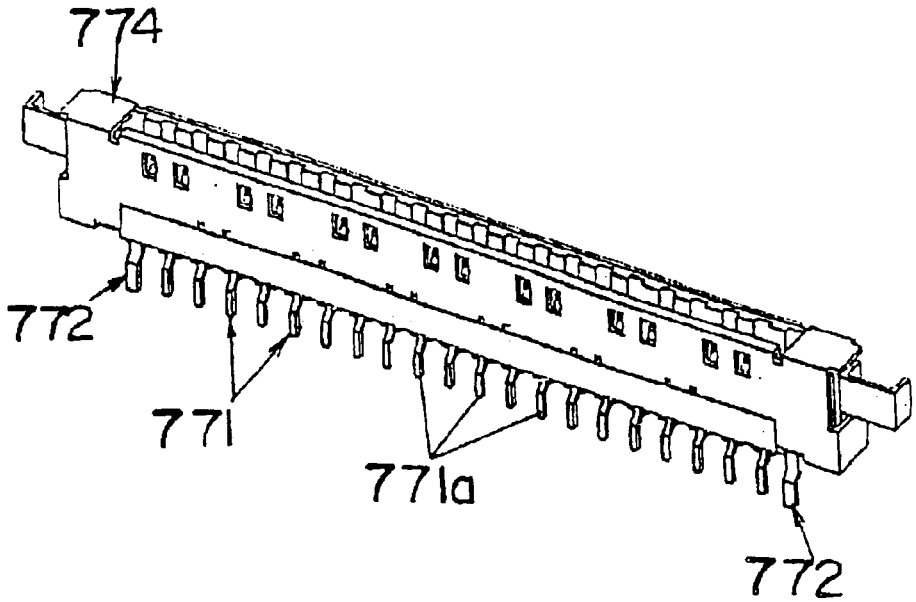
FIG. 56B is another perspective view of the connector receptacle shown in FIG. 55A.
Figure 57:
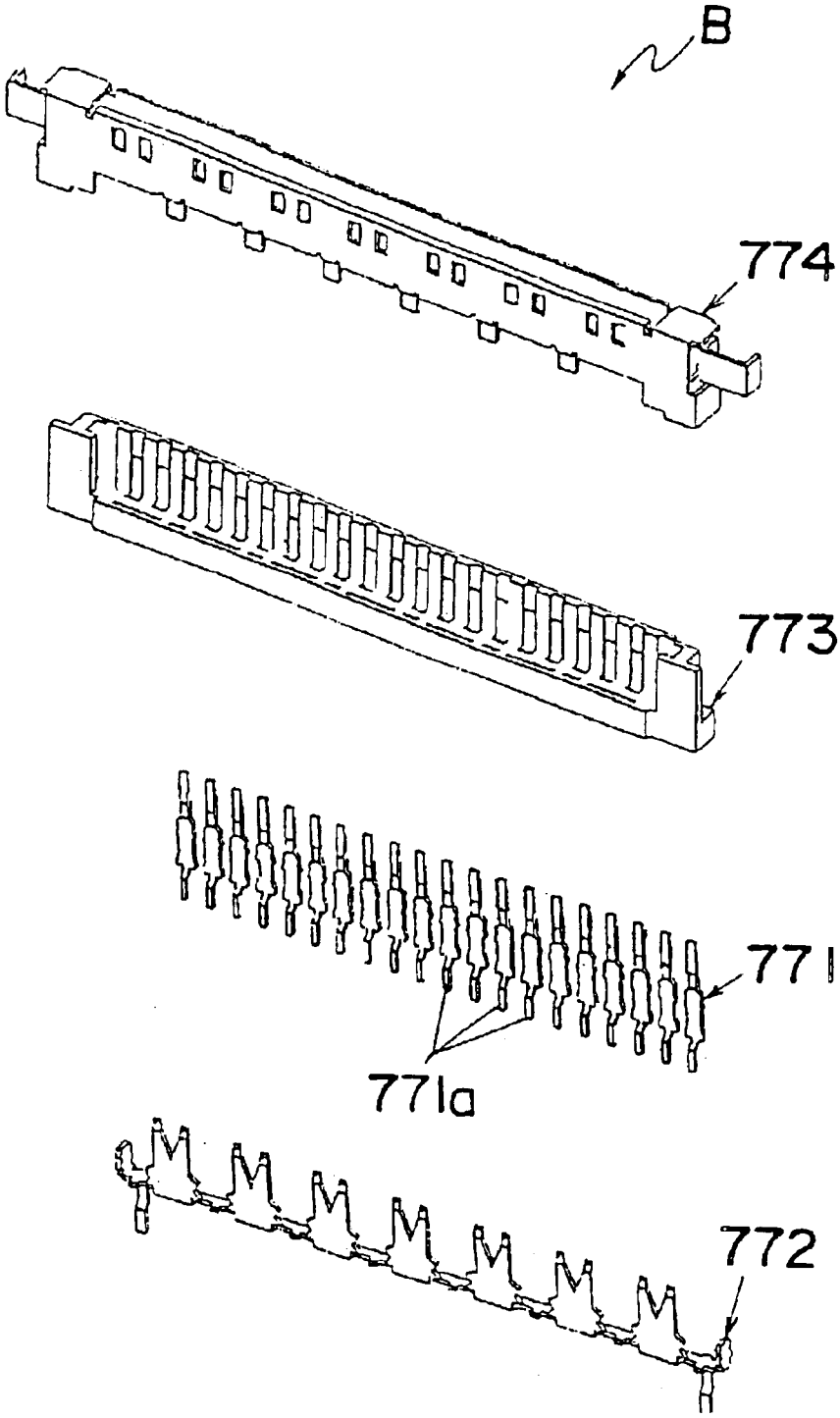
FIG. 57 is an exploded perspective view of the connector receptacle shown in FIG. 55A.
Figure 58:
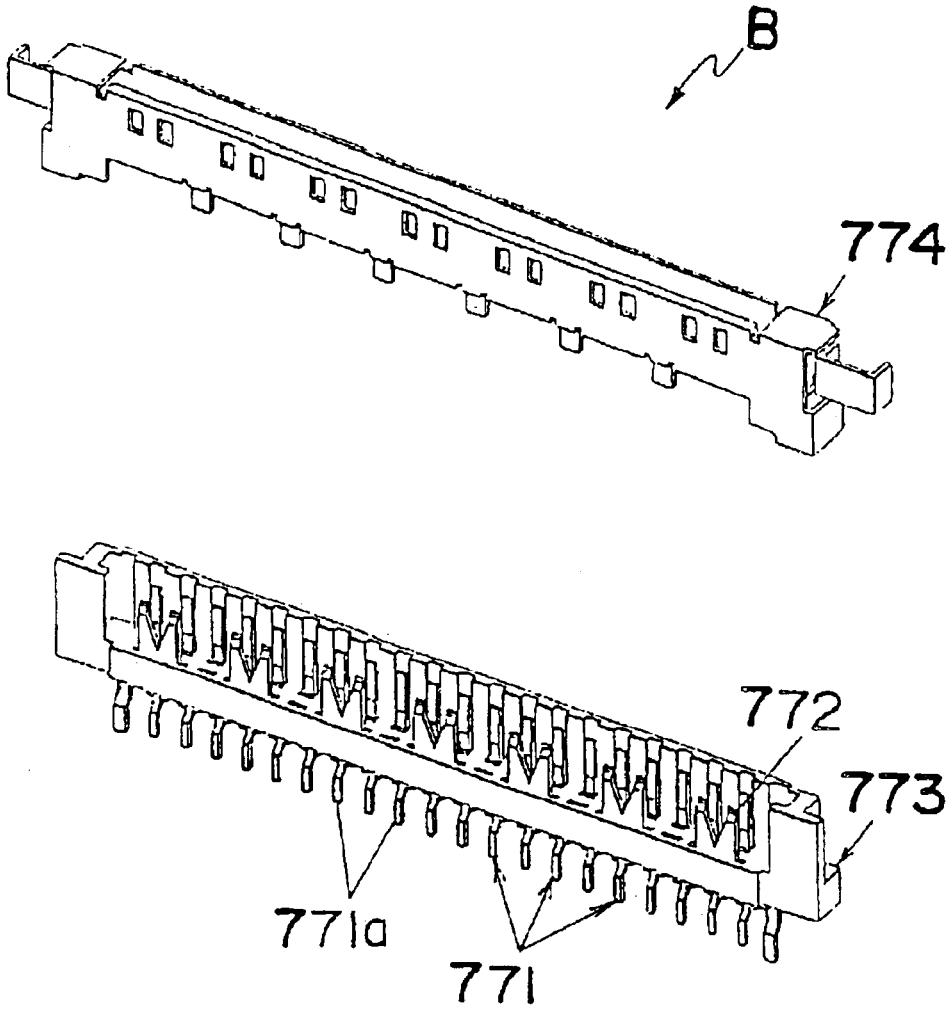
FIG. 58 is another exploded perspective view of the connector receptacle shown in FIG. 55A.

As shown in FIG. 48, when the terminal parts of connector plug A1 are inserted to insertion opening 670, contact part 651*a* contacts contact 10 of connector plug A1 so that contact tabs 651 are pushed and enter between adjacent dividers 622. Contact pressure between contacts 10 of connector plug A1 and contacts 650 is assured at this time by deflection of contact tabs 651 and contact parts 651*a*.

It should be noted that the part of body 620 surrounding insertion opening 570 has a comb-like shape formed by the dividers 622 extending as protrusions from the leading edge of the insulation base plate 621, and the contacts 650 are disposed corresponding to matching channels 626. It is therefore possible to prevent interference of insulation base plate 621 of body 620 with the ends (contact part 651*a*) of the contacts 650 when connector plug A1 is inserted from insertion opening 670, and the connector can be made even thinner.

Figure 44:
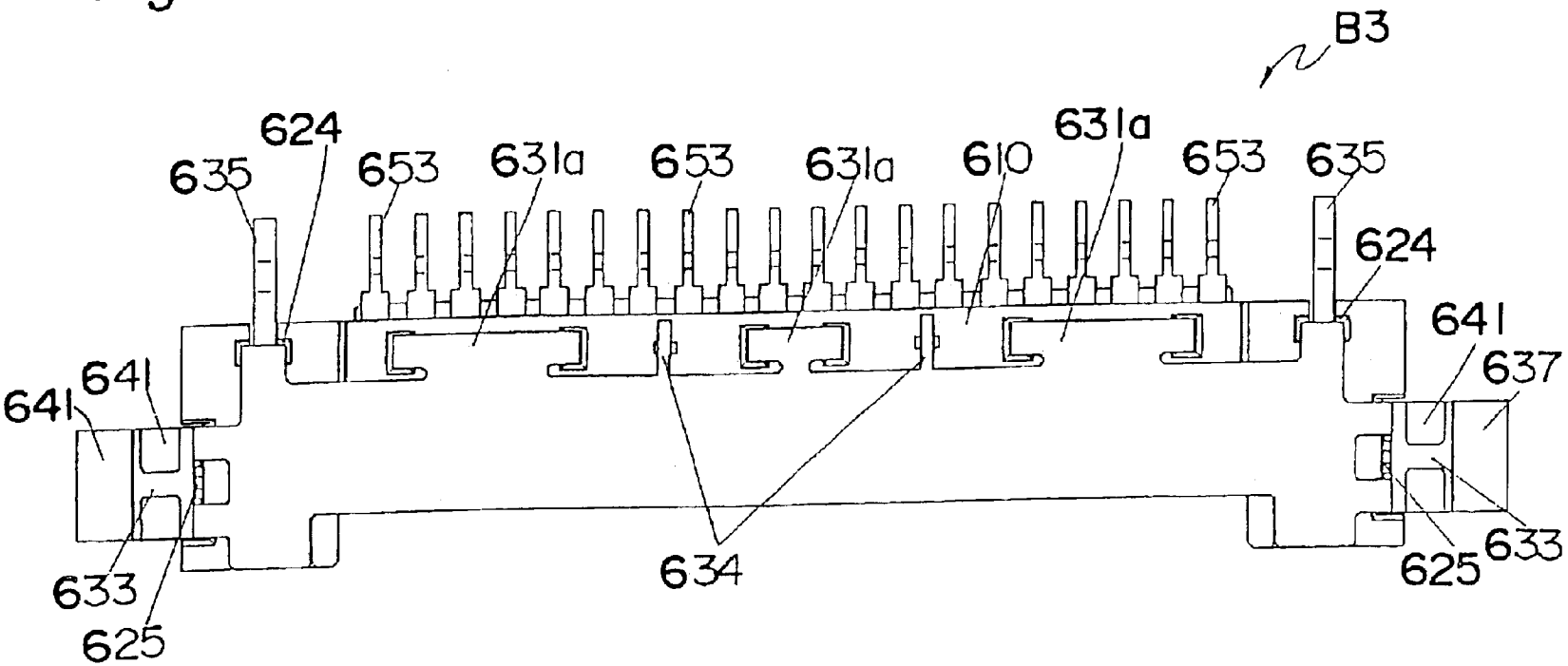
FIG. 44 is a top plan view of the connector receptacle shown in FIG. 40.
Figure 45:
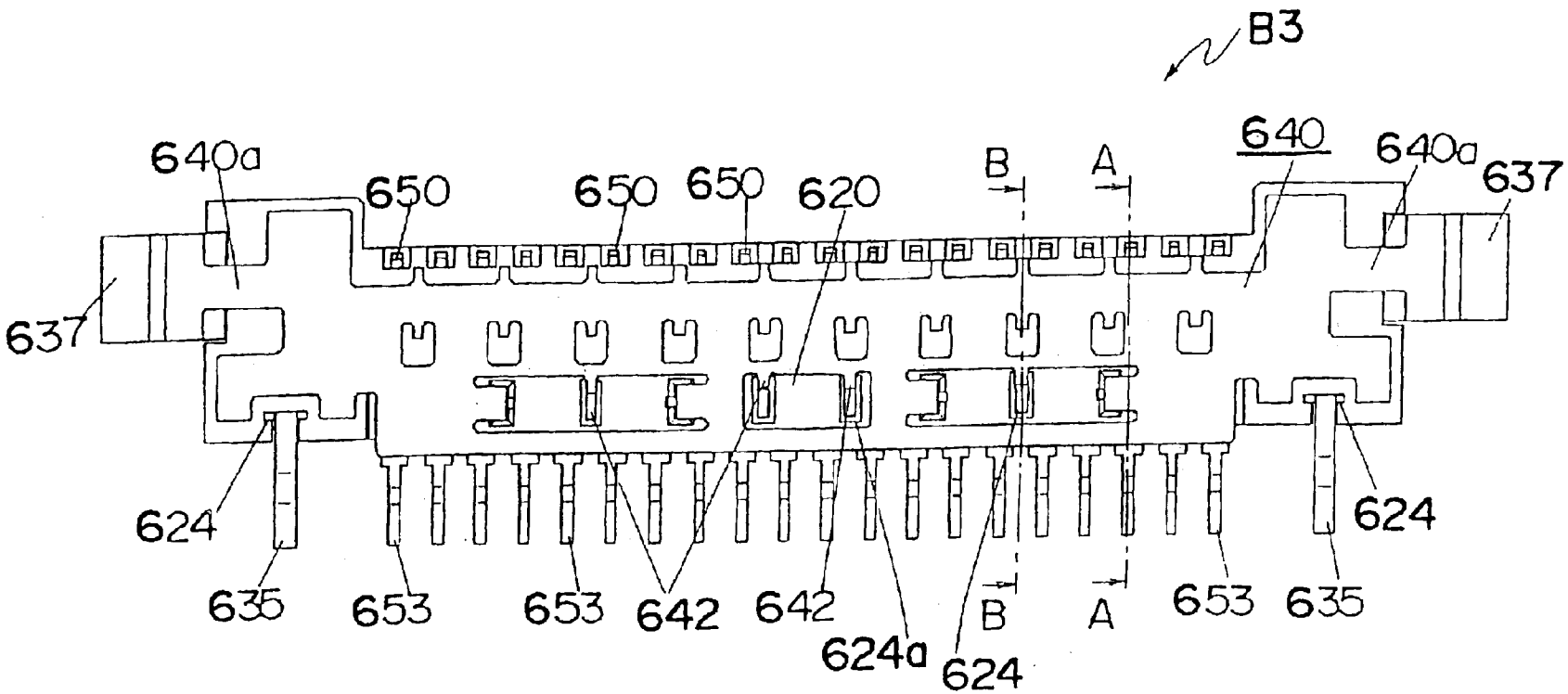
FIG. 45 is a bottom plan view of the connector receptacle shown in FIG. 40.
Figure 46:
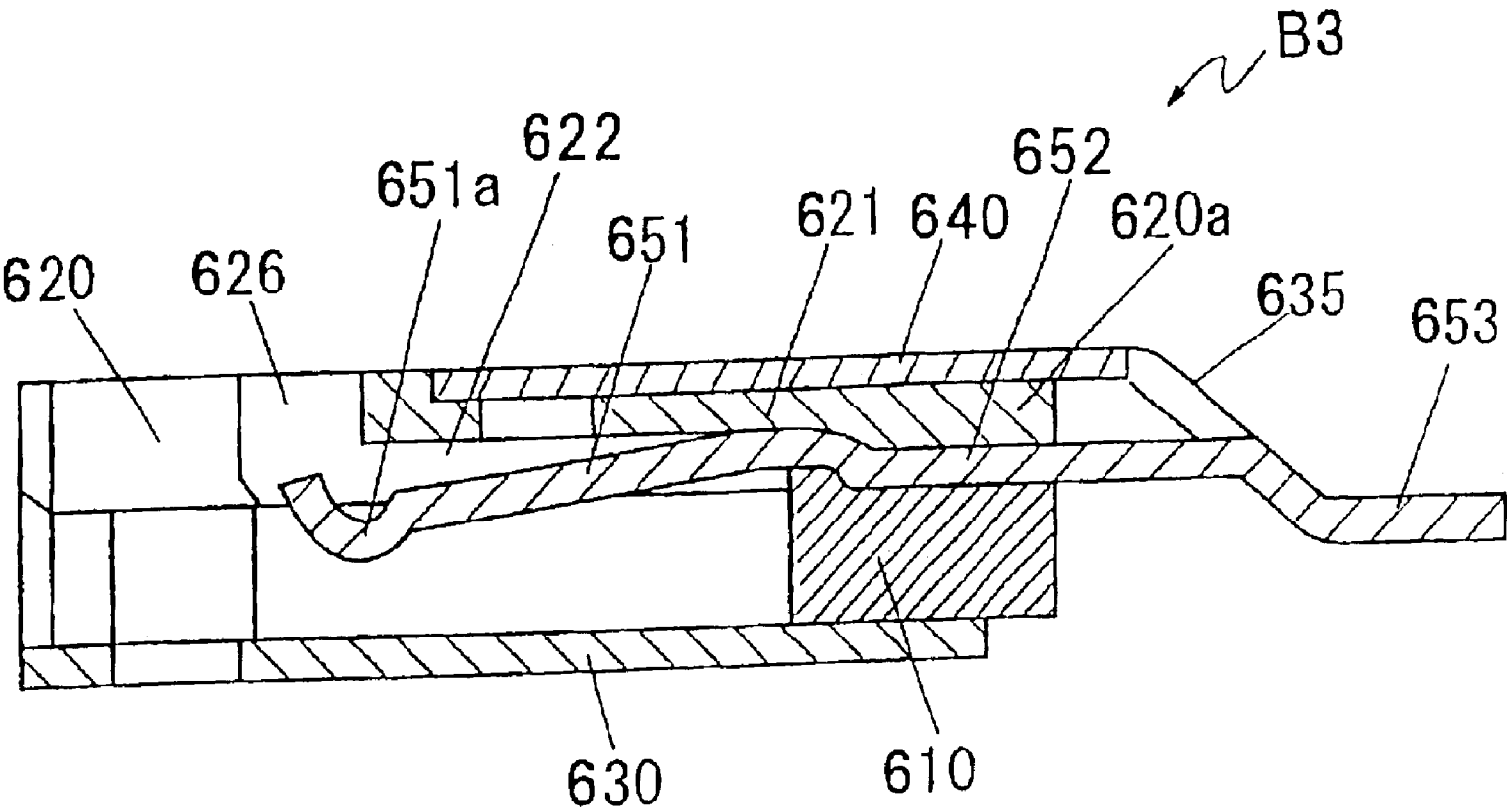
FIG. 46 is a sectional view through line A—A in FIG. 45.

The second shell 630 has T-shaped shoulders 631*a* projecting from one long edge thereof, and pressing tabs 631*c* project toward the first shell 640 from both edges of the shoulders 631*a*. The second shell 630 is a rectangular member long from left to right as seen in FIG. 44, has locking tabs 633 disposed thereto through intervening shoulders 638 at both right and left ends, and has L-shaped terminal ends 637 further extending from the locking tabs 633. Engaging holes 632 are formed at right and left ends of the second shell 630 extending to the shoulders 638.

Notches 633*a* are formed to the locking tabs 633 at both sides thereof at opposite ends of the second shell 630. Push tabs 636 project toward the first shell 640 from one side edge at both right and left ends of the second shell 630, and terminal ends 635 extend from the ends of the push tabs 636. Note that terminal ends 635 and 637 are connected to the ground pattern of the circuit board.

On the other hand, the body 620 has insertion holes 623 formed in base 620*a* (part overlapping holding frame 610) to receive pressing tabs. 631*c* projecting from second shell 630 toward first shell 640, and also has recesses 624 to receive push tabs 636 projecting from second shell 630 toward first shell 640. The body 620 also has tabs 625 formed at both ends in the lengthwise direction thereof (in the same direction in which the contacts 650 are arrayed) to engage with the engaging holes 632 formed in second shell 630.

Tabs 643 project from first shell 640 toward second shell 630 at a part overlapping base 620*a* (part overlapping holding frame 610). Tabs 640*a* are integrally formed with first shell 640 so as to project from both lengthwise ends thereof, and crimping tabs 641 for securing second shell 630 extend integrally from tabs 640*a*. The crimping tabs 641 are formed long in the insertion direction of the connector plug A1. The first shell 640 is connected (fastened) to the second shell 630 by crimping (folding over) both lengthwise ends of the crimping tabs 641 at the parts corresponding to the notches 633*a* in second shell 630.

Figure 40:
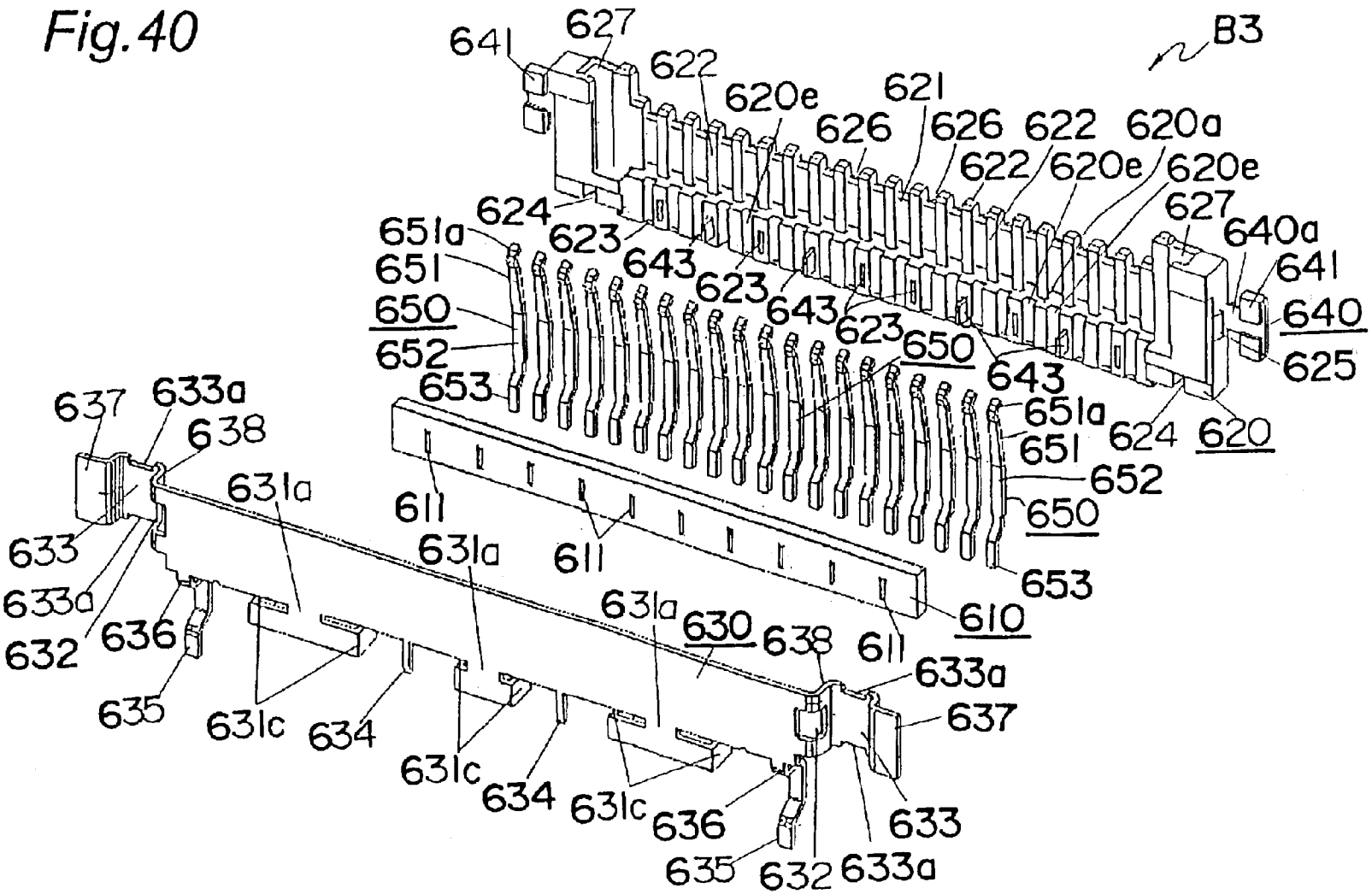
FIG. 40 is an exploded perspective view of a connector receptacle according to a third embodiment of the invention.
Figure 41:
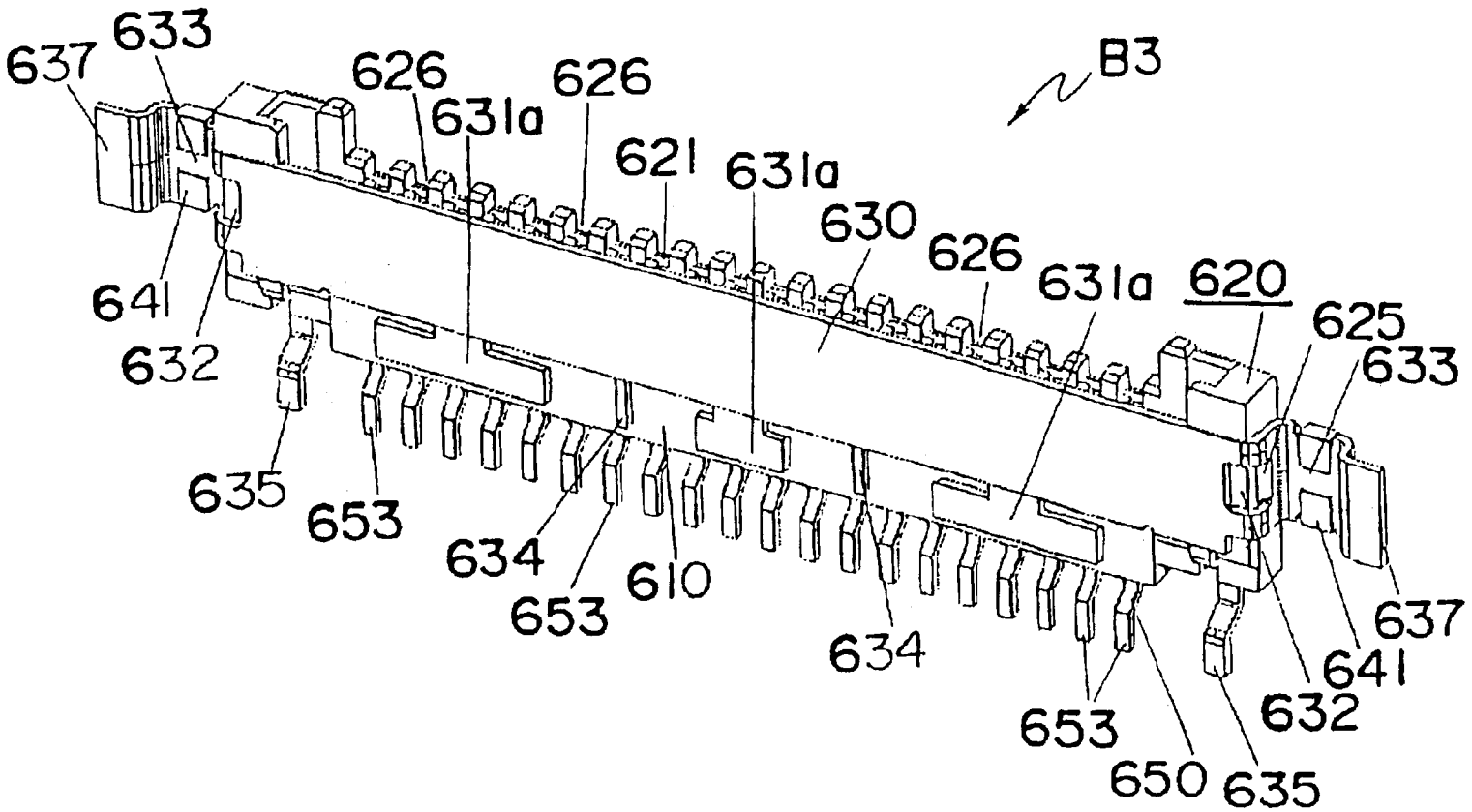
FIG. 41 is a perspective view of the connector receptacle shown in FIG. 40.
Figure 42:
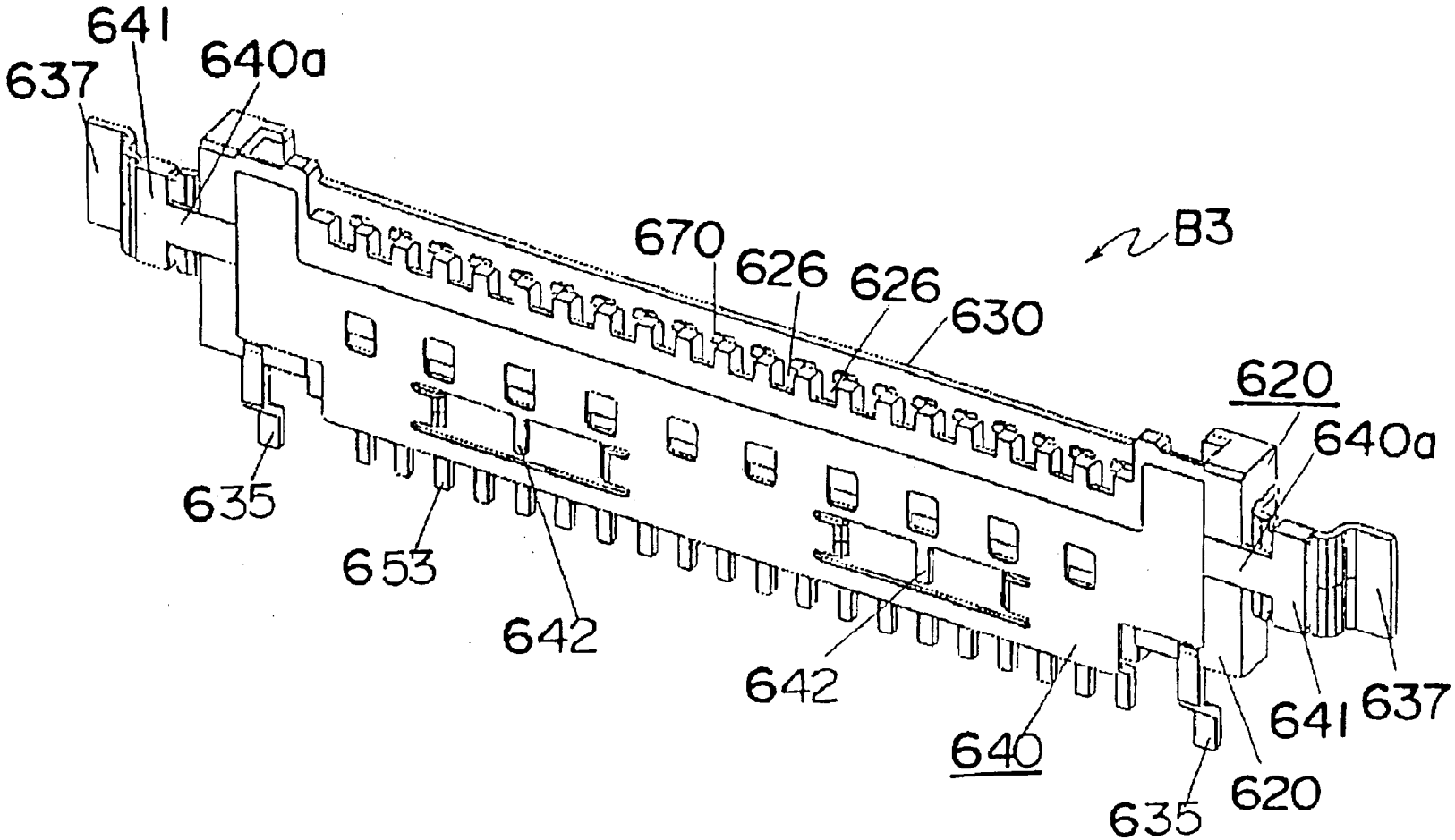
FIG. 42 is another perspective view of the connector receptacle shown in FIG. 40.

It should be noted that both ends of the crimping tabs 641 are shown in the crimped position in FIG. 40, and crimping tabs 641 are the crimping parts of the present embodiment.

The holding frame 610 is shaped like an elongated block, and insertion holes 611 are formed at a uniform pitch in line with the array of contacts 650. Tabs 631 to tabs 643 are pressed into insertion holes 611.

The present embodiment is thus able to establish reliable contact between the first shell 640 and second shell 630, and stabilize the ground potential when mounted to the circuit board. It is also possible to suppress deformation in the thickness direction of the connector when the connector plug A1 is inserted from insertion opening 670.

Figure 47:
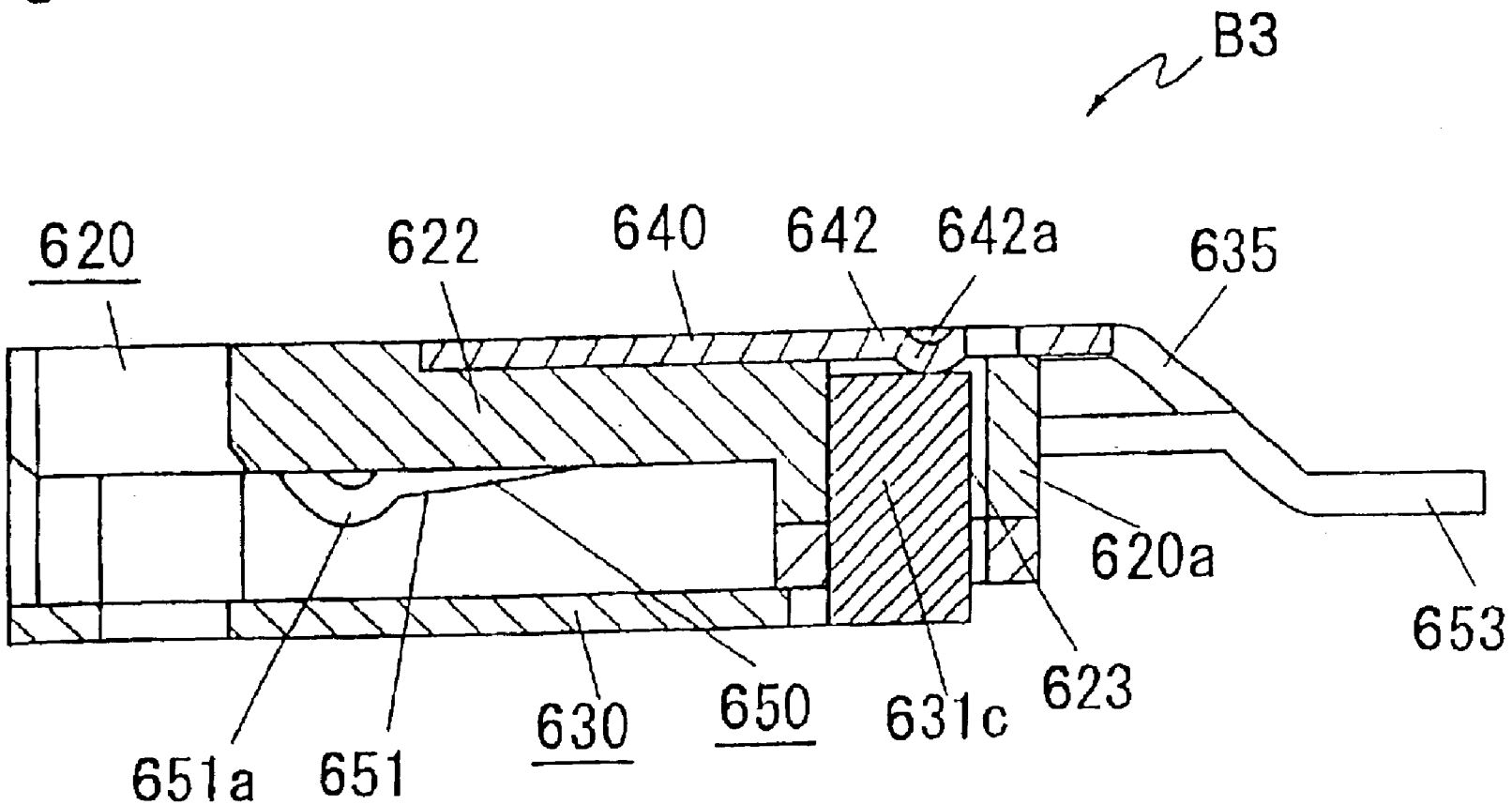
FIG. 47 is a sectional view through line B—B in FIG. 45.

The first shell 640 has tabs 642 formed at one side thereof so as extend in the widthwise direction thereof to act as contact parts for contacting the ends of pressure tabs 631, which are disposed to the second shell 630. The contact area between the first shell 640 and second shell 630 is thus increased and the ground potential can be yet further stabilized. As shown in FIG. 47, curved contacts 642*a* form protrusions toward second shell 630 in the thickness direction of first shell 640 at the end of tabs 642 (see FIG. 47), thus assuring reliable contact between contacts 642*a* and tabs 631.

Furthermore, contact tabs 634 extend from second shell 630 as flexible contacts for flexibly contacting the end of push tabs 643 extending from one edge in the thickness direction of first shell 640. Contact area between first shell 640 and second shell 630 thus increases and the ground potential can be further stabilized.

Assembling a connector receptacle B3 thus comprised is described next below.

Figure 43:
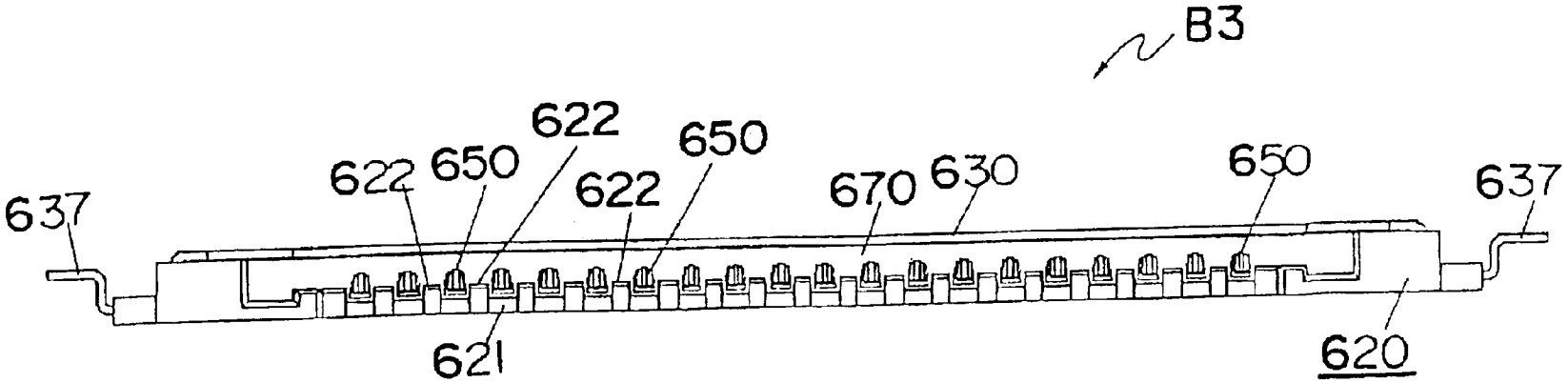
FIG. 43 is a front view of the connector receptacle shown in FIG. 40.

The fixed part 652 of each contact 650 is first pressed from above as seen in FIG. 43 into each channel 620*e* in the base 620*a* of body 620 integrally molded to first shell 640, and holding frame 610 is then assembled from above as seen in FIG. 43 to the body 620 so that tabs 643 of first shell 640 are pressed into the insertion holes 611 in holding frame 610. The tabs 631 of second shell 630 are then pressed from above as seen in FIG. 43 through the insertion holes 611 in holding frame 610 to the insertion holes 623 in base 620*a*, and crimping tabs 641 of first shell 640 are crimped to the locking tabs 633 of the second shell 630 to lock first shell 640 and second shell 630 together.

Therefore, the second shell 630 and first shell 640 are fastened together so that the holding frame 610 and fixed parts 652 of contacts 650 are held therebetween in the vertical direction as seen in FIG. 43.

Assembly is thus simple with the connector receptacle B3 according to the present embodiment because the various parts (contacts 650, holding frame 610, second shell 630) can be assembled from one direction to the body 620 without changing the orientation of the body 620. Furthermore, because the contacts 650 are assembled by pressing the fixed parts 652 thereof into position from above as seen in FIG. 43, the contacts are not longitudinally pressed into the mounting holes as they are with the prior art. Assembly is therefore easier, deformation of the contacts during assembly can be prevented, and multiple contacts can be easily arranged parallel in the same plane (the flatness of the terminals can be easily assured). In other words, the contact parts 653 of the contacts 650 can be easily aligned in the same plane.

A variation of this connector receptacle B3 is described next with reference to FIG. 49 to FIG. 52.

This variation is characterized by welding contact between first shell 640 and second shell 630 at a specific location. In the example shown in the figures crimping tabs 641 of first shell 640 and locking tabs 633 of second shell 630 are welded at welds 661 (see FIG. 50), locking tabs 634 of second shell 630 and tabs 643 of first shell 640 are welded at welds 662 (see FIG. 50), and tabs 642 of first shell 640 are welded to tabs 631 of second shell 630 at welds 663 (see FIG. 51).

Because first shell 640 and second shell 630 are welded together at specific contact points, deformation in the thickness direction of the contacts can be prevented when the connector plug A1 is inserted from insertion opening 670, reliable contact can be assured between first shell 640 and second shell 630, and the ground potential can be stabilized when mounted to a circuit board.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A connector having a connector plug and a connector receptacle for connecting a cable and a substrate, the connector plug comprising:

a shell formed of a conductive material, being open on both sides thereof, and having a shoulders;

an insulator made of a resin molding and having a first fitting part on a first side thereof that mates with the connector receptacle, a second fitting part on a second side thereof that mates with the cable, and a plurality of contacts disposed on the second fitting part side, said plurality of contacts being insert molded in said insulator;

the connector receptacle comprising a shell;

the shell of the connector plug having flexible parts that flexibly contact the shell of the connector receptacle mated with the first fitting part;

the insulator being fit into the shell of the connector plug from a first opening on one side of the shell of the connector plug; and said shoulder holds the cable to the contacts, and is formed on the second fitting part side on an inside of the shell of the connector plug opposite the contacts.

2. The connector according to claim 1, wherein the insulator has recesses substantially U-shaped in section and formed on a surface of the insulator so as to extend toward the first fitting part from a base between the contacts, and the flexible parts are disposed inside the recesses.

3. The connector according to claim 1, wherein the cable is a flexible printed circuit board.

4. The connector according to claim 3, wherein a pressing part that presses and positions the flexible printed circuit board to the inside surface of the shell of the connector plug is formed at an edge of a second opening of the shell of the connector plug on the second fitting part side.

5. The connector according to claim 3, wherein the shell of the connector plug has stops formed on both sides of the second opening thereof that prevent removal of the flexible printed circuit board, and the flexible printed circuit board has a protrusion formed on both sides at an end thereof, wherein when the end of the flexible printed circuit board is inserted to the second opening of the shell of the connector plug that is then provisionally positioned at a first position with respect to the insulator and when both the shell of the connector plug and the flexible printed circuit board are slid toward the first fitting part side from the first position to a second position where the insulator and the shell of the connector plug engage, the contacts flexibly deform to hold the flexible printed circuit board between the contacts and the inside surface of the shell of the connector plug.

6. The connector according to claim 1, wherein the connector receptacle comprises a plurality of contacts that conductively contact the contacts of the connector plug, a support frame made of an insulation material that supports and arrays the contacts of the connector receptacle, a first shell made of a metal extending in a direction in which the contacts of the connector receptacle are arrayed, and a second shell made of a metal extending in a direction in which the contacts of the connector receptacle are arrayed, wherein the first and second shells engage with each other so that the contacts of the connector receptacle and the support frame are disposed therebetween, and an insertion opening for inserting the connector plug is formed therebetween, and wherein a plurality of recesses enabling free insertion and removal of the contacts of the connector receptacle are formed to the support frame along an open edge of the insertion opening.

7. The connector according to claim 1, wherein the connector receptacle comprises a plurality of contacts that conductively contact the contacts of the connector plug, a support frame made of an insulation material that support and arrays the contacts of the connector receptacle, a first shell made of a metal extending in a direction in which the contacts of the connector receptacle are arrayed, and a second shell made of a metal extending in a direction in which the contacts of the connector receptacle are arrayed, wherein the first and second shells engage with each other so that the contacts of the connector receptacle and the support frame are disposed therebetween, and an insertion opening for inserting the connector plug is formed therebetween, and wherein the support frame has a fitting hole into which is press fit a first tab projecting from one of the first and second shells to the other shell.

8. The connector according to claim 7, wherein the tab is welded to the other shell.

9. The connector according to claim 7, wherein an insulation member for insulating between the first shell and each of the contacts of the connector receptacle is formed integrally to the first shell, and the insulation member has a press-fitting part to which is press fit a second tab projecting from the second shell toward the insulation member.

* * * * *

UNITED STATES PATENT AND TRADEMARK OFFICE

CERTIFICATE OF CORRECTION

PATENT NO. : 6,821,158 B2
DATED : November 23, 2004
INVENTOR(S) : M. Iida et al.

It is certified that error appears in the above-identified patent and that said Letters Patent is hereby corrected as shown below:

Column 18,
Line 64, “shoulders” should be -- shoulder --.

Column 19,
Line 13, after “inside” insert -- surface --.

Column 20,
Line 20, “support” should be -- supports --.

Signed and Sealed this

Twelfth Day of July, 2005

JON W. DUDAS
*Director of the United States Patent and Trademark Office*